US010255755B2

(12) United States Patent
Joao

(10) Patent No.: US 10,255,755 B2
(45) **Date of Patent: *Apr. 9, 2019**

(54) APPARATUS AND METHOD FOR FACILITATING GAMING ACTIVITY AND/OR GAMBLING ACTIVITY

(71) Applicant: Raymond Anthony Joao, Yonkers, NY (US)

(72) Inventor: Raymond Anthony Joao, Yonkers, NY (US)

(73) Assignee: GTJ VENTURES, LLC, Yonkers, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/163,140

(22) Filed: Oct. 17, 2018

(65) Prior Publication Data

US 2019/0051104 A1 Feb. 14, 2019

Related U.S. Application Data

(63) Continuation of application No. 16/012,838, filed on Jun. 20, 2018, now Pat. No. 10,147,266, which is a (Continued)

(51) Int. Cl.
*G07F 17/32* (2006.01)

(52) U.S. Cl.
CPC ..... *G07F 17/3237* (2013.01); *G07F 17/32* (2013.01); *G07F 17/3223* (2013.01); *G07F 17/3244* (2013.01); *G07F 17/3288* (2013.01)

(58) Field of Classification Search
CPC ..... G07F 17/3237; G07F 17/3288; G07F 17/3223; G07F 17/3244; G07F 17/32
See application file for complete search history.

(56) References Cited

U.S. PATENT DOCUMENTS 6,104,815 A * 8/2000 Alcorn ..... A63F 13/12 380/251
8,690,657 B2 4/2014 D'Angelo
(Continued)

OTHER PUBLICATIONS

PCT/US03/25122, Feb. 19, 2004, Hannan, et al.
(Continued)

*Primary Examiner* — Jasson H Yoo
(74) *Attorney, Agent, or Firm* — Raymond A. Joao, Esq.

(57) ABSTRACT

A method, including: detecting, with a computer, a posting of information regarding a gaming activity, gambling activity, or sporting event; generating a notification message regarding the same; initiating a communication link with, and transmitting the notification message to, a first communication device as an electronic transmission, or transmitting the notification message as an electronic mail message; receiving a bet message transmitted from the first communication device or a second communication device, wherein the first communication device or the second communication device comprises a global positioning device which determines a position or location of the first communication device or second communication device, wherein the bet message contains information regarding a bet to be placed regarding the activity or event, and information regarding the position or location of the first communication device or second communication device; and determining whether the bet is allowed or disallowed using the position or location information.

20 Claims, 36 Drawing Sheets

Related U.S. Application Data continuation of application No. 15/928,364, filed on Mar. 22, 2018, now Pat. No. 10,043,341, which is a continuation of application No. 14/987,286, filed on Jan. 4, 2016, now Pat. No. 9,965,920, which is a continuation of application No. 12/218,271, filed on Jul. 14, 2008, now abandoned, which is a continuation-in-part of application No. 10/440,888, filed on May 19, 2003, now abandoned.

(60) Provisional application No. 60/384,707, filed on May 31, 2002.

(56) References Cited

U.S. PATENT DOCUMENTS

| | | | | |
|---|---|---|---|---|
| 9,965,920 | B2 * | 5/2018 | Joao | G07F 17/32 |
| 10,043,341 | B1 * | 8/2018 | Joao | G07F 17/32 |
| 10,147,266 | B2 * | 12/2018 | Joao | G07F 17/3237 |
| 2002/0183105 | A1 * | 12/2002 | Cannon | G07F 17/32 463/16 |
| 2004/0029627 | A1 | 2/2004 | Hannan et al. | |
| 2014/0148238 | A1 | 5/2014 | D'Angelo | |

OTHER PUBLICATIONS

Hannan, et al., U.S. Appl. No. 10/392,138, filed Mar. 19, 2003, Entire Document.

Hannan, et al., U.S. Appl. No. 60/443,360, filed Jan. 29, 2003, Entire Document.

Hannan, et al. U.S. Appl. No. 60/402,814, filed Aug. 12, 2002, Entire Document.

Hannan, et al., PCT/US03/25122, Feb. 19, 2004, Published (International Publication Date) Feb. 19, 2004, Entire Document.

* cited by examiner

20

30

40

50

60

APPARATUS AND METHOD FOR FACILITATING GAMING ACTIVITY AND/OR GAMBLING ACTIVITY

RELATED APPLICATIONS

This application is a continuation application of U.S. patent application Ser. No. 16/012,838, filed Jun. 20, 2018, and entitled "APPARATUS AND METHOD FOR FACILITATING GAMING ACTIVITY AND/OR GAMBLING ACTIVITY", now U.S. Pat. No. 10,147,266, the subject matter and teachings of which are hereby incorporated by reference herein in their entirety, which application is a continuation application of U.S. patent application Ser. No. 15/928,364, filed Mar. 22, 2018, and entitled "APPARATUS AND METHOD FOR FACILITATING GAMING ACTIVITY AND/OR GAMBLING ACTIVITY", now U.S. Pat. No. 10,043,341, the subject matter and teachings of which are hereby incorporated by reference herein in their entirety, which application is a continuation application of U.S. patent application Ser. No. 14/987,286, filed Jan. 4, 2016, and entitled "APPARATUS AND METHOD FOR FACILITATING GAMING ACTIVITY AND/OR GAMBLING ACTIVITY", now U.S. Pat. No. 9,965,920, the subject matter and teachings of which are hereby incorporated by reference herein in their entirety, which application is a continuation application of U.S. patent application Ser. No. 12/218,271, filed Jul. 14, 2008, and entitled "APPARATUS AND METHOD FOR FACILITATING GAMING ACTIVITY AND/OR GAMBLING ACTIVITY", now abandoned, the subject matter and teachings of which are hereby incorporated by reference herein in their entirety, which application is a continuation-in-part application of U.S. patent application Ser. No. 10/440,888, filed May 19, 2003, and entitled "APPARATUS AND METHOD FOR FACILITATING GAMING ACTIVITY AND/OR GAMBLING ACTIVITY", now abandoned, the subject matter and teachings of which are hereby incorporated by reference herein in their entirety. U.S. patent application Ser. No. 10/440,888 claims the benefit of the priority of U.S. Provisional Patent Application Ser. No. 60/384,707, filed May 31, 2002, entitled "APPARATUS AND METHOD FOR FACILITATING GAMING ACTIVITY AND/OR GAMBLING ACTIVITY", the subject matter and teachings of which are hereby incorporated by reference herein in their entirety.

FIELD OF THE INVENTION

The present invention pertains to an apparatus and method for facilitating gaming activity and/or gambling activity and, in particular, to an apparatus and method for facilitating gaming activity and/or gambling activity via a user communication device.

BACKGROUND OF THE INVENTION

Many individuals like to gamble or like to engage in gaming activities and/or gaming events. People have typically been known to flock to casinos and/or other gaming establishments, racetracks, and/or other gaming venues and/or gambling venues. People also enjoy placing bets and/or betting or wagering on sporting events or other activities. People also enjoy playing lottery games.

While many individuals enjoy gambling and/or enjoy engaging in gaming activities and/or gambling activities, they may not always have access to particular gaming venues or gaming activities. Further, while many individuals may also be interested in making a gaming and/or gambling experience more interesting, more challenging, and/or more exciting, they typically do not have access to certain information, products, and/or services, for enhancing their experience or experiences.

In view of the above, prior art gaming systems and/or gambling systems, as well as conventional gaming practices and/or gambling practices, have failed to provide the gaming community with services, products, and/or other offerings, which would provide for more enhanced gaming and/or gambling activities, environments, and/or experiences.

SUMMARY OF THE INVENTION

The present invention pertains to an apparatus and method for facilitating gaming activity and/or gambling activity which overcomes shortfalls in the prior art. The present invention pertains to an apparatus and method for facilitating gaming activity and/or gambling activity via a user communication device. The present invention can be utilized in order to allow a user to engage in gaming activity and/or gambling activity via a user communication device. The present invention can also be utilized in order to facilitate gaming activity and/or gaming activity in a network environment.

The present invention can also be utilized in order to allow a user or individual to select a gaming event(s) or a gambling event(s). The user or individual can place bets via a user communication device.

The present invention can also be utilized in order to allow a user or individual to pre-request to receive information regarding the occurrence of a gaming event or a gambling event. The present invention can also provide a real-time as well as a non-real-time alert or notification message to a user or individual communication device informing the user or individual of any one or more of a gaming event, a gambling event, gaming activity, gambling activity, and/or of information regarding a gaming event and/or a gambling event.

The present invention can also be utilized in order to provide account security for any one or more of a financial account(s), bank account(s), checking account(s), automated teller machine (ATM) account(s), credit card account(s), charge card account(s), debit card account(s), smart card account(s), currency card account(s), electronic money account(s), a wireless communication device account(s), and/or a cellular communication device account(s), utilized in conjunction with a gaming account.

The present invention can also provide for the administration and management of financial accounts for any of the users, individuals, casinos, gaming facilitators, gambling facilitators, betting halls, betting venues, vendors, sports gaming facilitators, race tracks, sports betting arenas, sports arenas, sports stadiums, financial intermediaries, banks, financial institutions, and/or any other entities described herein. The present invention can also be utilized to administer escrow accounts for gaming activity, gambling activity, and/or betting activity.

The present invention can also be utilized in order to provide notification to a user or individual regarding when a withdrawal(s) is/are made from any of the user's or individual's financial account(s), bank account(s), checking account(s), automated teller machine (ATM) account(s), credit card account(s), charge card account(s), debit card account(s), smart card account(s), currency card account(s), and/or electronic money account(s), which are associated with the user's gaming account.

The present invention can also be utilized in order to provide notification to a user or individual regarding when a deposit(s) is/are made to any of the user's or individual's financial account(s), bank account(s), checking account(s), automated teller machine (ATM) account(s), credit card account(s), charge card account(s), debit card account(s), smart card account(s), currency card account(s), and/or electronic money account(s).

The present invention can also be utilized in order to allow any of the herein-described users, individuals, casinos, gaming facilitators, gambling facilitators, betting halls, betting venues, vendors, sports gaming facilitators, race tracks, sports betting arenas, sports arenas, sports stadiums, financial intermediaries, banks, financial institutions, and/or any other entities, to transfer funds electronically to and/or from any of the herein-described gaming accounts and/or other accounts utilized in conjunction with the present invention.

The present invention can also be utilized in order to allow a user or individual to access, and/or make withdrawals from, any one or more or bank accounts, savings accounts, checking accounts, automated teller machine accounts (ATM), credit card accounts, charge accounts, debit card accounts, smart card accounts, currency card accounts, and/or electronic money accounts, in order to place a bet and/or to pay off a bet.

The present invention can also be utilized in order to facilitate gaming activity and/or gambling activity from a remote location. The present invention can also be utilized in order to facilitate gaming activity and/or gambling activity at a gaming venue remote from the user's or individual's physical location. The present invention can also be utilized in order to allow a user or individual to participate in live gaming activity and/or gambling activity via a user communication device.

The present invention can be utilized in order to allow a user or individual to engage in gaming activity, and/or place bets, at one gaming establishment, or at a plurality of gaming establishments, remotely via a user communication device.

The present invention can also be utilized in order to allow a remote user(s) or player(s) to place virtual betting pieces, chips, and/or currency, at a respective gaming table, gaming machine, or slot machine, etc. In this embodiment, a display screen can be located at or adjacent to a respective gaming table, gaming machine, or slot machine, etc. A remote user(s) or player(s) can also utilize a display screen and one or more user input devices or user interactive devices in order to view a user's or player's betting inventory of virtual betting pieces, chips, and/or currency which the user or player can virtually "move" to the respective gaming table, gaming machine, or slot machine, etc., in order to place a bet at the respective gaming table, gaming machine, or slot machine, etc.

The user's display screen, which can be a component of, or associated with, the user's user communication device or computer, can display the user's inventory of virtual betting pieces, chips, and/or currency, show the movement of the user's virtual betting pieces, chips, and/or currency, to the respective gaming table, gaming machine, or slot machine, etc., and show any virtual betting pieces, chips, and/or currency, of the house or of any other remote users or players.

The user or player can utilize an input device or an interactive device in order to "drag" virtual betting pieces, chips, and/or currency, from the user's inventory to the respective gaming table, gaming machine, or slot machine, etc. A user's winnings can also be transferred to the user's inventory of virtual betting pieces, chips, and/or currency.

The present invention can also be utilized so as to allow a user or users to engage in gaming activity and/or gambling activity at remotely accessed gaming venues, tables, or machines, etc.

The present invention can also be utilized to monitor and control a user's gaming activities. A user communication device which can be utilized for remote gaming activity can be programmed to user's gaming account or communication device by others. A central processing computer or server computer which can be utilized during a use of the present invention can also be programmed to limit or restrict a user's gaming activities or the use of the user's gaming account or communication device by others.

A computer or server computer associated with a gaming establishment, such as, but not limited to, a casino, a racetrack, a stadium, an arena, or an off-track betting establishment, etc., can also be programmed to limit or restrict a user's gaming activities or the use of the user's gaming account or communication device by others.

The limitations or restrictions on use of a user's gaming account or communication device can include a limitation or a restriction of a negative limitation or restriction (i.e. a gaming activity which is not allowed to be engaged in; or a time period(s) during which gaming activities are not allowed, etc.) or a positive limitation or restriction (i.e. a gaming activity allowed to be engaged in, or a time period(s) during which gaming activities are allowed, etc.).

The limitation or restriction can include a name of a user of a gaming account, a name of an authorized user of a gaming account, a name of a user or names of users allowed to use a gaming account, gaming activities which are allowed on a gaming account, gaming activities which are not allowed on a gaming account, betting limits on a gaming account, account spending limits on a gaming account, daily betting amount limits on a gaming account, weekly betting amount limits on a gaming account, monthly betting amount limits on a gaming account, yearly betting amount limits on a gaming account, allowed gaming venues, disallowed gaming venues, allowed betting time period(s), disallowed betting time period(s), allowed games which can be bet on, disallowed games which can be bet on, allowed team(s) and/or player(s) which can be bet on, allowed betting amount, disallowed betting amounts, allowed betting venues, locations or places, disallowed betting venues, locations, or places, stop loss limits, allowed betting subject matter, or disallowed betting subject matter, etc., and/or any other limitation or restriction described herein and/or which could otherwise be envisioned for any of the gaming or gambling activities with which the apparatus and method of the present invention can be utilized.

The present invention can also perform financial account administration for a user. In this regard, the present invention, and/or any of the user communication devices, central processing computers, server computers, and/or any computer or computer system associated with any of the entities described herein as being able to utilize or participate in the use or operation of the present invention, can be programmed and/or be capable of maintaining a financial gaming account or accounts for any of the users or players described herein, perform credit and/or debit operations regarding financial gaming accounts, perform account record-keeping, perform tax withholding with regards to the financial gaming accounts, report taxable events to the appropriate taxing authorities, maintain periodic records of winnings and losses for the financial gaming accounts, provide periodic transaction summaries and/or gaming account statements for the financial gaming accounts, including the transactions or activities engaged in and any winnings or losses resulting therefrom. The present invention, or any of the computers, computer systems, and/or servers, can be programmed to automatically pay withholding taxes on gaming winnings for a user or player, and can automatically perform any of the herein-described functions.

The present invention can also be utilized to provide information for and/or to promote gaming activities or gambling activities. Information regarding gaming activities or gambling activities can be stored at a central processing computer or server computer. Information regarding a gaming activity or event (i.e. games at a casino, or a sporting event, etc.) can be entered by an individual or enterprise who or which may access the central processing computer or server computer and transmit the information regarding the gaming activity or event to the central processing computer or server computer which can then store the information in memory. A user can access the central processing computer and request information regarding any gaming activity or event and receive the information if such information exists.

The present invention can also notify a user or player regarding the posting or information regarding a new gaming activity or event, and/or of new or changed odds regarding a gaming activity or event. The notification can be provided in the form of information provided in real-time and/or otherwise, as any one or more of an electronic transmission, a communication transmission, a beeper message, a pager message, an instant message, an electronic mail message, a telephone message, a telephone call, a facsimile transmission, and/or any other communication transmission to any of the user communication devices described herein as being utilized in conjunction with the present invention. The present invention can provide wireless alerts to the user or player in order to provide the herein-described notification operations.

The present invention can also be utilized so as to allow a user or player to program a respective central processing computer to provide notification to the user or player of any new gaming activities or gaming events about which the user or player desires to be notified.

The present invention can also be utilized to allow a user or player to access a central processing computer and search for a gaming activity, gaming activities, a gaming event, or gaming events, in which the user or player may desire to bet or participate.

The present invention can also be utilized in order to provide information regarding gaming activities, gaming events, gambling activities, and/or gambling events. A central processing computer or server computer can include a database of information and/or statistics regarding any of the gaming activities, gaming events, gambling activities, and/or gambling events, and/or any of the teams, players, athletes, participants, animals (i.e. horses in horse racing, etc.), which may be involved in or be the subject of any of the gaming activities, gaming events, gambling activities, and/or gambling events. Information can, for example, include, but not be limited to, a casino's win percentage for a slot machine or for a table game, the average winnings of the house, users' or players' winning percentages, users' or players' losing percentages, average losses by a users or players, a professional boxer's won/loss record, a sports team's won/loss record and/or historic record against another team, a respective athlete's batting average, rushing average, or scoring average, etc., and past statistics or performance against a specific opponent, a race horse's racing won/loss record and/or statistics in a given setting, and/or any other information which a user or player may be interested in obtaining in order to make a more informed bet.

The present invention can also be utilized in order to facilitate gaming or gambling on gaming derivatives and/or gambling derivatives. For example, a bet could be made by a user or player that a casino or house may win a certain amount of money during a pre-specified time period, that a casino or house may make a certain level or amount of payoffs to winning users or players during a pre-specified time period, that a casino or house may win a certain amount to money from a particular game, games, gaming activity, or gaming activities, etc., during a pre-specified time period, that a casino or house may win more bets than it loses during a pre-specified time period and/or in a particular game, games, gaming activity, or gaming activities, etc., that users or players, as a whole, may win more bets than they lose during a pre-specified time period and/or in a particular game, games, gaming activity, or gaming activities, etc., and/or the percentage of time that spreads are met in outcomes of gaming activities and/or gaming events.

The present invention can be utilized in order to allow or facilitate the making of bets and/or the providing for gaming activities and/or gambling activities involving any derivative bets which can be made on any and/or all facets of a gaming environment and/or a gambling environment.

The present invention can also be utilized in order to allow a user or player to purchase gaming loss insurance and/or gambling loss insurance which can provide insurance coverage for gaming losses and/or gambling losses. The present invention can also facilitate the sale of gaming loss insurance policies and/or gambling loss insurance policies. The present invention can also provide a credit derivative product in the form of a gaming loss insurance credit derivative and/or a gambling loss credit derivative which can be an instrument which a provider or facilitator of the respective gaming loss insurance policies and/or the gambling loss insurance policies can issue to in order to reduce its risk of loss for claims made and required to be paid pursuant to the respective gaming loss insurance policies and/or the gambling loss insurance policies.

In this regard, the present invention can provide a credit derivative or instrument to users or players which will enable the provider of the respective insurance policy to reduce its risk of loss in the event of claims paid out to insureds under the respective policies and which enable a user or player to invest in and/or bet that the insurance policy provider will take in more from premiums under the respective insurance policies than it pays out to claimants under the respective insurance policies.

The present invention can also notify users or players of the availability of the herein-described gaming loss insurance policies and/or gambling loss insurance policies and/or of the availability of any of the herein-described gaming loss insurance credit derivatives and/or gambling loss insurance credit derivatives.

Users or players can purchase a gaming loss insurance policy and/or a gambling loss insurance policy via the apparatus and method of the present invention and the apparatus and method of the present invention can administer the respective policy or policies and service any claims made thereunder. A user or player can submit claims under the insurance policy or policies to a central processing computer or server computer which can administer the policy or policies and/or otherwise provide service or services pursuant to the policy or policies.

A user or player can also purchase a gaming loss insurance credit derivative(s) and/or a gambling loss credit derivative(s) via the apparatus and method of the present invention. A central processing computer can administer the sale and service of the respective gaming loss insurance credit derivative(s) and/or a gambling loss credit derivative(s).

The present invention can also be utilized in conjunction with state gaming activities of a respective state, country or sovereignty. In this manner, the present can be utilized in a manner consistent with gaming laws, rules, and/or regulations, in the various states, countries or sovereignties, in which, or in conjunction with which the present invention can be utilized. In this manner, the present invention can be utilized to facilitate compliance with the various and respective state, country, and/or sovereignty, gaming laws and/or gambling laws and/or so as to facilitate any reporting of gaming activities and/or gambling activities to the appropriate authorities and/or so as to facilitate any payments of fees and/or taxes relating to the gaming activities and/or gambling activities.

The present invention can also be utilized in order to facilitate the playing of state lottery games from any state or country.

The present invention can also provide for gaming activities and/or gambling activities on board any one or more of a gaming establishment or gambling establishment aboard a boat, ship, cruise ship, commercial boat or cruise ship, passenger boat, ferry, marine vehicle, marine vessel, aircraft, airplane, jet, passenger aircraft, shuttle aircraft, commercial aircraft, a train, a subway train, a bus, and/or an automobile, etc., which can allow or provide gaming activities and/or gambling activities on board same. The present invention can utilize global positioning technology at a user communication device and/or on board the respective boat, ship, cruise ship, commercial boat or cruise ship, passenger boat, ferry, marine vehicle, marine vessel, aircraft, airplane, jet, passenger aircraft, shuttle aircraft, and/or commercial aircraft, a train, a subway train, a bus, and/or an automobile, etc., in order to ascertain the jurisdiction in which the respective boat, ship, cruise ship, commercial boat or cruise ship, passenger boat, ferry, marine vehicle, marine vessel, aircraft, airplane, jet, passenger aircraft, shuttle aircraft, and/or commercial aircraft, a train, a subway train, a bus, and/or an automobile, etc., is located and apply the gaming laws and rules for the identified jurisdiction to the respective gaming activities and/or gambling activities.

The present invention can also be utilized in order to facilitate private gaming activities and/or gambling activities between two or more parties.

The present invention can be utilized in conjunction with any gaming activities, gambling activities, and/or games of chance, including, but not limited to, slot machine games, slots, Black Jack, Poker, Craps, Baccarat, Roulette wheel, Keno, Multispin, Multiline, Draw Poker, Reel games, Spin Poker, "21", pinball, Bingo, Solitaire, lottery games, state or other subdivision lottery games, Powerball lottery games, horse racing, dog racing, jailai, off track betting games, football games, professional football games, college football games, high school football games, little league football games, championship football games or series, baseball games, college baseball games, high school baseball games, little league baseball games, championship baseball games or series, basketball games, professional basketball games, college basketball games, high school basketball games, little league basketball games, championship basketball games or series, professional soccer games, college soccer games, high school soccer games, little league soccer games, championship soccer games or series, professional hockey games, college hockey games, hockey games, little league hockey games, championship hockey games or series, tennis matches, wresting matches, boxing matches, golf tournament, and/or games, matches, tournaments, and/or competitions, of any type or kind.

The present invention can also be utilized to provide gaming results or gambling results to a user or player.

The apparatus can include one or more of a central processing computer(s) or server computer(s), a user communication device(s), a gaming facility computer(s), a financial institution computer(s), an escrow agent computer(s), and/or a governmental entity computer(s), each of which can be capable of communicating with any of the other respective computers or user communication device(s). The apparatus can also include video equipment, audio equipment, and/or video conferencing equipment.

Any of the central processing computer(s) or server computer(s), the user communication device(s), the gaming facility computer(s), the financial institution computer(s), and/or the governmental entity computer(s), can any one or more of access, activate, de-activate, enable, and/or disable, any of the herein-described video equipment, audio equipment, and/or video conferencing equipment.

Each of central processing computer(s) or server computer(s), the gaming facility computer(s), the financial institution computer(s), the escrow agent computer(s), and/or the governmental entity computer(s), can have a web site or web sites associated therewith.

The present invention can be utilized over any suitable communication network and/or any combination of computer networks, including, but not limited to the Internet, the World Wide Web, a telecommunication network or system, a telephone network or system, a cable television communication network or system, a satellite television communication network or system, a digital television network or system, a satellite communication network or system, a broadband communication network or system, a radio frequency communication network or system, an optical communication network or system, a line-connected network or system, a wireless network or system, a radio communication network or system, a digital communication network or system, a personal communications services (PCS) network or system, a local area network (LAN), a wide area network (WAN), a wireless Internet network or system, a wireless World Wide Web network or system, an optical communication network or system, a broadband communication network or system, a Bluetooth communication network or system, a streaming video communication network or system, a streaming audio communication network or system, a live video communication network or system, and/or any other suitable communications network or system, and/or any combination(s) thereof.

Each of the central processing computer(s) or server computer(s), the user communication device(s), the gaming facility computer(s), the financial institution computer(s), and/or the governmental entity computer(s), can include a central processing unit (CPU), a read only memory (ROM) device, a random access memory (RAM) device, a user input device(s), a display device, an output device, a database(s), a receiver, a transmitter, and/or a global positioning device.

The present invention can be utilized in order to provide information regarding gaming activities, gaming events, gambling activities, and or gambling events as well as any information relating to the gaming event. The present invention can also be utilized in order to allow a user(s) or player(s) to place bets and/or otherwise engage or participate in the gaming event.

A central processing computer and/or a gaming facility computer can also process bets in order to allow the user to place bets on any of the gaming events which can be accessed via the central processing computer and/or any of the gaming facility computers.

A central processing computer and/or any of the gaming facility computers can also provide information to the user regarding any one or more of the gaming events.

The present invention can be utilized in order to allow a user to identify and/or select a gaming event, allow a user to obtain information regarding the gaming event or event players or participants, and allow a user to place a bet on the gaming event and thereby engage in gaming activity and/or gambling activity via the user communication device.

The gaming facility computer associated with a gaming facility can be utilized in order to perform any of the functionality described herein as being provided by the central processing computer.

A user or users can request to be notified upon an availability of a gaming event, a posting of a gaming event, and/or a presence of a gaming event.

A user can request to be notified upon a detected or identified availability of a gaming event, a scheduled happening of the gaming event, and/or any other information regarding the gaming event or its participants. A user can also request any of the additional information (i.e. lottery odds of winning, last winning draw, last winning pay out, odds of winning, slot pay outs, frequency of user wins, amount of user wins, frequency of user wins at any table games, amount of user wins at table games, roulette wheel wins by users, amounts of roulette wins, teams records, sports players records, averages, and/or statistics, and/or any statistical and/or historical records regarding any of the herein-described gaming events, information regarding previous winning numbers and the probabilistic information regarding same, player statistics against an opposing team, historical records regarding prior meetings of the teams, player injuries, or line-ups for the game, etc., and any other information which a user may find desirable in having prior to placing a bet on a gaming event, etc.).

A user can also access the central processing computer and/or a particular gaming facility computer via a user communication device and transmit a message to the central processing computer and/or a particular gaming facility computer. The message can contain information regarding the identity, type, or kind, of gaming event, for which the user desires to be notified.

The message can also contain information regarding a request to receive notification of gaming events having certain betting limits (i.e. maximum bets, or minimum bets, etc.), notification of gaming events having certain winning odds, notification of gaming events having certain participants or teams involved, notification of gaming events having a certain prize (i.e. lottery games over $25 Million, etc.), and/or notification of gaming events having certain criteria of interest to the user. The message can also contain a user authorization to the respective central processing computer and/or gaming facility computer to automatically place a bet for the user.

A user can also request to be notified if betting odds change regarding an gaming event (i.e. a certain race horse is now paying two to one odds), a handicap or spread for a game has changed (i.e. the NFC team in the NFL Super Bowl formerly favored by three points is now favored by ten points over the AFC team, etc.). Information regarding these types of requests can also be contained in the message transmitted by the user to the central processing computer and/or the particular gaming facility computer.

The central processing computer and/or the gaming computer can detect a gaming event or gaming events for which the user has desired to be notified and can notify the user regarding the gaming event or gaming events by transmitting a user notification message to the user communication device associated with the user.

The user notification message can contain information regarding the gaming event or gaming events, any additional requested information regarding the gaming event or gaming events (i.e. lottery odds of winning, last winning draw, last winning pay out, odds of winning, slot pay outs, frequency of user wins, amount of user wins, frequency of user wins at any table games, amount of user wins at table games, roulette wheel wins by users, amounts of roulette wins, teams records, sports players records, averages, and/or statistics, and/or any statistical and/or historical records regarding any of the herein-described gaming events, information regarding previous winning numbers and the probabilistic information regarding same, player statistics against an opposing team, historical records regarding prior meetings of the teams, player injuries, or line-ups for the game, etc., and any other information which a user may find desirable in having prior to placing a bet on a gaming event, etc.), and, if the user programmed or requested that a bet be placed automatically, information regarding the placing of the bet or bets.

The present invention can also be utilized in order to provide notification to an individual account holder of a gaming account or a user of a gaming account that the account has been utilized or is being utilized. The present invention can also be utilized in order to provide a user or other individual gaming account holder with notification of gaming account use.

The present invention can also be programmed to cancel and/or to de-activate a gaming account if a pre-determined number of disallowed gaming activities are determined to have occurred on the account.

The present invention can also be utilized in order to provide notification to a user or individual gaming account holder regarding a withdrawal made from a gaming account and/or a deposit made to a gaming account.

The present invention can also be programmed to cancel and/or to de-activate a gaming account if a pre-determined number of disallowed withdrawals, attempted withdrawals, deposits, or attempted deposits, are determined to have occurred on the account.

The present invention can be utilized in order to facilitate gaming activity and/or gambling activity from a remote location. The present invention can also be utilized in order to facilitate gaming activity and/or gambling activity at a gaming venue remote from a user's or individual's physical location. The present invention can also be utilized in order to facilitate a user or individual participating in live gaming activity and/or gambling activity via a user communication device. The present invention can also be utilized in order to allow a user or individual to engage in gaming activity, and/or place bets, at one or at a plurality of gaming establishments remotely via a user communication device.

The present invention can also be utilized in order to allow a remote player(s) to place virtual betting pieces, chips, and/or currency, at a respective gaming table, gaming machine, or slot machine, etc. In this embodiment, a display screen can be located at or adjacent to a respective gaming table, gaming machine, or slot machine, etc.

A remote user(s) can also utilize a display screen and one or more user input devices or user interactive devices in order to view a betting inventory of virtual betting pieces, chips, and/or currency which the user or player can virtually "move" to the respective gaming table, gaming machine, or slot machine, etc., in order to place a bet at the respective gaming table, gaming machine, or slot machine, etc.

The user's display screen, which can be a component of, or associated with, the user's user communication device or computer, can display the user's inventory of virtual betting pieces, chips, and/or currency, show the movement of the user's virtual betting pieces, chips, and/or currency, to the respective gaming table, gaming machine, or slot machine, etc., and show any virtual betting pieces, chips, and/or currency, of the house or of any other remote users or players.

The user or player can utilize an input device or an interactive device to place remote bets. A user's winnings can also be transferred to the user's inventory of virtual betting pieces, chips, and/or currency. The present invention can also be utilized so as to allow a user or users to engage in gaming activity and/or gambling activity at remotely accessed gaming venues, tables, or machines, etc.

The present invention can also be utilized in order to allow a user to limit and/or restrict use of his or her gaming account or gaming accounts. The user and/or individual gaming account holder can pre-limit and/or pre-restrict gaming account activity or gaming account use by utilizing the present invention. The present invention can determine whether a gaming activity is allowed and disallowed.

The limitation(s) or restriction(s) can be positive limitation(s) or restriction(s), defined herein to mean a limitation or restriction which if met allows the gaming activity on the gaming account (i.e. gaming activity only for a certain game, a time period during which gaming activity can occur, or a gaming facility where gaming activities are allowed, etc.) and/or the limitation(s) and/or restriction(s) can be negative limitation(s) or restriction(s), meaning a limitation(s) or restriction(s) which if met disallows the gaming activity (i.e. a time period during which gaming activity is disallowed, a gaming activity which is not allowed, or a gaming facility at which a user is not allowed to engage in gaming activities, etc.).

The limitation(s) and/or restriction(s) can, for example, include a name of a user of a gaming account, a name of an authorized user of a gaming account, a name of a user or names of users allowed to use a gaming account, gaming activities which are allowed on a gaming account, gaming activities which are not allowed on a gaming account, betting limits on a gaming account, account spending limits on a gaming account, daily betting amount limits on a gaming account, weekly betting amount limits on a gaming account, monthly betting amount limits on a gaming account, yearly betting amount limits on a gaming account, allowed gaming venues, disallowed gaming venues, allowed betting time period(s), disallowed betting time period(s), allowed games which can be bet on, disallowed games which can be bet on, allowed team(s) and/or player(s) which can be bet on, allowed betting amount, disallowed betting amounts, allowed betting venues, locations or places, disallowed betting venues, locations, or places, stop loss limits, allowed betting subject matter, or disallowed betting subject matter, etc., and/or any other limitation or restriction described herein and/or which could otherwise be envisioned for any of the gaming or gambling activities with which the apparatus and method of the present invention can be utilized.

The present invention can also be utilized in order to control and/or monitor use of a gaming account.

The present invention can also perform financial account administration for a user. The present invention can provide a system for allowing a user to establish gaming accounts and engage in gaming activities via the gaming accounts. The user can establish financial gaming accounts or gaming fund accounts from which to withdraw funds for gaming activities and/or bets. A user's winnings can also be deposited into these accounts.

The present invention can be utilized to administer, provide account and/or record keeping for, withhold and/or pay income taxes on winnings, reconcile winnings and losses for a user, withdraw and pay gaming fees and/or dues and/or other charges incurred in connection with utilizing the gaming account(s) described herein and/or the present invention (i.e. gaming fees, gaming activity fees, account dues, or account servicing fees, etc.). The present invention can also provide gaming account statements, gaming account activity statements, or reports to third parties, etc. regarding any gaming account(s).

The present invention can also provide an apparatus or system which can be programmed and/or can be capable of maintaining a financial gaming account or accounts for any of the users or players described herein, perform credit and/or debit operations regarding financial gaming accounts, perform account record-keeping, perform tax withholding with regards to the financial gaming accounts, report taxable events to the appropriate taxing authorities, maintain periodic records of winnings and losses for the financial gaming accounts, provide periodic transaction summaries and/or gaming account statements for the financial gaming accounts, including the transactions or activities engaged in and any winnings or losses resulting therefrom.

The present invention, or any of the computers, computer systems, and/or servers, utilized in conjunction therewith can also be programmed to automatically pay withholding taxes on gaming winnings for a user or player, and can automatically perform any of the herein-described functions. A user can select the gaming account services he or she desired to be provided with by the present invention.

The present invention can also be utilized in order to provide information for and/or to promote or advertise gaming activities, gaming events, gambling activities, and/or gambling events (hereinafter referred to as "gaming activities and/or gaming events"). Information regarding gaming activities and/or gaming events can be stored at a respective central processing computer and/or gaming facility computer.

Information regarding a gaming activity and/or gaming event (i.e. a game(s) at a casino or betting hall, a horse race, or a sporting event, etc.) can be entered by an individual or enterprise who or which may access the central processing computer and/or gaming facility computer and transmit the pertinent information and/or enter the pertinent information regarding the gaming activity and/or gaming event into the respective central processing computer and/or gaming facility computer so as to thereby "post" the information at the respective central processing computer and/or gaming facility computer.

The information regarding the gaming activity and/or gaming event can also include information regarding changed odds of winning, a changed score spread, an increased lottery prize or jackpot, a changed and/or updated historical and/or statistical information, and/or new and/or updated information regarding the gaming activity and/or gaming event, new and/or updated information and/or statistics regarding any of the gaming activities, gaming events, gambling activities, and/or gambling events, and/or any of the teams, players, athletes, participants, animals (i.e. horses in horse racing, etc.), which may be involved in or be the subject of any of the gaming activities, gaming events, gambling activities, and/or gambling events. New and/or updated information can also include, but not be limited to, a casino's win percentage for a slot machine or for a table game, the average winnings of the house, users' or players' winning percentages, users' or players' losing percentages, average losses by users or players, a professional boxer's won/loss record, a sports team's won/loss record and/or historic record against another team, a respective athlete's batting average, rushing average, or scoring average, etc., and past statistics or performance against a specific opponent, a race horse's racing won/loss record and/or statistics in a given setting, and/or any other information which a user or player may be interested in obtaining in order to make a more informed bet.

The present invention can alert a user of, and/or provide a user with, any new or updated information regarding a gaming activity and/or gaming event.

The information regarding the gaming activity and/or gaming event can then be stored in a respective database of a respective central processing computer and/or gaming facility computer and can be retrieved via a user search and/or user searching activity and/or by automatic message generation by the respective central processing computer and/or gaming facility computer. A user can also pre-request to be automatically notified, or receive an alert regarding a posting or postings of new gaming activities and/or gaming events and/or new and/or updated information regarding the gaming activity and/or gaming event.

The present invention can also be programmed to notify a user or player regarding the posting of information regarding a new gaming activity or event, and/or of new or changed information regarding the gaming activity and/or gaming event. A notification message can be provided in the form of information provided in real-time and/or otherwise, as any one or more of an electronic transmission, a communication transmission, a beeper message, a pager message, an instant message, an electronic mail message, a telephone message, a telephone call, a facsimile transmission, and/or any other communication transmission to any of the user communication devices described herein as being utilized in conjunction with the present invention. The present invention can also provide wireless alerts to the user or player in order to provide the herein-described notification operations.

A user can also program a respective central processing computer and/or gaming facility computer to provide him or her with notification of any new gaming activities or gaming events and/or new and/or updated information regarding gaming activities and/or gaming events about which the user desires to be notified.

A user can also access a respective central processing computer and/or gaming facility computer and search for information regarding a gaming activity, gaming activities, a gaming event, gaming events, and/or new and/or updated information regarding same.

The present invention can also be utilized in order to facilitate gaming or gambling on gaming derivatives and/or gambling derivatives. A gaming derivative and/or a gambling derivative can be a bet or a game of chance entered into with a counterparty which can, among other things, include, for example, a bet that a casino or betting house may win a certain amount of money during a pre-specified time period, a bet that a casino or betting house may make a certain level or amount of payoffs to winning users or players during a pre-specified time period, a bet that a casino or betting house may win a certain amount to money from a particular game, games, gaming activity, or gaming activities, etc., during a pre-specified time period, a bet that a casino or betting house may win more bets than it loses during a pre-specified time period and/or in a particular game, games, gaming activity, or gaming activities, etc., a bet that players and/or users, as a whole or group, may win more bets than they lose during a pre-specified time period and/or in a particular game, games, gaming activity, or gaming activities, etc., and/or a bet regarding the percentage of time(s) that spreads are met in outcomes of gaming activities and/or gaming events.

The present invention can be utilized in order to allow or facilitate the making of bets and/or the providing for gaming activities and/or gambling activities involving any of the above-described and/or any other derivative bets which can be made on any and/or all facets of a gaming environment and/or a gambling environment.

The present invention can be utilized in order to generate a gaming derivative and/or gambling derivative message containing information regarding the respective gaming derivatives and/or gambling derivatives, the type or kind of each gaming derivative and/or gambling derivative, the odds of winning corresponding to each gaming derivative and/or gambling derivative, and/or the price or cost of each gaming derivative and/or gambling derivative. The message can by transmitted to a user communication device in order to provide information contained therein to a user.

The present invention can also be utilized in order to select, identify, and/or recommend, a gaming derivative or derivatives and/or a gambling derivative or derivatives which may be suitable for the user, and generate a gaming derivative and/or gambling derivative message containing information regarding the selected, identified, and/or recommended gaming derivative(s) and/or gambling derivative(s).

The present invention can also be utilized in order to effectuate a sale of a gaming derivative and/or gambling derivative and provide administrative services, including effecting payment to a user or a user's gaming account if the user should be successful in the investment in his or her purchase of, bet on, and/or investment in, the respective gaming derivative and/or gambling derivative.

The present invention can be utilized in order to provide, and/or to allow a user or player to purchase, a gaming loss insurance policy or coverage and/or a gambling loss insurance policy or coverage which can provide insurance coverage for gaming losses and/or gambling losses. In this manner, a user can purchase a gaming loss insurance policy and/or a gambling loss insurance policy which can be underwritten by a gaming facility, an insurance provider, and/or any other third party underwriter.

The present invention can also facilitate the sale of gaming loss insurance policies and/or gambling loss insurance policies. The present invention can also facilitate the sale of a gaming loss insurance policy or coverage and/or a gambling loss insurance policy or coverage and/or can automatically process claims relating to and/or made pursuant to such gaming and/or gambling loss insurance policies and/or coverage. In this manner, a user can obtain insurance in order to mitigate any gaming losses or gambling losses which he or she may sustain.

The present invention can also be utilized in order to automatically select, identify, and/or recommend, a gaming loss insurance policy or policies and/or a gambling loss insurance policy or policies which may be suitable for the user, and generate a gaming loss insurance and/or gambling loss insurance message containing information regarding the selected, identified, and/or recommended policy or policies.

The present invention can be utilized in order to purchase the respective policy or policies and/or effectuate payment for the respective policy or policies by deducting the purchase price from the user's gaming account. The present invention can also automatically monitor the outcome of the bet or gaming activity covered by the respective gaming loss and/or gambling loss insurance policy or policies.

The present invention can determine an outcome of the bet or gaming activity covered by the respective gaming loss and/or gambling loss insurance policy or policies and determine the winner of the bet or gaming activity and, if applicable, automatically generate and process a claim or claims under the respective gaming loss and/or gambling loss insurance policy or policies and effectuate payment of any insurance proceeds to the user's gaming account.

The present invention can be utilized in order to provide a credit derivative product, in the form of a gaming loss insurance credit derivative and/or a gambling loss credit derivative, which can be an instrument which a gaming facility, a gaming loss insurance provider, and/or a gambling loss insurance provider, can sell and/or issue to a user or users of the present invention, and/or or to any other interested parties, in order to reduce its risk of loss associated with its exposure or potential exposure from the sale or issuance of the respective gaming loss insurance policies and/or gambling loss insurance policies.

The present invention can provide a credit derivative or instrument to users, players, or other parties, which will enable the provider(s) of the respective gaming loss insurance policies and/or gaming loss insurance policies to reduce its risk of loss in the event of claims paid out to user insureds under the respective policies.

The credit derivative can also enable the user to invest in, and/or bet and/or gamble on, whether a respective gaming loss insurance provider and/or gambling loss insurance provider will realize more revenues from premiums obtained under the respective insurance policies than it pays out to claimants under the respective insurance policies. In a situation wherein an insurer needs to pay out more for claims than it takes obtains in premiums, it can utilize the proceeds obtained from the sale of credit derivatives.

In another situation wherein an insurer pays out less in claims than it pays out in claims, it can return the purchase price plus a percentage return (i.e. interest payment, or payment for assuming the risk of the investment in the credit derivative, etc.) to the user or purchaser of the credit derivative.

The credit derivative can also be structured and/or devised in any other appropriate manner so as to cover an insured's risk of loss while providing a rate of return to the investing user or other party in the event the insured does not sustain a loss. The present invention can be utilized in order to identify a credit derivative suitable for the insurer.

The present invention can also be utilized in order to provide information regarding any credit derivative or credit derivatives to any users or other parties. The present invention can also be utilized in order to effectuate a sale of and administer process settlement transactions, if applicable, regarding same.

The present invention can also be utilized in order to notify users of the availability of any of the herein-described gaming loss insurance policies and/or gambling loss insurance policies and/or of the availability of any of the herein-described gaming loss insurance credit derivatives and/or gambling loss insurance credit derivatives. The users can thereafter effectuate a purchase of any of any of the herein-described gaming loss insurance policies and/or gambling loss insurance policies and/or of the availability of any of the herein-described gaming loss insurance credit derivatives and/or gambling loss insurance credit derivatives via the apparatus of the present invention and/or any of the computers or computer systems utilized in conjunction therewith.

The present invention can also administer the sale of, and/or process, and/or service, any claims and/or payments made to the user pursuant to a respective gaming loss insurance policies and/or gambling loss insurance policies and/or of the availability of any of the herein-described gaming loss insurance credit derivatives and/or gambling loss insurance credit derivatives.

The present invention can also be utilized in conjunction with state gaming activities of a respective state, country or sovereignty. As used herein the term "state" means any state, region, territory, and/or possession of the United States of America, any nation, country, sovereign state, monarchy, principality, and/or any region, territory, possession, and/or subdivision of same. In this manner, the present invention can be utilized in a manner consistent with gaming laws, rules, and/or regulations, in the various states, countries, or sovereignties, in which, or in conjunction with which, the present invention can be utilized.

The present invention can be utilized to facilitate compliance with the various and respective state, country, and/or sovereignty, gaming laws and/or gambling laws and/or so as to facilitate any reporting of gaming activities and/or gambling activities to the appropriate state, country, and/or sovereignty, authorities and/or so as to facilitate any payments of fees and/or taxes relating to the gaming activities and/or gambling activities.

The present invention can be utilized in a scenario in which each of the herein-described types or kinds of states may have gaming law, gaming regulations, gaming rules, gambling laws, gambling regulations, and/or gambling rules, in effect. In certain scenarios, certain states may only allow certain types of gaming and/or gambling (i.e. lotteries, or horse racing, etc.). In certain other scenarios, certain states may affirmatively ban certain types of gaming activities and/or gambling activities (i.e. card games, or sports gambling, etc.). In certain other scenarios, certain states may allow all gaming activities and/or gambling activities and/or allow same if supervised by a licensing authority and/or upon the payment of gaming fees and/or gambling fees.

The present invention can also be utilized in a scenario in which a state from which a remote gaming activity and/or gambling activity originates ("the originating state") would be deemed legal and/or in compliance with the originating state's gaming laws and/or gambling laws if any one or more of a gaming license is obtained by the user and/or the gaming facility involved in the gaming activity and/or gambling activity, a gaming fee is paid to the originating state, a gaming fee is paid to the originating state by the user and/or the gaming facility involved in the gaming activity and/or gambling activity for each gaming activity and/or gambling activity which occurs, and/or upon the satisfaction of any other originating state dictated requirements and/or the payment of any originating state prescribed fees. The gaming facility can be the operator of and/or be associated with any of the herein-described central processing computers and/or gaming facility computers.

It is envisioned that certain states either or both may claim jurisdiction over gaming activities and/or gambling activities which physically occur inside the state, on waters within the state's jurisdiction, and/or within the state's airspace, and/or that certain states may claim jurisdiction over remote gaming activities and/or gambling activities which originate from a user communication device which is permanently and/or temporarily inside the state, on waters within the state's jurisdiction, and/or within the state's airspace, at the time the remote gaming activity and/or gaming activity occurs or takes place.

For example, if a state claims jurisdiction over gaming activities and/or gambling activities which originate from a user communication device which is located inside the state, on waters within the state's jurisdiction, and/or within the state's airspace, at the time the remote gaming activity and/or gaming activity occurs or takes place, the state may require a license be obtained beforehand and/or afterward by the user and/or the gaming facility which is the counterparty to the gaming activity and/or gambling activity. In this manner, gaming activity and/or gambling activity, otherwise prohibited by a state's laws, can be legal and the state can realize financial revenues from such remote gaming activity and/or gambling activity.

The present invention can be utilized in order to administer remote gaming activity and/or gambling activity. The present invention can ascertain the state having jurisdiction over the remote gaming activity and/or gambling activity and/or can determine if the remote gaming activity and/or gambling activity is allowed by the state having jurisdiction over the remote gaming activity and/or gambling activity.

The present invention can also be utilized in order to effectuate payment of any gaming fee and/or gambling fee for the remote gaming activity and/or gambling activity to the originating state. The payment of any fee or fees to the originating state can be effectuated by an electronic monetary transmission and/or electronic transfer from a respective central processing computer and/or gaming facility computer to the governmental entity computer associated with the originating state. Any suitable accounting methods (i.e. account crediting, etc.) can also be utilized for effectuating payments to the originating state.

The present invention can also be utilized in order to allow a user to play lottery games in any number of states, countries, and/or other localities. The present invention can be utilized to determine a user's originating state and can facilitate the playing of a lottery game or games, including the collection of winnings and/or prizes for and/or on behalf of the user for any number of state lottery games.

The present invention can also be utilized in order to allow a user or user's to place remote bets, wagers, and/or otherwise engage in gaming activity and/or gambling activity from a vehicle. The present invention can also be utilized in order to provide for gaming activities and/or gambling activities on board any one or more of a gaming establishment or gambling establishment aboard a boat, ship, cruise ship, commercial boat or cruise ship, passenger boat, ferry, marine vehicle, marine vessel, aircraft, airplane, jet, passenger aircraft, shuttle aircraft, commercial aircraft, train, subway train, bus, automobile, and/or any other vehicle, etc.

The present invention can utilize global positioning technology at the user communication device and/or at a central processing computer and/or a gaming facility computer on board the respective boat, ship, cruise ship, commercial boat or cruise ship, passenger boat, ferry, marine vehicle, marine vessel, aircraft, airplane, jet, passenger aircraft, shuttle aircraft, and/or commercial aircraft, a train, a subway train, a bus, and/or an automobile, etc., in order to ascertain the jurisdiction in which the respective boat, ship, cruise ship, commercial boat or cruise ship, passenger boat, ferry, marine vehicle, marine vessel, aircraft, airplane, jet, passenger aircraft, shuttle aircraft, commercial aircraft, train, subway train, bus, automobile, and/or any other vehicle, on which any one or more of the respective user communication device, central processing computer, and/or gaming facility computer, is located and apply the gaming laws and rules for the identified jurisdiction in which the respective user communication device, central processing computer, and/or gaming facility computer, is located, to the respective gaming activities and/or gambling activities.

The present invention can also facilitate and/or effectuate the payment of any gaming activities and/or gambling activity fees to an appropriate state or states.

The present invention can also be utilized in order to allow a user to purchase lottery tickets for lotteries in any number of states and/or countries. The present invention can also provide a user with an alert, in real-time and/or otherwise, when a lottery is available and/or when a lottery prize reaches a certain prize amount. The present invention can also monitor the results of the various state lotteries and receive any winnings on behalf of the user which can be electronically transferred into the user's gaming account.

The present invention can also perform any and/or all of the gaming account administration processing routines and/or functionality such as, but not limited to, recording a user's winnings, recording a user's losses, recording a user's net winnings, recording a user's net losses, reporting a user's winnings and/or losses to appropriate taxing authorities, withholding income taxes for a user, or paying withholding taxes to a taxing authority, etc.

The present invention can also be utilized to effectuate a purchase of a lottery ticket and/or lottery tickets for any particular state lottery and/or for any number of state lotteries.

The present invention can also be utilized process lottery winning results in conjunction with the lottery numbers or lottery ticket(s) held by the user, or which can be held by the user. The present invention can also collect winnings for, or on behalf of, the user. The present invention can also any one or more of receive electronic transfers of a user's winnings on behalf of the user, pay a user's withholding taxes and/or income taxes on winnings, and/or report the user's gaming activities to an appropriate governmental entity. The present invention can also effectuate payment of any due gaming activity fee and/or gambling activity fee to the originating state.

The present invention can also be utilized in order to allow a user to identify and/or locate a gaming activity, a gaming event, a gambling activity, and/or a gambling event, to bet or wager on and/or to locate a counterparty or counterparties interested in betting and/or wagering on a gaming activity, a gaming event, a gambling activity, and/or a gambling event. The present invention can also be utilized in order to allow users to engage in private bets, private gaming activity, private gaming events, private gambling activities, and/or private gambling events, with other users.

The present invention can be utilized in order to allow the user to post his or her bet for a certain gaming activity, gaming event, gambling activity, and/or gambling event, on a respective central processing computer and/or gaming facility computer. Another user or users can place a bet or wager as a counterparty or counterparties to the bet for any of the bets on a posted gaming activity, gaming event, gambling activity, and/or gambling event.

The present invention can also be utilized in order to allow a user to program the present invention to notify him or her if and/or when another user posts a certain bet for a certain gaming activity, gaming event, gambling activity, and/or gambling event. Upon the posting of the bet for the certain gaming activity, gaming event, gambling activity, and/or gambling event, the present invention can generate and transmit a notification message to the requesting user. Thereafter, the user may access a respective central processing computer and/or gaming facility computer and decide to be that counterparty or one of the counterparties to the particular bet on the particular gaming activity, gaming event, gambling activity, and/or gambling event.

The present invention can also determine whether the respective bet, gaming activity, gaming event, gambling activity, and/or gambling event, is legal in all appropriate jurisdictions. The present invention can also be utilized to administer the bet or bets and/or to hold bets in escrow for respective parties to a bet. The present invention can be utilized in order to determine a winner or winners of a bet and effectuate payment of winnings to a winning user's gaming account.

The present invention can be utilized in order to facilitate gaming activity and/or gambling activity in numerous preferred embodiments. The present invention can also be utilized in order to facilitate gaming activity and/or gambling activity by remote users or players who can be located anywhere in the world and/or who can be located at any physical distance from a respective gaming facility, gaming activity, gaming event, gambling activity, and/or gambling event.

The present invention can be utilized in conjunction with any one or combination of the Internet, the World Wide Web, a telecommunication network, a satellite communication network, a cable television network, a satellite television network, a digital television network, a digital communication network, a radio frequency network, a broadband network, an optical communication network, and/or any other communication network described herein and/or otherwise, in order to allow users or players to engage in gaming activity and/or gambling activity.

Any signals, messages, reports, and/or notifications, provided by the present invention can also contain an advertisement or advertisements.

Accordingly, it is an object of the present invention to provide an apparatus and method for facilitating gaming activity and/or gambling activity.

It is another object of the present invention to provide an apparatus and method for facilitating gaming activity and/or gambling activity which can facilitate gaming activity and/or gambling activity via a user communication device.

It is still another object of the present invention to provide an apparatus and method for facilitating gaming activity and/or gambling activity which can facilitate gaming activity and/or gambling activity via a communication network.

It is yet another object of the present invention to provide an apparatus and method for facilitating gaming activity and/or gambling activity which can process information regarding gaming activity and/or gambling activity.

It is another object of the present invention to provide an apparatus and method for facilitating gaming activity and/or gambling activity which can provide information regarding gaming activity and/or gambling activity.

It is still another object of the present invention to provide an apparatus and method for facilitating gaming activity and/or gambling activity which can provide process information regarding gaming activity and/or gambling activity.

It is yet another object of the present invention to provide an apparatus and method for facilitating gaming activity and/or gambling activity which can allow a user to engage in gaming activity and/or gambling activity via a user communication device.

It is another object of the present invention to provide an apparatus and method for facilitating gaming activity and/or gambling activity which facilitates allowing a user to engage in gaming activity and/or gaming activity in a network environment.

It is still another object of the present invention to provide an apparatus and method for facilitating gaming activity and/or gambling activity which can allow a user or individual to select a gaming event(s) or a gambling event(s).

It is yet another object of the present invention to provide an apparatus and method for facilitating gaming activity and/or gambling activity which can be utilized in order to allow a user or individual to pre-request to receive information regarding the occurrence of a gaming event or a gambling event.

It is another object of the present invention to provide an apparatus and method for facilitating gaming activity and/or gambling activity which can be utilized in order to provide a real-time as well as a non-real-time alert or notification message to a user or individual communication device for informing a user of any one or more of a gaming event, a gambling event, gaming activity, gambling activity, and/or of information regarding a gaming event and/or a gambling event.

It is still another object of the present invention to provide an apparatus and method for facilitating gaming activity and/or gambling activity which can be utilized in order to provide account security for any one or more of a financial account(s), bank account(s), checking account(s), automated teller machine (ATM) account(s), credit card account(s), charge card account(s), debit card account(s), smart card account(s), currency card account(s), electronic money account(s), a wireless communication device account(s), and/or a cellular communication device account(s), utilized in conjunction with a gaming account.

It is yet another object of the present invention to provide an apparatus and method for facilitating gaming activity and/or gambling activity which can be utilized in order to provide for the administration and management of financial accounts for any of the users, individuals, casinos, gaming facilitators, gambling facilitators, betting halls, betting venues, vendors, sports gaming facilitators, race tracks, sports betting arenas, sports arenas, sports stadiums, financial intermediaries, banks, financial institutions, and/or any other entities described herein.

It is another object of the present invention to provide an apparatus and method for facilitating gaming activity and/or gambling activity which can be utilized in order to administer escrow accounts for gaming activity, gambling activity, and/or betting activity.

It is yet another object of the present invention to provide an apparatus and method for facilitating gaming activity and/or gambling activity which can be utilized in order to provide notification to a user or individual regarding when a withdrawal(s) is made from, and/or when a deposit is made to, any of the user's or individual's financial account(s), bank account(s), checking account(s), automated teller machine (ATM) account(s), credit card account(s), charge card account(s), debit card account(s), smart card account(s), currency card account(s), and/or electronic money account(s), which are associated with the user's gaming account.

It is another object of the present invention to provide an apparatus and method for facilitating gaming activity and/or gambling activity which can be utilized in order to allow any of the herein-described users, individuals, casinos, gaming facilitators, gambling facilitators, betting halls, betting venues, vendors, sports gaming facilitators, race tracks, sports betting arenas, sports arenas, sports stadiums, financial intermediaries, banks, financial institutions, and/or any other entities, described herein, to transfer funds electronically to and/or from gaming accounts and/or other accounts utilized in conjunction with the present invention.

It is still another object of the present invention to provide an apparatus and method for facilitating gaming activity and/or gambling activity which can be utilized in order to allow a user, to make a withdrawal(s) from an account, financial account, and/or a gaming account, in order to place a bet and/or to pay off a bet.

It is yet another object of the present invention to provide an apparatus and method for facilitating gaming activity and/or gambling activity which can be utilized in order to facilitate gaming activity and/or gambling activity from a remote location.

It is another object of the present invention to provide an apparatus and method for facilitating gaming activity and/or gambling activity which can be utilized in order to facilitate gaming activity and/or gambling activity at a gaming venue remote from the user's or individual's physical location.

It is still another object of the present invention to provide an apparatus and method for facilitating gaming activity and/or gambling activity which can be utilized in order to allow a user to participate in live gaming activity and/or gambling activity via a user communication device.

It is yet another object of the present invention to provide an apparatus and method for facilitating gaming activity and/or gambling activity which can be utilized in order to allow a user to engage in gaming activity, and/or to place bets, at one gaming establishment, or at a plurality of gaming establishments, remotely via a user communication device.

It is another object of the present invention to provide an apparatus and method for facilitating gaming activity and/or gambling activity which can be utilized in order to allow a user to place virtual betting pieces, chips, and/or currency, at a respective gaming table, gaming machine, and/or slot machine.

It is still another object of the present invention to provide an apparatus and method for facilitating gaming activity and/or gambling activity which can be utilized in order to allow a user to engage in gaming activity and/or gambling activity at remotely accessed gaming venues, tables, and/or machines.

It is yet another object of the present invention to provide an apparatus and method for facilitating gaming activity and/or gambling activity which can be utilized in order to control a user's gaming activity and/or gambling activity.

It is another object of the present invention to provide an apparatus and method for facilitating gaming activity and/or gambling activity which can be utilized in order to monitor a user's gaming activity and/or gambling activity.

It is still another object of the present invention to provide an apparatus and method for facilitating gaming activity and/or gambling activity which can be utilized in order to limit or restrict a user's activities or the use of the user's gaming account or communication device by others.

It is yet another object of the present invention to provide an apparatus and method for facilitating gaming activity and/or gambling activity which can be programmed to limit or restrict a user's activities or the use of the user's gaming account or communication device by others.

It is yet another object of the present invention to provide an apparatus and method for facilitating gaming activity and/or gambling activity which can be programmed, by a user or a gaming account holder, to limit or restrict a user's activities or the use of the user's gaming account or communication device by others.

It is another object of the present invention to provide an apparatus and method for facilitating gaming activity and/or gambling activity which can be programmed to limit or restrict a user's activities or the use of a user's gaming account or a communication device by others.

It is still another object of the present invention to provide an apparatus and method for facilitating gaming activity and/or gambling activity which can be utilized in order to perform financial account administration for a user.

It is yet another object of the present invention to provide an apparatus and method for facilitating gaming activity and/or gambling activity which can be utilized in order to perform or provide any one or more services relating to a gaming account.

It is another object of the present invention to provide an apparatus and method for facilitating gaming activity and/or gambling activity which can be utilized in order to maintain a financial gaming account or accounts for any of the users or players described herein, to perform credit and/or debit operations regarding financial gaming accounts, to perform account record-keeping, to perform tax withholding with regards to the financial gaming accounts, to report taxable events to the appropriate taxing authorities, to maintain periodic records of winnings and losses for the financial gaming accounts, and/or to provide periodic transaction summaries and/or gaming account statements for financial gaming accounts.

It is still another object of the present invention to provide an apparatus and method for facilitating gaming activity and/or gambling activity which can be utilized to and/or can be programmed to automatically pay withholding taxes on gaming winnings for a user or player.

It is yet another object of the present invention to provide an apparatus and method for facilitating gaming activity and/or gambling activity which can be utilized in order to provide information for and/or to promote gaming activities or gambling activities.

It is another object of the present invention to provide an apparatus and method for facilitating gaming activity and/or gambling activity which can be utilized in order to notify a user or player regarding the posting of information regarding a new gaming activity or event, and/or of new or changed odds regarding a gaming activity or event.

It is another object of the present invention to provide an apparatus and method for facilitating gaming activity and/or gambling activity which can be utilized in order to provide wireless alerts to a user regarding any information described herein as being provided by the apparatus and method the present invention.

It is still another object of the present invention to provide an apparatus and method for facilitating gaming activity and/or gambling activity which can be programmed by a user to provide notification to the user of a new gaming activity or gaming event.

It is yet another object of the present invention to provide an apparatus and method for facilitating gaming activity and/or gambling activity which can be utilized by a user to search for a gaming activity, gaming activities, a gaming event, or gaming events.

It is another object of the present invention to provide an apparatus and method for facilitating gaming activity and/or gambling activity which can be utilized in order to provide information regarding and/or relating to a gaming activity or a gaming event.

It is still another object of the present invention to provide an apparatus and method for facilitating gaming activity and/or gambling activity which can facilitate gaming or gambling on gaming derivatives and/or gambling derivatives.

It is yet another object of the present invention to provide an apparatus and method for facilitating gaming activity and/or gambling activity which can facilitate gaming or gambling derivative bets which can be made on any and/or all facets of a gaming environment and/or a gambling environment.

It is another object of the present invention to provide an apparatus and method for facilitating gaming activity and/or gambling activity which can be utilized to provide gaming loss insurance products and/or services and/or gambling loss insurance products and/or services.

It is still another object of the present invention to provide an apparatus and method for facilitating gaming activity and/or gambling activity which can be utilized to facilitate the sale of a gaming loss insurance policy and/or a gambling loss insurance policy.

It is yet another object of the present invention to provide an apparatus and method for facilitating gaming activity and/or gambling activity which can be utilized to provide, and/or facilitate the sale of, a credit derivative product in the form of a gaming loss insurance credit derivative and/or a gambling loss credit derivative.

It is another object of the present invention to provide an apparatus and method for facilitating gaming activity and/or gambling activity which can be utilized in order to provide notification to a user or other party regarding the availability of a gaming loss insurance policy and/or a gambling loss insurance policy.

It is still another object of the present invention to provide an apparatus and method for facilitating gaming activity and/or gambling activity which can be utilized in order to provide notification to a user or other party regarding the availability of a gaming loss insurance credit derivative and/or a gambling loss insurance credit derivative.

It is yet another object of the present invention to provide an apparatus and method for facilitating gaming activity and/or gambling activity which can be utilized in order to administer a gaming loss insurance policy and/or a gambling loss insurance policy.

It is another object of the present invention to provide an apparatus and method for facilitating gaming activity and/or gambling activity which can be utilized in order to administer a gaming loss insurance credit derivative and/or a gambling loss insurance credit derivative.

It is still another object of the present invention to provide an apparatus and method for facilitating gaming activity and/or gambling activity which can be utilized in order to service claims made under or pursuant to a gaming loss insurance policy and/or a gambling loss insurance policy.

It is yet another object of the present invention to provide an apparatus and method for facilitating gaming activity and/or gambling activity which can be utilized in order to perform settlement transactions for a gaming loss insurance credit derivative and/or a gambling loss insurance credit derivative.

It is another object of the present invention to provide an apparatus and method for facilitating gaming activity and/or gambling activity which can be utilized in conjunction with state gaming activities.

It is still another object of the present invention to provide an apparatus and method for facilitating gaming activity and/or gambling activity which can be utilized in order to facilitate the playing of state lottery games from any state or country.

It is yet another object of the present invention to provide an apparatus and method for facilitating gaming activity and/or gambling activity which can be utilized in order to provide for gaming activities and/or gambling activities onboard a vehicle.

It is another object of the present invention to provide an apparatus and method for facilitating gaming activity and/or gambling activity which can be utilized in order to provide for gaming activities and/or gambling activities onboard a boat, ship, cruise ship, commercial boat or cruise ship, passenger boat, ferry, marine vehicle, marine vessel, aircraft, airplane, jet, passenger aircraft, shuttle aircraft, commercial aircraft, a train, a subway train, a bus, an automobile, and/or any other vehicle.

It is still another object of the present invention to provide an apparatus and method for facilitating gaming activity and/or gambling activity which can be utilized in order to facilitate private gaming activities and/or gambling activities between two or more parties.

It is yet another object of the present invention to provide an apparatus and method for facilitating gaming activity and/or gambling activity which can be utilized in order to provide gaming results or gambling results to a user or player.

It is another object of the present invention to provide an apparatus and method for facilitating gaming activity and/or gambling activity which can be utilized over any suitable communication network, including, but not limited to the Internet, the World Wide Web, a telecommunication network or system, a telephone network or system, a cable television communication network or system, a satellite television communication network or system, a digital television network or system, a satellite communication network or system, a broadband communication network or system, a radio frequency communication network or system, an optical communication network or system, a line-connected network or system, a wireless network or system, a radio communication network or system, a digital communication network or system, a personal communications services (PCS) network or system, a local area network (LAN), a wide area network (WAN), a wireless Internet network or system, a wireless World Wide Web network or system, an optical communication network or system, a broadband communication network or system, a Bluetooth communication network or system, a streaming video communication network or system, a streaming audio communication network or system, a live video communication network or system, and/or any other suitable communications network or system, and/or any combination(s) thereof.

It is still another object of the present invention to provide an apparatus and method for facilitating gaming activity and/or gambling activity which can be utilized by a user in order to identity and/or to select a gaming event and/or a gambling event.

It is yet another object of the present invention to provide an apparatus and method for facilitating gaming activity and/or gambling activity which can be utilized in order to provide a user or other individual gaming account holder with notification of gaming account use.

It is another object of the present invention to provide an apparatus and method for facilitating gaming activity and/or gambling activity which can be programmed to cancel and/or to de-activate a gaming account if a pre-determined number of disallowed gaming activities are determined to have occurred on the account.

It is still another object of the present invention to provide an apparatus and method for facilitating gaming activity and/or gambling activity which can be utilized in order to select, identify, and/or recommend, a gaming derivative or derivatives and/or a gambling derivative or derivatives which may be suitable for a user.

It is yet another object of the present invention to provide an apparatus and method for facilitating gaming activity and/or gambling activity which can be utilized in order to select, identify, and/or recommend, a gaming loss insurance policy or policies and/or a gambling loss insurance policy or policies which may be suitable for the user.

It is another object of the present invention to provide an apparatus and method for facilitating gaming activity and/or gambling activity which can be utilized in order to monitor the outcome of a bet or a gaming activity covered by the respective gaming loss and/or gambling loss insurance policy or policies.

It is still another object of the present invention to provide an apparatus and method for facilitating gaming activity and/or gambling activity which can be utilized in order to determine an outcome of a bet or gaming activity covered by the respective gaming loss and/or gambling loss insurance policy or policies and determine the winner of the bet or gaming activity.

It is yet another object of the present invention to provide an apparatus and method for facilitating gaming activity and/or gambling activity which can be utilized in order to generate and/or process a claim or claims under a respective gaming loss and/or gambling loss insurance policy or policies.

It is another object of the present invention to provide an apparatus and method for facilitating gaming activity and/or gambling activity which can be utilized in order to effectuate payment of any insurance proceeds to the user's gaming account.

It is still another object of the present invention to provide an apparatus and method for facilitating gaming activity and/or gambling activity which can be utilized in order to identify a credit derivative suitable for an insurer.

It is yet another object of the present invention to provide an apparatus and method for facilitating gaming activity and/or gambling activity which can be utilized in order to determine or identify a state or a jurisdiction from which a gaming activity and/or a gambling activity originates.

It is another object of the present invention to provide an apparatus and method for facilitating gaming activity and/or gambling activity which can be utilized in order to effectuate payment of a gaming fee and/or a gambling fee, for remote gaming activity and/or gambling activity, to an originating state.

It is still another object of the present invention to provide an apparatus and method for facilitating gaming activity and/or gambling activity which can be utilized in order to allow a user to play lottery games in any number of states, countries, and/or other localities.

It is yet another object of the present invention to provide an apparatus and method for facilitating gaming activity and/or gambling activity which can be utilized in order to determine a user's originating state in the playing of a lottery game or lottery games.

It is another object of the present invention to provide an apparatus and method for facilitating gaming activity and/or gambling activity which can be utilized in order to collect winnings and/or prizes for and/or on behalf of a user.

It is still another object of the present invention to provide an apparatus and method for facilitating gaming activity and/or gambling activity which can be utilized in order to collect winnings and/or prizes for and/or on behalf of a user for any number of state lottery games.

It is yet another object of the present invention to provide an apparatus and method for facilitating gaming activity and/or gambling activity which can be utilized in order to allow a user or user's to place remote bets, wagers, and/or otherwise engage in gaming activity and/or gambling activity, from a vehicle.

It is another object of the present invention to provide an apparatus and method for facilitating gaming activity and/or gambling activity which can be utilized in order to provide for gaming activities and/or gambling activities from a boat, ship, cruise ship, commercial boat or cruise ship, passenger boat, ferry, marine vehicle, marine vessel, aircraft, airplane, jet, passenger aircraft, shuttle aircraft, commercial aircraft, a train, a subway train, a bus, an automobile, and/or any other vehicle.

It is another object of the present invention to provide an apparatus and method for facilitating gaming activity and/or gambling activity which utilize global positioning technology in order to ascertain the jurisdiction in which or from which a bet is placed.

It is still another object of the present invention to provide an apparatus and method for facilitating gaming activity and/or gambling activity which can facilitate and/or effectuate the payment of any gaming activities fees and/or gambling activity fees to an appropriate state or states.

It is yet another object of the present invention to provide an apparatus and method for facilitating gaming activity and/or gambling activity which can provide a user with an alert, in real-time and/or otherwise, when a lottery is available and/or when a lottery prize reaches a certain prize amount.

It is another object of the present invention to provide an apparatus and method for facilitating gaming activity and/or gambling activity which can be utilized in order to allow users to engage in private bets, private gaming activity, private gaming events, private gambling activities, and/or private gambling events, with other users.

It is still another object of the present invention to provide an apparatus and method for facilitating gaming activity and/or gambling activity which can allow a user to post a bet for a certain gaming activity, gaming event, gambling activity, and/or gambling event.

It is yet another object of the present invention to provide an apparatus and method for facilitating gaming activity and/or gambling activity which can be utilized by a user to receive notification of a posting of a bet for a certain gaming activity, gaming event, gambling activity, and/or gambling event.

It is another object of the present invention to provide an apparatus and method for facilitating gaming activity and/or gambling activity which can be utilized to determine whether a respective bet, gaming activity, gaming event, gambling activity, and/or gambling event, is legal.

It is still another object of the present invention to provide an apparatus and method for facilitating gaming activity and/or gambling activity which can be utilized in order to administer a bet or bets and/or to hold bets in escrow.

It is yet another object of the present invention to provide an apparatus and method for facilitating gaming activity and/or gambling activity which can be utilized in order to determine a winner or winners of a bet and/or to effectuate a payment of winnings to a winning user's gaming account.

It is another object of the present invention to provide an apparatus and method for facilitating gaming activity and/or gambling activity which can provide a signal, message, report, and/or notification, which can also contain an advertisement or advertisements.

Other objects and advantages of the present invention will be apparent to those skilled in the art upon a review of the Description of the Preferred Embodiments taken in conjunction with the Drawings which follow.

DESCRIPTION OF THE PREFERRED EMBODIMENTS

Figure 1:
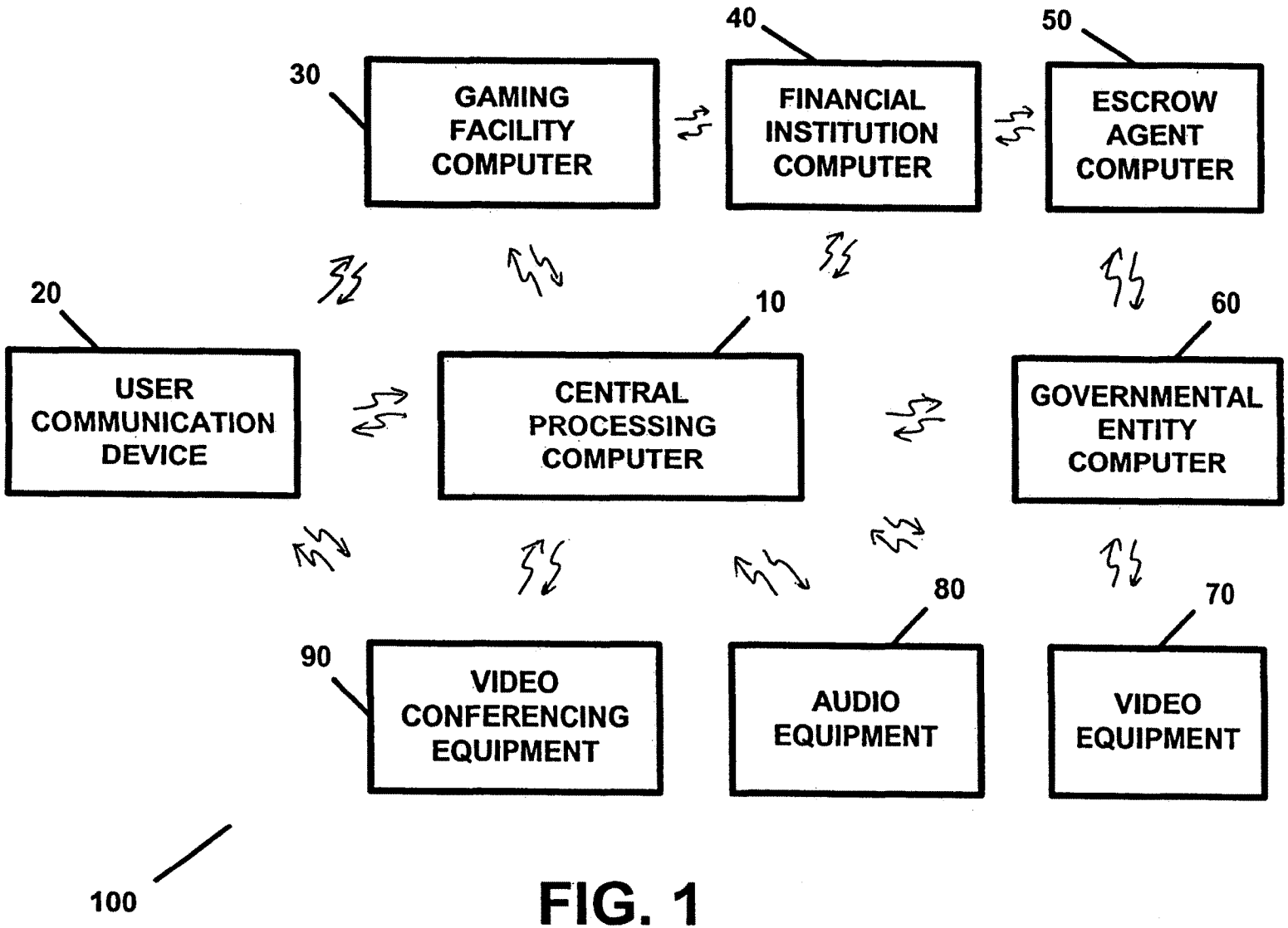
FIG. 1 illustrates a preferred embodiment of the apparatus of the present invention, in block diagram form.

The present invention pertains to an apparatus and method for facilitating gaming activity and/or gambling activity and, in particular, to an apparatus and method for facilitating gaming activity and/or gambling activity via a user communication device. The apparatus and method of the present invention can be utilized in order to allow a user to engage in gaming activity and/or gambling activity via a user communication device. The apparatus and method of the present invention can also be utilized in order to facilitate gaming activity and/or gaming activity in a network environment.

The apparatus and method of the present invention can also be utilized in order to allow a user or individual to select a gaming event(s) or a gambling event(s). The user or individual can place bets via a user communication device.

The apparatus and method of the present invention can also be utilized in order to allow a user or individual to pre-request to receive information regarding the occurrence of a gaming event or a gambling event. The apparatus and method of the present invention can also provide a real-time as well as a non-real-time alert or notification message to a user or individual communication device informing the user or individual of any one or more of a gaming event, a gambling event, gaming activity, gambling activity, and/or of information regarding a gaming event and/or a gambling event.

The apparatus and method of the present invention can also be utilized in order to provide account security for any one or more of a financial account(s), bank account(s), checking account(s), automated teller machine (ATM) account(s), credit card account(s), charge card account(s), debit card account(s), smart card account(s), currency card account(s), electronic money account(s), a wireless communication device account(s), and/or a cellular communication device account(s), utilized in conjunction with a gaming account.

The apparatus and method of the present invention can also provide for the administration and management of financial accounts for any of the users, individuals, casinos, gaming facilitators, gambling facilitators, betting halls, betting venues, vendors, sports gaming facilitators, race tracks, sports betting arenas, sports arenas, sports stadiums, financial intermediaries, banks, financial institutions, and/or any other entities described herein. The apparatus and method of the present invention can also be utilized to administer escrow accounts for gaming activity, gambling activity, and/or betting activity.

The apparatus and method of the present invention can also be utilized in order to provide notification to a user or individual regarding when a withdrawal(s) is/are made from any of the user's or individual's financial account(s), bank account(s), checking account(s), automated teller machine (ATM) account(s), credit card account(s), charge card account(s), debit card account(s), smart card account(s), currency card account(s), and/or electronic money account(s).

The apparatus and method of the present invention can also be utilized in order to provide notification to a user or individual regarding when a deposit(s) is/are made to any of the user's or individual's financial account(s), bank account(s), checking account(s), automated teller machine (ATM) account(s), credit card account(s), charge card account(s), debit card account(s), smart card account(s), currency card account(s), and/or electronic money account(s), which are associated with the user's gaming account.

The apparatus and method the present invention can also be utilized in order to allow any of the herein-described users, individuals, casinos, gaming facilitators, gambling facilitators, betting halls, betting venues, vendors, sports gaming facilitators, race tracks, sports betting arenas, sports arenas, sports stadiums, financial intermediaries, banks, financial institutions, and/or any other entities, to transfer funds electronically to and/or from any of the herein-described gaming accounts and/or other accounts utilized in conjunction with the present invention.

The apparatus and method of the present invention can also be utilized in order to allow a user or individual to access, and/or make withdrawals from, any one or more or bank accounts, savings accounts, checking accounts, automated teller machine accounts (ATM), credit card accounts, charge accounts, debit card accounts, smart card accounts, currency card accounts, and/or electronic money accounts, in order to place a bet and/or to pay off a bet.

The apparatus and method of the present invention can also be utilized in order to facilitate gaming activity and/or gambling activity from a remote location. The apparatus and method of the present invention can also be utilized in order to facilitate gaming activity and/or gambling activity at a gaming venue remote from the user's or individual's physical location. The apparatus and method of the present invention can also be utilized in order to allow a user or individual to participate in live gaming activity and/or gambling activity via a user communication device.

For example, and for purposes of an illustrative example, a user desiring to bet at a casino gaming table can access a camera or video device located at the table, obtain, at the communication device, audio and video information at the table, including being able to interact with dealers or betting house officials and/or other betters at the table, place bets, and engage in gaming activity and/or gambling activity at the table live and/or in real-time via the user communication device and any one or more of video equipment, audio equipment, and/or video conferencing equipment. In this manner, the apparatus and method of the present invention can be utilized in order to allow a user or individual to engage in gaming activity, and/or place bets, at one gaming establishment, or at a plurality of gaming establishments, remotely via a user communication device.

For example, an individual can gain remote access to, and bet at, a table at a Las Vegas, Nev. casino and, at any time, access, and bet at, a table in an Atlantic City, N.J. casino, access and place bets at Yonkers Raceway, and/or engage in remote gaming activities and/or gambling activities via a user communication device and/or the apparatus of the present invention.

The apparatus and method of the present invention can also be utilized in order to allow a remote user(s) to place virtual betting pieces, chips, and/or currency, at a respective gaming table, gaming machine, or slot machine, etc. In this embodiment, a display screen can be located at or adjacent to a respective gaming table, gaming machine, or slot machine, etc. A remote user(s) can also utilize a display screen and one or more user input devices or user interactive devices in order to view a user's or player's betting inventory of virtual betting pieces, chips, and/or currency which the user or player can virtually "move" to the respective gaming table, gaming machine, or slot machine, etc., in order to place a bet at the respective gaming table, gaming machine, or slot machine, etc.

The user's display screen, which can be a component of, or associated with, the user's user communication device or computer, can display the user's inventory of virtual betting pieces, chips, and/or currency, show the movement of the user's virtual betting pieces, chips, and/or currency, to the respective gaming table, gaming machine, or slot machine, etc., and show any virtual betting pieces, chips, and/or currency, of the house or of any other remote users or players.

The user or player can utilize an input device or an interactive device in order to "drag" virtual betting pieces, chips, and/or currency, from the user's inventory to the respective gaming table, gaming machine, or slot machine, etc. A user's winnings can also be transferred to the user's inventory of virtual betting pieces, chips, and/or currency. The apparatus and method of the present invention can also be utilized so as to allow a user or users to engage in gaming activity and/or gambling activity at remotely accessed gaming venues, tables, or machines, etc.

The apparatus and method of the present invention can also be utilized to monitor and control a user's gaming activities. In this regard, a user communication device which is utilized for remote gaming activity can be programmed to limit or restrict the user's activities or the use of the user's gaming account or communication device by others.

In another preferred embodiment, the central processing computer or server computer which may be utilized during a use of the apparatus and method of the present invention can also be programmed to limit or restrict a user's gaming activities or the use of the user's gaming account or communication device by others. In still another preferred embodiment, the computer or server computer associated with a gaming establishment, such as, but not limited to, a casino, a racetrack, a stadium, an arena, or an off-track betting establishment, etc., can also be programmed to limit or restrict a user's gaming activities or the use of the user's gaming account or communication device by others.

The limitations or restrictions on use of a user's gaming account or communication device can include a limitation or a restriction of a negative limitation or restriction (i.e. a gaming activity which is not allowed to be engaged in; or a time period(s) during which gaming activities are not allowed, etc.) or a positive limitation or restriction (i.e. a gaming activity allowed to be engaged in, or a time period(s) during which gaming activities are allowed, etc.).

The limitation or restriction can include a name of a user of a gaming account, a name of an authorized user of a gaming account, a name of a user or names of users allowed to use a gaming account, gaming activities which are allowed on a gaming account, gaming activities which are not allowed on a gaming account, betting limits on a gaming account, account spending limits on a gaming account, daily betting amount limits on a gaming account, weekly betting amount limits on a gaming account, monthly betting amount limits on a gaming account, yearly betting amount limits on a gaming account, allowed gaming venues, disallowed gaming venues, allowed betting time period(s), disallowed betting time period(s), allowed games which can be bet on, disallowed games which can be bet on, allowed team(s) and/or player(s) which can be bet on, allowed betting amount, disallowed betting amounts, allowed betting venues, locations or places, disallowed betting venues, locations, or places, stop loss limits, allowed betting subject matter, or disallowed betting subject matter, etc., and/or any other limitation or restriction described herein and/or which could otherwise be envisioned for any of the gaming or gambling activities with which the apparatus and method of the present invention can be utilized.

The apparatus and method of the present invention can also perform financial account administration for a user. In this regard, the apparatus and method of the present invention, and/or any of the user communication devices, central processing computers, server computers, and/or any computer or computer system associated with any of the entities described herein as being able to utilize or participate in the use or operation of the apparatus and method of the present invention, can be programmed and/or be capable of maintaining a financial gaming account or accounts for any of the users or players described herein, perform credit and/or debit operations regarding financial gaming accounts, perform account record-keeping, perform tax withholding with regards to the financial gaming accounts, report taxable events to the appropriate taxing authorities, maintain periodic records of winnings and losses for the financial gaming accounts, provide periodic transaction summaries and/or gaming account statements for the financial gaming accounts, including the transactions or activities engaged in and any winnings or losses resulting therefrom.

The apparatus and method of the present invention, or any of the computers, computer systems, and/or servers, can be programmed to automatically pay withholding taxes on gaming winnings for a user or player, and can automatically perform any of the herein-described functions.

The apparatus and method of the present invention can also be utilized to provide information for and/or to promote gaming activities or gambling activities. Information regarding gaming activities or gambling activities can be stored at a central processing computer or server computer. Information regarding a gaming activity or event (i.e. games at a casino, or a sporting event, etc.) can be entered by an individual or enterprise who or which may access the central processing computer or server computer and transmit the information regarding the gaming activity or event to the central processing computer or server computer which can then store the information in memory. A user can access the central processing computer and request information regarding any gaming activity or event and receive the information if such information exists.

The apparatus and method of the present invention can also notify a user or player regarding the posting or information regarding a new gaming activity or event, and/or of new or changed odds regarding a gaming activity or event. The notification can be provided in the form of information provided in real-time and/or otherwise, as any one or more of an electronic transmission, a communication transmission, a beeper message, a pager message, an instant message, an electronic mail message, a telephone message, a telephone call, a facsimile transmission, and/or any other communication transmission to any of the user communication devices described herein as being utilized in conjunction with the present invention. The apparatus and method of the present invention can provide wireless alerts to the user or player in order to provide the herein-described notification operations.

The present invention can also be utilized so as to allow a user or player to program a respective central processing computer to provide notification to the user or player of any new gaming activities or gaming events about which the user or player desires to be notified. For example, if a user or player desires to bet on a boxing match, he or she can request to be notified when information regarding a boxing match is posted on a central processing computer or server computer. In a similar manner, if a user or player desires to be notified when different or more favorable odds are posted to a gaming activity or event, he or she can post his or her request to be notified and receive such notification if and when such odds may be changed.

The apparatus and method of the present invention can also be utilized to allow a user or player to access a central processing computer and search for a gaming activity, gaming activities, a gaming event, or gaming events, in which the user or player may desire to bet or participate.

The apparatus and method of the present invention can also be utilized in order to provide information regarding gaming activities, gaming events, gambling activities, and/or gambling events. A central processing computer or server computer can include a database of information and/or statistics regarding any of the gaming activities, gaming events, gambling activities, and/or gambling events, and/or any of the teams, players, athletes, participants, animals (i.e. horses in horse racing, etc.), which may be involved in or be the subject of any of the gaming activities, gaming events, gambling activities, and/or gambling events.

Information can, for example, include, but not be limited to, a casino's win percentage for a slot machine or for a table game, the average winnings of the house, users' or players' winning percentages, users' or players' losing percentages, average losses by a user or player, a professional boxer's won/loss record, a sports team's won/loss record and/or historic record against another team, a respective athlete's batting average, rushing average, or scoring average, etc., and past statistics or performance against a specific opponent, a race horse's racing won/loss record and/or statistics in a given setting, and/or any other information which a user or player may be interested in obtaining in order to make a more informed bet.

The apparatus and method of the present invention can also be utilized in order to facilitate gaming or gambling on gaming derivatives and/or gambling derivatives. For example, a bet could be made by a player that a casino or house may win a certain amount of money during a pre-specified time period, that a casino or house may make a certain level or amount of payoffs to winning players during a pre-specified time period, that a casino or house may win a certain amount to money from a particular game, games, gaming activity, or gaming activities, etc., during a pre-specified time period, that a casino or house may win more bets than it loses during a pre-specified time period and/or in a particular game, games, gaming activity, or gaming activities, etc., that players, as a whole, may win more bets than they lose during a pre-specified time period and/or in a particular game, games, gaming activity, or gaming activities, etc., and/or the percentage of time that spreads are met in outcomes of gaming activities and/or gaming events. The present invention can be utilized in order to allow or facilitate the making of bets and/or the providing for gaming activities and/or gambling activities involving any derivative bets which can be made on any and/or all facets of a gaming environment and/or a gambling environment.

The apparatus and method of the present invention can also be utilized in order to allow a user or player to purchase gaming loss insurance and/or gambling loss insurance which can provide insurance coverage for gaming losses and/or gambling losses. In another preferred embodiment, the apparatus and method of the present invention can facilitate the sale of gaming loss insurance policies and/or gambling loss insurance policies.

The apparatus and method of the present invention can also provide a credit derivative product in the form of a gaming loss insurance credit derivative and/or a gambling loss credit derivative which can be an instrument which a provider or facilitator of the respective gaming loss insurance policies and/or the gambling loss insurance policies can issue to in order to reduce its risk of loss for claims made and required to be paid pursuant to the respective gaming loss insurance policies and/or the gambling loss insurance policies.

In this regard, the apparatus and method of the present invention can provide a credit derivative or instrument to users or players which will enable the provider of the respective insurance policy to reduce its risk of loss in the event of claims paid out to insureds under the respective policies and which enable a user or player to invest in and/or bet that the insurance policy provider will take in more from premiums under the respective insurance policies than it pays out to claimants under the respective insurance policies.

The apparatus and method of the present invention can also notify users or players of the availability of the herein-described gaming loss insurance policies and/or gambling loss insurance policies and/or of the availability of any of the herein-described gaming loss insurance credit derivatives and/or gambling loss insurance credit derivatives.

Users or players can purchase a gaming loss insurance policy and/or a gambling loss insurance policy via the apparatus and method of the present invention and the apparatus and method of the present invention can administer the respective policy or policies and service any claims made thereunder. A user or player can submit claims under the insurance policy or policies to a central processing computer or server computer which can administer the policy or policies and/or otherwise provide service or services pursuant to the policy or policies.

A user or player can also purchase a gaming loss insurance credit derivative(s) and/or a gambling loss credit derivative(s) via the apparatus and method of the present invention. A central processing computer can administer the sale and service of the respective gaming loss insurance credit derivative(s) and/or a gambling loss credit derivative(s).

The apparatus and method of the present invention can also be utilized in conjunction with state gaming activities of a respective state, country or sovereignty. In this manner, the apparatus and method of the present can be utilized in a manner consistent with gaming laws, rules, and/or regulations, in the various states, countries or sovereignties, in which, or in conjunction with which the present invention can be utilized. In this manner, the apparatus and method of the present invention can be utilized to facilitate compliance with the various and respective state, country, and/or sovereignty, gaming laws and/or gambling laws and/or so as to facilitate any reporting of gaming activities and/or gambling activities to the appropriate authorities and/or so as to facilitate and/or effectuate any payments of fees and/or taxes relating to the gaming activities and/or gambling activities.

The apparatus and method of the present invention can also be utilized in order to facilitate the playing of state lottery games from any state or country.

The apparatus and method of the present invention can also provide for gaming activities and/or gambling activities on board any one or more of a gaming establishment or gambling establishment aboard a boat, ship, cruise ship, commercial boat or cruise ship, passenger boat, ferry, marine vehicle, marine vessel, aircraft, airplane, jet, passenger aircraft, shuttle aircraft, commercial aircraft, a train, a subway train, a bus, and/or an automobile, etc., which can allow or provide gaming activities and/or gambling activities on board same. The present invention can utilize global positioning technology at a user communication device and/or on board the respective boat, ship, cruise ship, commercial boat or cruise ship, passenger boat, ferry, marine vehicle, marine vessel, aircraft, airplane, jet, passenger aircraft, shuttle aircraft, and/or commercial aircraft, a train, a subway train, a bus, and/or an automobile, etc., in order to ascertain the jurisdiction in which the respective boat, ship, cruise ship, commercial boat or cruise ship, passenger boat, ferry, marine vehicle, marine vessel, aircraft, airplane, jet, passenger aircraft, shuttle aircraft, and/or commercial aircraft, a train, a subway train, a bus, and/or an automobile, etc., is located and apply the gaming laws and rules for the identified jurisdiction to the respective gaming activities and/or gambling activities.

The apparatus and method of the present invention can also be utilized in order to facilitate private gaming activities and/or gambling activities between two or more parties.

The apparatus and method can be utilized in conjunction with any gaming activities, gambling activities, and/or games of chance. In this regard, the terms "gaming activity", "gaming event", "game of chance", "gambling activity", "gambling event", or their plurals, refers to, but is not limited to slot machine games, slots, Black Jack, Poker, Craps, Baccarat, Roulette wheel, Keno, Multispin, Multiline, Draw Poker, Reel games, Spin Poker, "21", pinball, Bingo, Solitaire, lottery games, state or other subdivision lottery games, Powerball lottery games, horse racing, dog racing, jai lai, off track betting games, football games, professional football games, college football games, high school football games, little league football games, championship football games or series, baseball games, college baseball games, high school baseball games, little league baseball games, championship baseball games or series, basketball games, professional basketball games, college basketball games, high school basketball games, little league basketball games, championship basketball games or series, professional soccer games, college soccer games, high school soccer games, little league soccer games, championship soccer games or series, professional hockey games, college hockey games, hockey games, little league hockey games, championship hockey games or series, tennis matches, wresting matches, boxing matches, golf tournament, and/or games, matches, tournaments, and/or competitions, of any type or kind.

The terms "gaming activity", "gaming event", "game of chance", "gambling activity", "gambling event", or their plurals, also refer to any team gaming activities, events or games, which can facilitate team play in any of the herein-described gaming activities, events, or games of chance.

As used herein the terms "user", "player", "game player", etc., or their plural, refer to any user, users, player, players, and/or individuals and/or entities, etc., who or which utilize the apparatus and method of the present invention in order to engage in gaming activities, gambling activities, and/or other activities which are provided by and/or facilitated by the apparatus and method of the present invention.

As used herein the terms "gaming provider", "gaming facility", "gaming venue", "gaming house", or their plurals, refer to any gaming provider, gaming facility, gaming venue, gaming house, casino, gambling hall, state lottery commission, state gaming commission, Indian reservation gaming commission, gaming establishment, gaming establishment or gambling establishment aboard a boat, ship, cruise ship, commercial boat or cruise ship, passenger boat, ferry, marine vehicle, marine vessel, aircraft, airplane, jet, passenger aircraft, shuttle aircraft, commercial aircraft, a bus, an automobile, a train, or a subway train, etc., which can allow or provide gaming activities and/or gambling activities on board same, gaming outlet, race track, stadium, arena, web site, server computer, and/or any other entity which can be the place, location, and/or venue, at which one may engage in gaming activity, gambling activity, place a bet, make a bet, engage in a game of chance, and/or otherwise engage in a gaming activity, gambling activity, and/or other game of chance.

As used herein, the terms "gaming derivative" or "gambling derivative", or their plurals, refer to any derivative instrument, derivative, option, future, or credit derivative, etc., which can be developed for and/or associated with any of the gaming activities, gambling activities, and/or any risk of loss reduction activities, hedging activities, and/or gaming or gambling games or activities associated therewith, in conjunction with which the present invention may be utilized.

As used herein the term "counterparty" or "counterparties" refer to an individual who is a counterpart to another or others in a bet, a wager, a gaming activity, a gaming event, a gambling activity, and/or a gambling event, and/or to individuals who are counterparts to another or others in a bet, a wager, a gaming activity, a gaming event, a gambling activity, and/or a gambling event.

The apparatus and method of the present invention can also be utilized to provide the gaming results or gambling results to a user or player.

Applicant hereby incorporates by reference herein the subject matter and teachings of U.S. Provisional Patent Application Ser. No. 60/384,707, filed May 31, 2002, and entitled "APPARATUS AND METHOD FOR FACILITATING GAMING ACTIVITY AND/OR GAMBLING ACTIVITY".

Applicant hereby incorporates by reference herein the subject matter and teachings of U.S. patent application Ser. No. 12/218,271, filed Jul. 14, 2008, and entitled "APPARATUS AND METHOD FOR FACILITATING GAMING ACTIVITY AND/OR GAMBLING ACTIVITY", the subject matter and teachings of which are hereby incorporated by reference herein in their entirety.

FIG. 1 illustrates a preferred embodiment of the apparatus of the present invention, which is designated by reference numeral 100, in block diagram form. With reference to FIG. 1, the apparatus 100 comprises a central processing computer or server computer 10 (hereinafter "central processing computer 10"). The central processing computer 10 can include any number of central processing computers and/or computer systems. The central processing computer 10 can be associated with any gaming provider, gaming facility, gaming venue, and/or with any number of gaming providers, gaming facilities, and/or gaming venues.

The central processing computer(s) 10 can have a web site or web sites associated therewith.

In any and/or all of the embodiments described herein, the central processing computer(s) 10 can be comprised of one computer or computer system and/or can be comprised of a plurality of computers or computer systems.

The central processing computer(s) 10, in the preferred embodiment, is/are capable of performing any of and all of the processing routines and/or functionality described herein as being performed by the apparatus 100 of the present invention.

With reference to FIG. 1, the apparatus 100 also includes any number of user computers or user communication devices 20 (hereinafter "user communication device 20"). The user communication device 20 can be utilized in order to communicate with the central processing computer(s) 10 described herein. In the preferred embodiment, the user communication device or devices 20 can be linked with the central processing computer(s) 10.

The user communication device 20 can be utilized by any of the herein-described users or players in order to interface with, and/or interact with, the central processing computer 10. In the preferred embodiment, the user communication device 20 can be a computer, a computer terminal, a terminal device connected to, or associated with, the central processing computer 10, a kiosk, a personal computer, a home computer, a communication device, a telephone, an interactive television, a personal communication device, a pocket personal computer, a telephone, a cellular telephone, a wireless telephone, a videophone, a video telephone, a palm device, a palm-top device, a hand-held device, a personal digital assistant, and/or any other communication device.

The user communication device 20 can also include and/or be utilized in conjunction with a network computer which can be utilized to receive e-mail messages for, or on behalf of a user. The network computer, in the preferred embodiment, can transmit the e-mail messages to any of the herein-described user communication devices and/or can provide the e-mail message to the user communication device 20 when so requested by the user. In any and/or all of the embodiments described herein, the respective network computer can also automatically transmit or "push" an e-mail message or e-mail messages to a user communication device 20 as soon as same are received and/or in real-time.

In any and/or all of the embodiments described herein, the respective network computer can also serve as a conventional e-mail server which can allow a user to request or "pull" an e-mail message or e-mail messages to a user communication device 20 when requested by the user or other authorized individual.

In the preferred embodiment, any number of user communication devices 20 can be utilized. The user communication devices 20 described herein can be utilized to communicate with the central processing computer(s) 10 in a bi-directional manner.

With reference once again to FIG. 1, the apparatus 100 can also include a computer or computer system which can be associated with a gaming provider, a gaming facility computer, and/or gaming venue 30 (hereinafter referred to as "gaming facility computer 30") which can be associated with and/or located at, in, or in the vicinity of, any of the gaming providers, gaming facilities, gaming venues, casinos, gambling halls, boats, ships, cruise ships, commercial boats or cruise ships, passenger boats, ferries, marine vehicles, marine vessels, aircraft, airplanes, jets, passenger aircraft, shuttle aircraft, commercial aircraft, trains, subway trains, buses, and/or automobiles, gaming outlets, race tracks, stadiums, arenas, web sites, server computers, and/or any other entities or venues which can be the place, location, and/or venue, at which one may engage in gaming activity, gambling activity, place a bet, make a bet, engage in a game of chance, and/or otherwise engage in a gaming activity, gambling activity, and/or other game of chance. The apparatus 100 can include any number of gaming facility computers 30.

A gaming facility computer 30 or computers can be associated with a gaming provider, a gaming facility, and/or a gaming venue and/or can be associated with any gaming activity, game of chance, or gaming machine, etc., located at, in, or in the vicinity of, a gaming provider.

A gaming facility computer 30 can also be associated with and/or located at, in, or in the vicinity of, any of the gaming venues, gaming machines, gaming tables, and/or other gaming locations in, at, or in the vicinity of any of the herein-described gaming provider, a gaming facility, and/or gaming venue. Any number of gaming facility computers 30 can be utilized in conjunction with the apparatus 100 of the present invention.

The gaming facility computer(s) 30 can have a web site or web sites associated therewith.

In any and/or all of the embodiments described herein, the gaming facility computer(s) 30 can be comprised of one computer or computer system and/or can be comprised of a plurality of computers or computer systems.

The apparatus 100 can also include a financial institution or financial intermediary computer or computer system 40 (hereinafter referred to as "financial institution computer 40") which can be associated with and/or which can administer and/or service financial accounts and/or gaming accounts for any of the herein-described users, players, gaming providers, gaming facilities, and/or gaming venues described herein. Any number of financial institution computers 40 can be utilized in conjunction with the apparatus 100 of the present invention.

The financial institution computer(s) 40 can have a web site or web sites associated therewith.

In any and/or all of the embodiments described herein, the financial institution computer(s) 40 can be comprised of one computer or computer system and/or can be comprised of a plurality of computers or computer systems.

The apparatus 100 can also include an escrow agent computer or computer system 50 (hereinafter referred to as "escrow agent computer 50") which can be associated with and/or which can act as an escrow facility for holding bets and/or any other entities, money, or objects, etc., which can be the subject of the bet or wager. The escrow agent, in the preferred embodiment, is a neutral administrator who or which can act as the escrow agent for parties to a bet or wager and/or can be the officiating party or entity to officiate over a bet or wager when and/or if such service or services are or may be needed and/or desired. Any number of escrow agent computers 50 can be utilized in conjunction with the apparatus 100 of the present invention.

The escrow agent computer(s) 50 can have a web site or web sites associated therewith.

In any and/or all of the embodiments described herein, the escrow agent computer(s) 50 can be comprised of one computer or computer system and/or can be comprised of a plurality of computers or computer systems.

The apparatus 100 can also include a governmental entity computer or computer system 60 (hereinafter "governmental entity computer 60") which can be a computer or computers which are associated with a federal, state, or local, government gaming commission, gaming administrator or other governmental entity which can regulate, oversee, and/or administer, gaming activities, gaming events, and/or games of chance, which can take place under, or within, the jurisdiction of the respective federal, state, or local, government gaming commission, gaming administrator or other governmental entity.

The governmental entity computer(s) 60 can have a web site or web sites associated therewith.

In any and/or all of the embodiments described herein, the governmental entity computer(s) 60 can be comprised of one computer or computer system and/or can be comprised of a plurality of computers or computer systems.

The apparatus 100, in a preferred embodiment, can also include video equipment 70 which can be located at, or in the vicinity of a gaming activity, gaming event, and/or gaming facility, in order to provide video information regarding the respective gaming activity, gaming event, and/or gaming facility. For example, a user engaging in gambling activity at a casino located at a distant location can obtain video information at a table game in order to engage in a gaming activity at the table. For example, a user or player can access a Black Jack table, a Poker table, a Roulette wheel game, and/or any other table, machine, or location, and view and/or participate in the game while obtaining video information of the game via the video equipment 70.

In this manner, the video equipment 70 can be utilized in order to allow a user of player to bet on, wager on, and/or engage in, a gaming activity from a remote location. In another embodiment, the video equipment 70 can be utilized to provide video of a game, a match, a sporting event, tournament, and/or competition which is the subject of gaming activity and/or gambling activity. For example, a user betting or wagering on a horserace, a boxing match, and/or a sporting event or game, can view the event upon betting or wagering on same. In this manner, the apparatus 100 can be utilized in a gaming and/or pay per view scenario so that users or players can view the respective event upon betting or wagering on same.

The video equipment 70 can include a video camera, a video recording device, a video recording camera, a camera, and/or any other device for recording and/or providing video information.

The video recording equipment 70 can also include a receiver for receiving signals and/or command signals from any one or more of the central processing computers 10, the user communication devices 20, the gaming facility computers 30, the financial institution computers 40, the escrow agent computers 50, and/or the governmental entity computers 60, described herein.

The video equipment 70 can also include transmitters for transmitting video information to any one or more of the any one or more of the central processing computers 10, the user communication devices 20, the gaming facility computers 30, the financial institution computers 40, the escrow agent computers 50, and/or the governmental entity computers 60, described herein.

The apparatus 100, in a preferred embodiment, can also include audio equipment 80 which can be located at, or in the vicinity of a gaming activity, gaming event, and/or gaming facility, in order to provide audio information regarding the respective gaming activity, gaming event, and/or gaming facility.

For example, a user engaging in gambling activity located at a distant location can obtain audio information at the event or game in order to engage and/or to hear the gaming event or game. For example, a user or player can access a game, and/or an event, or location, and hear and/or participate in the game while obtaining audio information of the game via the audio equipment 80. In this manner, audio equipment 80 can be utilized in order to allow a user of player to bet on, wager on, and/or engage in, gaming activity from a remote location. In another embodiment, the audio equipment 80 can be utilized to provide audio of a game, a match, a sporting event, tournament, and/or competition which is the subject of gaming activity and/or gambling activity. For example, a user betting or wagering on a horserace, a boxing match, and/or a sporting event or game, can hear the event upon betting or wagering on same. In this manner, the apparatus 100 can be utilized in a gaming and/or pay per listening scenario so that users or players can hear the respective event upon betting or wagering on same.

The video conferencing equipment 90 can include a video camera, a video recording device, a video recording camera, a camera, and/or any other device for recording and/or providing video information, an audio recording device, a microphone, a tape recorder, and/or any other audio recording device for recording and/or providing audio information.

The video conferencing equipment 90 can also include a receiver for receiving signals and/or command signals from any one or more of the central processing computers 10, the user communication devices 20, the gaming facility computers 30, the financial institution computers 40, the escrow agent computers 50, and/or the governmental entity computers 60, described herein.

The video conferencing equipment 90 can also include transmitters for transmitting video information to any one or more of the any one or more of the central processing computers 10, the user communication devices 20, the gaming facility computers 30, the financial institution computers 40, the escrow agent computers 50, and/or the governmental entity computers 60, described herein.

The apparatus 100, in a preferred embodiment, can also include video conferencing equipment 90 which can be located at, or in the vicinity of a gaming activity, gaming event, and/or gaming facility, in order to provide two-way video and audio communication between a user or player and a respective gaming activity, gaming event, and/or gaming facility.

For example, a user engaging in gambling activity at a casino located at a distant location can video conference with the gaming house, with the gaming house's employees, with a dealer or dealers, with other game or activity administrating individuals, and/or with other players, in order to participate in and/or to engage in a gaming activity at the table or other gaming venue. In this manner, the apparatus 100 can facilitate a user's participation and/or gambling, betting, and/or wagering, in a game from a remote location while being able to interact with the gaming house, its employees, and/or other players as if the user or player were located at the game or event.

The video conferencing equipment 90 can be utilized to allow a user or player to remotely access, for example, a Black Jack table, a Poker table, a Roulette wheel game, and/or any other table, machine, or location, and view, hear, participate in, and engage in two-way communication with, the game, the gaming house, gaming house employees, and/or other users or players via the video conferencing equipment 90.

The audio equipment 80 can include an audio recording device, a microphone, a tape recorder, and/or any other audio recording device for recording and/or providing audio information.

The audio recording equipment 80 can also include a receiver for receiving signals and/or command signals from any one or more of the central processing computers 10, the user communication devices 20, the gaming facility computers 30, the financial institution computers 40, the escrow agent computers 50, and/or the governmental entity computers 60, described herein.

The audio equipment 80 can also include transmitters for transmitting audio information to any one or more of the any one or more of the central processing computers 10, the user communication devices 20, the gaming facility computers 30, the financial institution computers 40, the escrow agent computers 50, and/or the governmental entity computers 60, described herein.

In this manner, the video conferencing equipment 90 can be utilized in order to allow a user of player to bet on, wager on, and/or engage in, a gaming activity from a remote location while being able to engage in two-way communications concerning the gaming activity. In another embodiment, the video conferencing equipment 90 can be utilized to provide video and/or audio of a game, a match, a sporting event, tournament, and/or competition which is the subject of gaming activity and/or gambling activity.

For example, a user betting or wagering on a horserace, a boxing match, a baseball game, and/or a sporting event or game, can view the event upon betting or wagering on same and be able to engage in two-way communication with an individual or individuals located at, officiating, or participating in, the gaming activity or gaming event. In this manner, the apparatus 100 can also be utilized in a gaming and/or pay per view scenario so that users or players can view and/or interact with the respective event upon betting or wagering on same.

In the preferred embodiment, the central processing computer 10 can communicate with any and/or all of the herein-described user communication devices 20, gaming facility computers 30, financial institution computers 40, escrow agent computers 50, governmental entity computers 60, video equipment 70, audio equipment 80, video conferencing equipment 90, and/or any other central processing computers 10 described herein, in a bi-directional manner.

In the preferred embodiment, the user communication device 20 can communicate with any and/or all of the herein-described central processing computers 10, gaming facility computers 30, financial institution computers 40, escrow agent computers 50, governmental entity computers 60, video equipment 70, audio equipment 80, video conferencing equipment 90, and/or any other user communication devices 20 described herein, in a bi-directional manner.

In the preferred embodiment, the gaming facility computers 30 can communicate with any and/or all of the herein-described central processing computers 10, user communication devices 20, financial institution computers 40, escrow agent computers 50, governmental entity computers 60, video equipment 70, audio equipment 80, video conferencing equipment 90, and/or any other gaming facility computers 30, described herein, in a bi-directional manner.

In the preferred embodiment, the financial institution computers 40, can communicate with any and/or all of the herein-described central processing computers 10, user communication devices 20, gaming facility computers 30, escrow agent computers 50, governmental entity computers 60, video equipment 70, audio equipment 80, video conferencing equipment 90, and/or any other financial institution computers 40, described herein, in a bi-directional manner.

In the preferred embodiment, the escrow agent computers 50 can communicate with any and/or all of the herein-described central processing computers 10, user communication devices 20, gaming facility computers 30, financial institution computers 40, governmental entity computers 60, video equipment 70, audio equipment 80, video conferencing equipment 90, and/or any other escrow agent computers 50, described herein, in a bi-directional manner.

In the preferred embodiment, the governmental entity computers 60 can communicate with any and/or all of the herein-described central processing computers 10, user communication devices 20, gaming facility computers 30, financial institution computers 40, escrow agent computers 50, video equipment 70, audio equipment 80, video conferencing equipment 90, and/or any other governmental entity computers 60, described herein, in a bi-directional manner.

In the preferred embodiment, any of the central processing computers 10, the user communication devices 20, the gaming facility computers 30, the financial institution computers 40, the escrow agent computers 50, and/or the governmental entity computers 60, can any one or more of access, activate, de-activate, enable, and/or disable, any of the herein-described video equipment 70, audio equipment 80, and/or video conferencing equipment 90.

In the preferred embodiment, the apparatus 100 and method of the present invention can be utilized over any suitable communication network and/or any combination of computer networks, including, but not limited to the Internet, the World Wide Web, a telecommunication network or system, a telephone network or system, a cable television communication network or system, a satellite television communication network or system, a digital television network or system, a satellite communication network or system, a broadband communication network or system, a radio frequency communication network or system, an optical communication network or system, a line-connected network or system, a wireless network or system, a radio communication network or system, a digital communication network or system, a personal communications services (PCS) network or system, a local area network (LAN), a wide area network (WAN), a wireless Internet network or system, a wireless World Wide Web network or system, an optical communication network or system, a broadband communication network or system, a Bluetooth communication network or system, a streaming video communication network or system, a streaming audio communication network or system, a live video communication network or system, and/or any other suitable communications network or system, and/or any combination(s) thereof.

Figure 2:
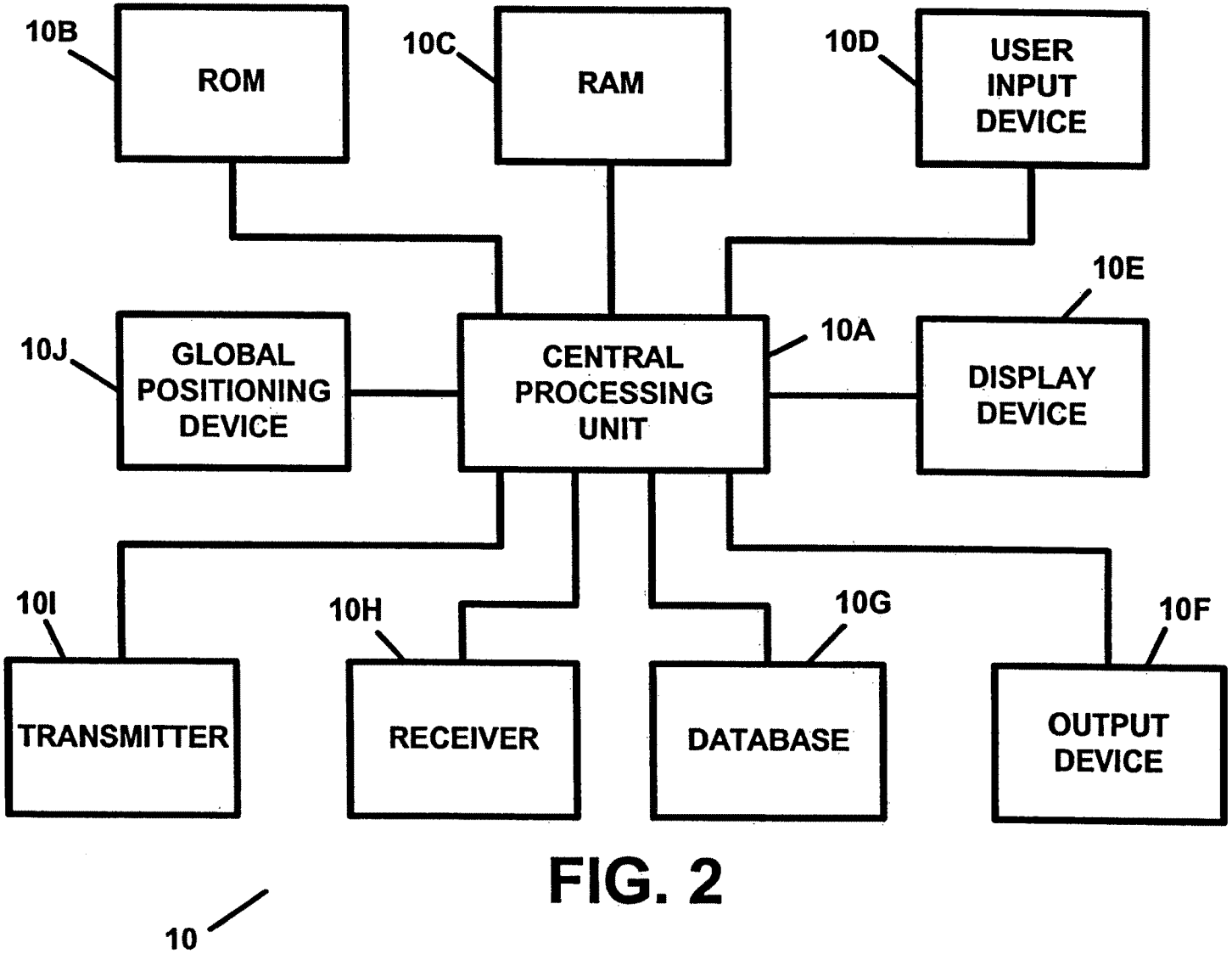
FIG. 2 illustrates a preferred embodiment of the central processing computer of FIG. 1, in block diagram form.

FIG. 2 illustrates the central processing computer 10 of the apparatus 100, in block diagram form. With reference to FIG. 2, the central processing computer 10 includes a central processing unit (CPU) 10A. The central processing unit (CPU) 10A may be a microprocessor, a microcomputer, a minicomputer, a macro-computer, or a mainframe computer, depending upon the application.

The central processing computer 10 also includes a read only memory (ROM) device 10B and a random access memory (RAM) device 10C which are also connected to the CPU 10A. The central processing computer 10 also includes a user input device(s) 10D which can include any one or more of a keyboard, a scanner, a user pointing device, such as, for example, a mouse, an audio input device, a touch pad, or a touch screen, etc., which input device(s) 10D is also connected to the CPU 10A.

The central processing computer 10 also includes a display device 10E, such as a display monitor and/or a display screen for providing the herein-described information to the operator of the central processing computer 10. The display device 10E is also connected to the CPU 10A.

The central processing computer 10 can also include an output device 10F, such as a printer, a display device, and/or a modem, for outputting, in either or both of hard copy form or electronic form, any of the information which is described herein as being provided by, or at, the central processing computer 10. The output device 10F can also be connected to the CPU 10A.

The central processing computer 10 can also include a database(s) 10G, which can contain any information and/or data which may be required, and/or which may be desired, for performing any of the functionality and/or processing routines described herein as being performed by the central processing computer 10 and/or the apparatus 100.

For example, the database 10G can contain account information for any of the users or players, gaming providers, gaming facilities, gaming events, financial institutions, escrow agents, and/or governmental entities, who or which utilize the apparatus 100 and method of the present invention, including, but not limited to, name of the respective party, address of the respective party, telephone number of the respective party, e-mail address of the respective party, financial account information of the respective party, gaming account information of the respective party, limitation or restrictions on a user's or a player's gaming account, gaming account betting limits for a user's or a player's gaming account, games or games of chance which can be played via the apparatus 100 of the present invention, gaming activities, gaming events, and/or games of chance which can be the subject of gaming activity or gambling activity, schedules of gaming activities or gambling activities, results of gaming activities or gambling activities, historical information, including statistical results regarding gaming activities or gambling activities, and/or any other information and/or data described herein and/or otherwise which is needed and/or desired in order to perform any and/or all of the processing routines and/or functionality described herein as being performed and/or provided by the apparatus 100 and method of the present invention and/or by any of the user computers 20, gaming facility computers 30, financial institution computers 40, escrow agent computers 50, governmental entity computers 60, and/or any of the other central processing computers 10 described herein.

The database 10G also contains information regarding any and/or all of the video equipment 70, audio equipment 80, video conferencing equipment 90, and/or any of the components thereof, described as being utilized in conjunction with the apparatus 100 of the present invention. The information regarding the video equipment 70, audio equipment 80, video conferencing equipment 90, and/or any of the components thereof, can include the identity of the respective equipment or component, the location of deployment, the game, gaming activity, gaming facility, gaming event, gaming provider, in conjunction with which the respective equipment or component is utilized, an IP address or other address for accessing the respective equipment or component thereof, and/or any other information needed and/or desired regarding the operation and/or utilization of the video equipment 70, the audio equipment 80, and/or the video conferencing equipment 90.

The database 10G can also contain information regarding gaming laws, regulations, and rules, income tax laws, regulations, and/or rules, regarding any of the jurisdictions in which the apparatus 100 and method of the present invention can be utilized.

The database 10G can also contain any other data and/or information which may be needed and/or desired for performing any and/or all of the processing routines and/or functionality described herein as being provided by the central processing computer 10 and/or apparatus 100. The database 10G can also be connected to the CPU 10A.

The central processing computer 10 can also include a receiver 10H for receiving data and/or information, including any of the herein-described information, and/or any of the other information described herein as being provided to the central processing computer 10 from any of the user communication devices 20, from any of the gaming facility computers 30, from any of the financial institution computers 40, from any of the escrow agent computers 50, from any of the governmental entity computers 60, and/or from any of the other central processing computers 10 described herein. The receiver 10H can also be connected to the CPU 10A.

The central processing computer 10 can also include a transmitter 101 for transmitting data and/or information, including any of the herein-described information, and/or any of the other information described herein as being provided from the central processing computer 10 to any of the user communication devices 20, to any of the gaming facility computers 30, to any of the financial institution computers 40, to any of the escrow agent computers 50, to any of the governmental entity computers 60, and/or to any of the other central processing computers 10 described herein. The transmitter 101 can also be connected to the CPU 10A.

With reference to FIG. 2, the central processing computer 10 can also include a global positioning device 10J for determining the position or location of the central processing computer 10. In a preferred embodiment, the global positioning device 10J can be utilized in order to determine the position or location of the central processing computer 10 so as to, for example, determine a jurisdiction in which the central processing computer 10 is located.

For example, if the central processing computer 10 is located on board a boat, ship, aircraft, or jet, the global positioning device 10J can be utilized in order to determine if the respective boat, ship, aircraft, or jet, is in or over international waters or international airspace, and, therefore, outside of a state's or a country's gaming laws, or within the jurisdiction of international gaming laws, etc., if applicable. In another embodiment, when traveling over land, such as in a bus, automobile, or train, etc., the global positioning device 10J can be utilized in order to determine when a state or national line has been crossed in order to ascertain that new gaming laws may be or have been put into effect. The global positioning device 10J can also be connected with the CPU 10A.

Figure 3:
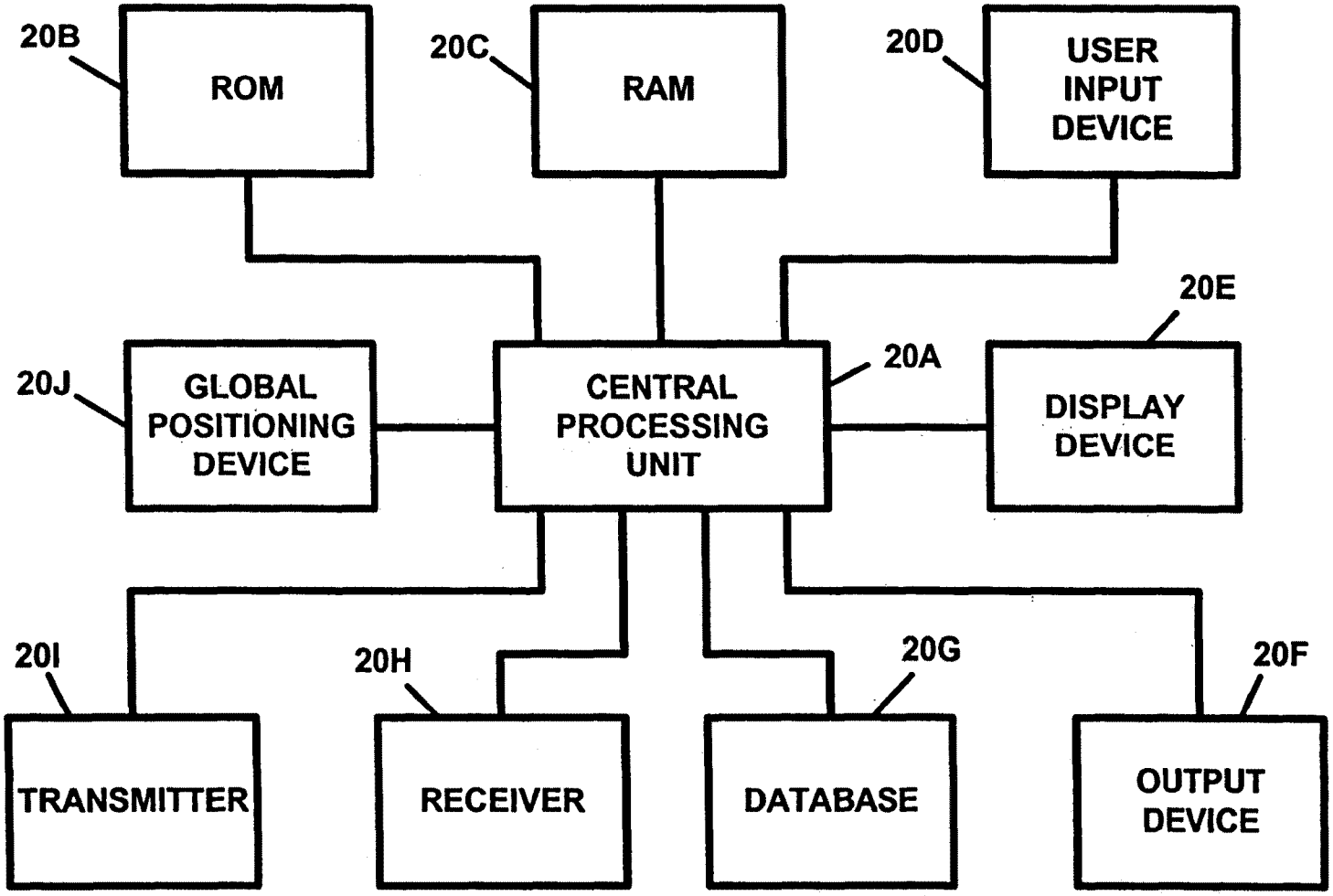
FIG. 3 illustrates a preferred embodiment of the user communication device of FIG. 1, in block diagram form.

FIG. 3 illustrates the user communication device 20 of FIG. 1, in block diagram form. With reference to FIG. 3, the user communication device 20 includes a central processing unit (CPU) 20A. The central processing unit (CPU) 20A may be a microprocessor, a microcomputer, a minicomputer, a macro-computer, or a mainframe computer, depending upon the application.

The user communication device 20 also includes a read only memory (ROM) device 20B and a random access memory (RAM) device 20C which are also connected to the CPU 20A. The user communication device 20 also includes a user input device(s) 20D which can include any one or more of a keyboard, a scanner, a user pointing device, such as, for example, a mouse, an audio input device, a touch pad, or a touch screen, etc., which input device(s) 20D is also connected to the CPU 20A.

The user communication device 20 also includes a display device 20E, such as a display monitor and/or a display screen for providing the herein-described information to the user or player. The display device 20E is also connected to the CPU 20A. The user communication device 20 can also include an output device 20F, such as a printer, a display device, and/or a modem, for outputting, in either or both of hard copy form or electronic form, any of the information which is described herein as being provided by, or at, the user communication device 20. The output device 20F can also be connected to the CPU 20A.

The user communication device 20 can also include a database(s) 20G, which can contain any information and/or data which may be required, and/or which may be desired, for performing any of the functionality and/or processing routines described herein as being performed by the user communication device 20 and/or the apparatus 100. In a preferred embodiment, the database 20G can also include any of the information and/or data described herein as being contained in the respective databases of the central processing computer(s) 10, the gaming facility computer(s) 30, the financial institution computer(s) 40, the escrow agent computer(s) 50, and/or the governmental entity computer(s) 60, described herein. The database 20G can also be connected to the CPU 20A.

The user communication device 20 can also include a receiver 20H for receiving data and/or information, including any of the herein-described information, and/or any of the other information described herein as being provided to the user communication device 20, from any of the central processing computer systems 10, from any of the gaming facility computers 30, from any of the financial institution computers 40, from any of the escrow agent computers 50, from any of the governmental entity computers 60, and/or from any of the other user communication devices 20, described herein. The receiver 20H can also be connected to the CPU 20A.

The user communication device 20 can also include a transmitter 20I for transmitting data and/or information, including any of the herein-described information, and/or any of the other information described herein as being provided from or transmitted from the user communication device 20, to any of the central processing computer systems 10, to any of the gaming facility computers 30, to any of the financial institution computers 40, to any of the escrow agent computers 50, to any of the governmental entity computers 60, and/or to any of the other user communication devices 20, described herein. The transmitter 20I can also be connected to the CPU 20A.

With reference to FIG. 3, the user communication device 20 can also include a global positioning device 20J for determining the position or location of the user communication device 20. In a preferred embodiment, the global positioning device 20J can be utilized to determine the position or location of the user communication device 20 so as to, for example, determine a jurisdiction in which the user communication device 20 is located and/or is being utilized.

For example, if the user communication device 20 is located on board a boat, ship, aircraft, or jet, the global positioning device 20J can be utilized in order to determine if the respective boat, ship, aircraft, or jet, is in or over international waters or international airspace, and, therefore, outside of a state's or a country's gaming laws, or within the jurisdiction of international gaming laws, etc., if applicable. In another embodiment, when traveling over land, such as in a bus, automobile, or train, etc., the global positioning device 20J can be utilized in order to determine when a state or national line has been crossed in order to ascertain that new gaming laws may be or have been put into effect. The global positioning device 20J can also be connected with the CPU 20A.

Figure 4:
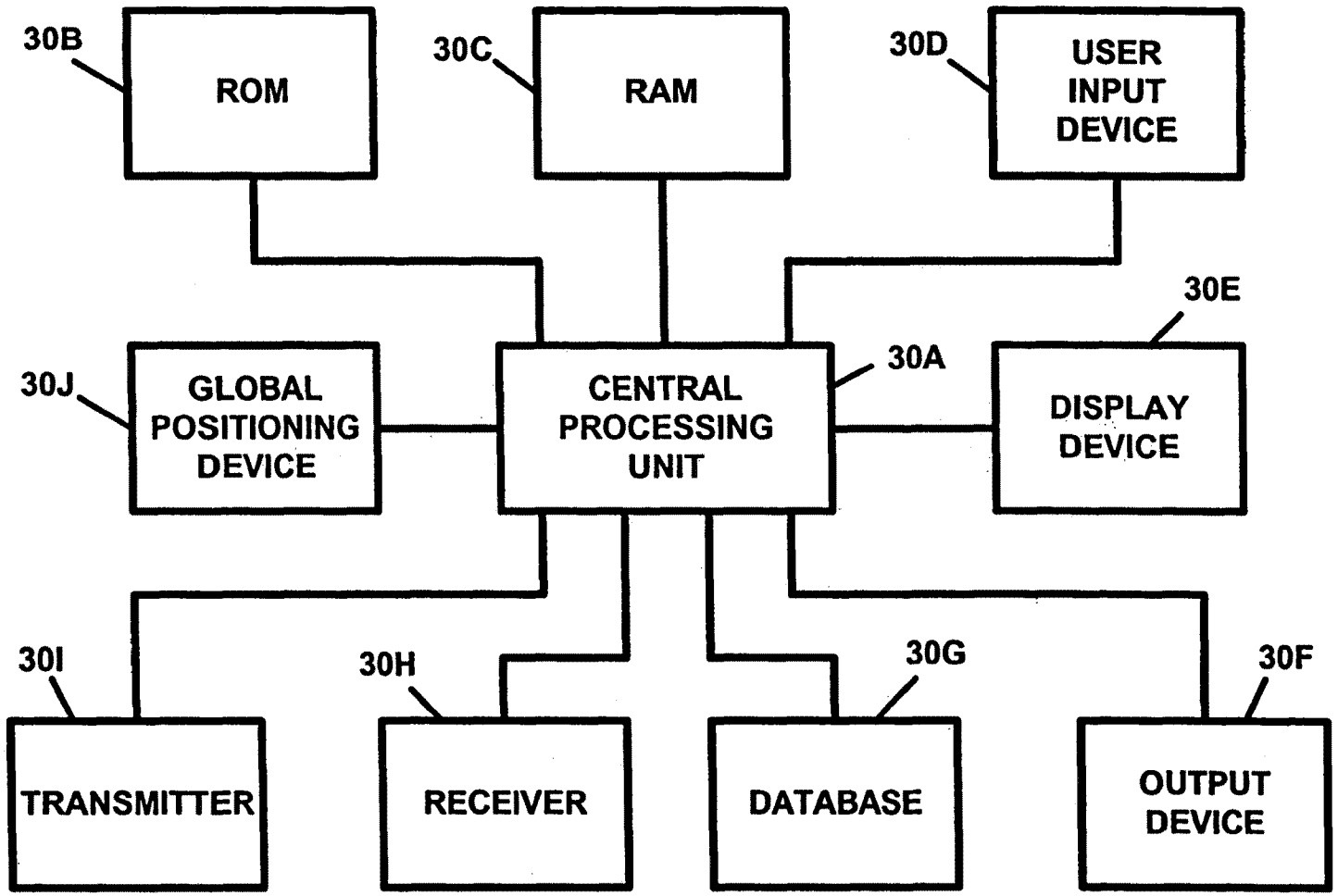
FIG. 4 illustrates a preferred embodiment of the gaming facility computer of FIG. 1, in block diagram form.

FIG. 4 illustrates the gaming facility computer 30 of the apparatus 100, in block diagram form. With reference to FIG. 4, the gaming facility computer 30 includes a central processing unit (CPU) 30A. The central processing unit (CPU) 30A may be a microprocessor, a microcomputer, a minicomputer, a macro-computer, or a mainframe computer, depending upon the application.

The gaming facility computer 30 also includes a read only memory (ROM) device 30B and a random access memory (RAM) device 30C which are also connected to the CPU 30A. The gaming facility computer 30 also includes a user input device(s) 30D which can include any one or more of a keyboard, a scanner, a user pointing device, such as, for example, a mouse, an audio input device, a touch pad, or a touch screen, etc., which input device(s) 30D is also connected to the CPU 30A.

The gaming facility computer 30 also includes a display device 30E, such as a display monitor and/or a display screen for providing the herein-described information to the operator of the gaming facility computer 30. The display device 30E is also connected to the CPU 30A.

The gaming facility computer 30 can also include an output device 30F, such as a printer, a display device, and/or a modem, for outputting, in either or both of hard copy form or electronic form, any of the information which is described herein as being provided by, or at, the gaming facility computer 30. The output device 30F can also be connected to the CPU 30A.

The gaming facility computer 30 can also include a database(s) 30G, which can contain any information and/or data which may be required, and/or which may be desired, for performing any of the functionality and/or processing routines described herein as being performed by the gaming facility computer 30 and/or the apparatus 100.

For example, the database 30G can contain account information for any of the users or players, gaming providers, gaming facilities, gaming events, financial institutions, escrow agents, and/or governmental entities, who or which utilize the apparatus 100 and method of the present invention, including, but not limited to, name of the respective user or party, address of the respective user or party, telephone number of the respective user or party, e-mail address of the respective user or party, financial account information of the respective user or party, gaming account information of the respective user or party, limitation or restrictions on a user's or a player's gaming account, gaming account betting limits for a user's or a player's gaming account, games or games of chance which can be played via the apparatus 100 of the present invention, gaming activities, gaming events, and/or games of chance which can be the subject of gaming activity or gambling activity, schedules of gaming activities or gambling activities, results of gaming activities or gambling activities, historical information, including statistical results regarding gaming activities or gambling activities, and/or any other information and/or data described herein and/or otherwise which is needed and/or desired in order to perform any and/or all of the processing routines and/or functionality described herein as being performed and/or provided by the apparatus 100 and method of the present invention and/or by any of the central processing computers 10, user computers 20, financial institution computers 40, escrow agent computers 50, governmental entity computers 60, and/or any of the other gaming facility computer 30 described herein.

The database 30G also contains information regarding any and/or all of the video equipment 70, audio equipment 80, video conferencing equipment 90, and/or any of the components thereof, described as being utilized in conjunction with the apparatus 100 of the present invention. The information regarding the video equipment 70, audio equipment 80, video conferencing equipment 90, and/or any of the components thereof, can include the identity of the respective equipment or component, the location of deployment, the game, gaming activity, gaming facility, gaming event, gaming provider, in conjunction with which the respective equipment or component is utilized, an IP address or other address for accessing the respective equipment or component thereof, and/or any other information needed and/or desired regarding the operation and/or utilization of the video equipment 70, the audio equipment 80, and/or the video conferencing equipment 90.

The database 30G can also contain information regarding gaming laws, regulations, and rules, income tax laws, regulations, and/or rules, regarding any of the jurisdictions in which the apparatus 100 and method of the present invention can be utilized.

The database 30G can also contain any other data and/or information which may be needed and/or desired for performing any and/or all of the processing routines and/or functionality described herein as being provided by the gaming facility computer 30 and/or apparatus 100. The database 30G can also be connected to the CPU 30A.

The gaming facility computer 30 can also include a receiver 30H for receiving data and/or information, including any of the herein-described information, and/or any of the other information described herein as being provided to the gaming facility computer 30 from any of the central processing computers 10, from any of the user communication devices 20, from any of the financial institution computers 40, from any of the escrow agent computers 50, from any of the governmental entity computers 60, and/or from any of the other gaming facility computers 30, described herein. The receiver 30H can also be connected to the CPU 30A.

The gaming facility computer 30 can also include a transmitter 30I for transmitting data and/or information, including any of the herein-described information, and/or any of the other information described herein as being provided from the gaming facility computer 30 to any of the central processing computers, to any of the user communication devices 20, to any of the financial institution computers 40, to any of the escrow agent computers 50, to any of the governmental entity computers 60, and/or to any of the other gaming facility computers 30, described herein. The transmitter 30I can also be connected to the CPU 30A.

With reference to FIG. 4, the gaming facility computer 30 can also include a global positioning device 30J for determining the position or location of the gaming facility computer 30. In a preferred embodiment, the global positioning device 30J can be utilized in order to determine the position or location of the gaming facility computer 30 so as to, for example, determine a jurisdiction in which the gaming facility computer 30 is located.

For example, if the gaming facility computer 30 is located on board a boat, ship, aircraft, or jet, the global positioning device 30J can be utilized in order to determine if the respective boat, ship, aircraft, or jet, is in or over international waters or international airspace, and, therefore, outside of a state's or a country's gaming laws, or within the jurisdiction of international gaming laws, etc., if applicable. In another embodiment, when traveling over land, such as in a bus, automobile, or train, etc., the global positioning device 30J can be utilized in order to determine when a state or national line has been crossed in order to ascertain that new gaming laws may be or have been put into effect. The global positioning device 30J can also be connected with the CPU 30A.

Figure 5:
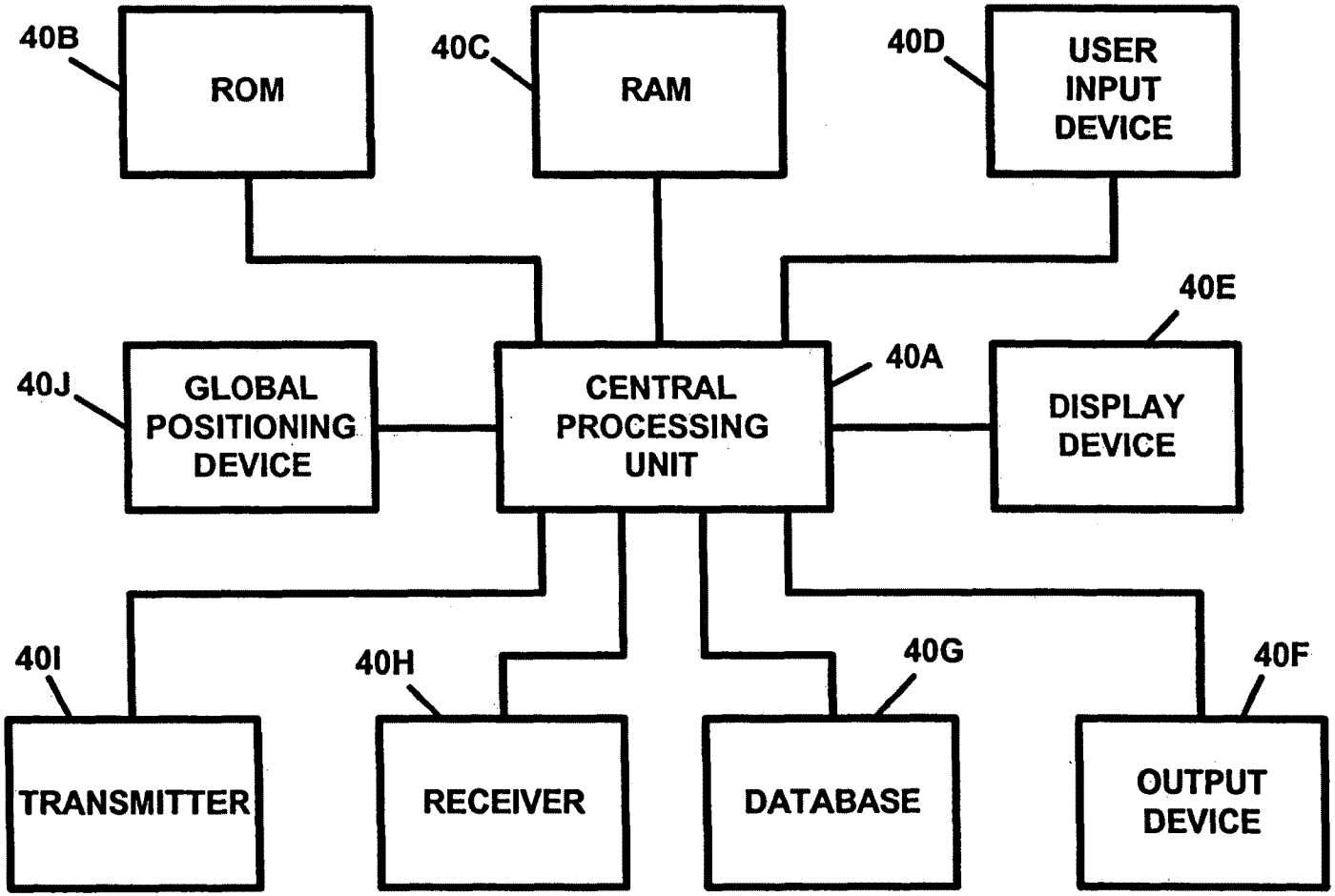
FIG. 5 illustrates a preferred embodiment of the financial institution computer of FIG. 1, in block diagram form.

FIG. 5 illustrates the financial institution computer 40 of the apparatus 100, in block diagram form. With reference to FIG. 5, the financial institution computer 40 includes a central processing unit (CPU) 40A. The central processing unit (CPU) 40A may be a microprocessor, a microcomputer, a minicomputer, a macro-computer, or a mainframe computer, depending upon the application.

The financial institution computer 40 also includes a read only memory (ROM) device 40B and a random access memory (RAM) device 40C which are also connected to the CPU 40A. The financial institution computer 40 also includes a user input device(s) 40D which can include any one or more of a keyboard, a scanner, a user pointing device, such as, for example, a mouse, an audio input device, a touch pad, or a touch screen, etc., which input device(s) 40D is also connected to the CPU 40A.

The financial institution computer 40 also includes a display device 40, such as a display monitor and/or a display screen for providing the herein-described information to the operator of the financial institution computer 40. The display device 40E is also connected to the CPU 40A.

The financial institution computer 40 can also include an output device 40F, such as a printer, a display device, and/or a modem, for outputting, in either or both of hard copy form or electronic form, any of the information which is described herein as being provided by, or at, the financial institution computer 40. The output device 40F can also be connected to the CPU 40A.

The financial institution computer 40 can also include a database(s) 40G, which can contain any information and/or data which may be required, and/or which may be desired, for performing any of the functionality and/or processing routines described herein as being performed by the financial institution computer 40 and/or the apparatus 100.

For example, the database 40G can contain account information for any of the users or players, gaming providers, gaming facilities, gaming events, financial institutions, escrow agents, and/or governmental entities, who or which utilize the apparatus 100 and method of the present invention, including, but not limited to, name of the respective user or party, address of the respective user or party, telephone number of the respective user or party, e-mail address of the respective user or party, financial account information of the respective user or party, gaming account information of the respective user or party, limitation or restrictions on a user's or a player's gaming account, gaming account betting limits for a user's or a player's gaming account, games or games of chance which can be played via the apparatus 100 of the present invention, gaming activities, gaming events, and/or games of chance which can be the subject of gaming activity or gambling activity, schedules of gaming activities or gambling activities, results of gaming activities or gambling activities, historical information, including statistical results regarding gaming activities or gambling activities, and/or any other information and/or data described herein and/or otherwise which is needed and/or desired in order to perform any and/or all of the processing routines and/or functionality described herein as being performed and/or provided by the apparatus 100 and method of the present invention and/or by any of the central processing computers 10, user computers 20, gaming facility computers 30, escrow agent computers 50, governmental entity computers 60, and/or any of the other financial institution computer 40 described herein.

The database 40G can also contain information regarding gaming laws, regulations, and rules, income tax laws, regulations, and/or rules, regarding any of the jurisdictions in which the apparatus 100 and method of the present invention can be utilized.

The database 40G can also contain any other data and/or information which may be needed and/or desired for performing any and/or all of the processing routines and/or functionality described herein as being provided by the financial institution computers 40 and/or the apparatus 100. The database 40G can also be connected to the CPU 40A.

The financial institution computer 40 can also include a receiver 40H for receiving data and/or information, including any of the herein-described information, and/or any of the other information described herein as being provided to the financial institution computer 40 from any of the central processing computers 10, from any of the user communication devices 20, from any of the gaming facility computers 30, from any of the escrow agent computers 50, from any of the governmental entity computers 60, and/or from any of the other financial institution computers 40, described herein. The receiver 40H can also be connected to the CPU 40A.

The financial institution computer 40 can also include a transmitter 401 for transmitting data and/or information, including any of the herein-described information, and/or any of the other information described herein as being provided from the financial institution computer 40 to any of the central processing computers, to any of the user communication devices 20, to any of the gaming facility computers 40, to any of the escrow agent computers 50, to any of the governmental entity computers 60, and/or to any of the other financial institution computers 40, described herein. The transmitter 401 can also be connected to the CPU 40A.

With reference to FIG. 5, the financial institution computer 40 can also include a global positioning device 40J for determining the position or location of the financial institution computer 40. In a preferred embodiment, the global positioning device 40J can be utilized in order to determine the position or location of the financial institution computer 40 so as to, for example, determine a jurisdiction in which the financial institution computer 40 is located.

For example, if the financial institution computer 40 is located on board a boat, ship, aircraft, or jet, the global positioning device 40J can be utilized in order to determine if the respective boat, ship, aircraft, or jet, is in or over international waters or international airspace, and, therefore, outside of a state's or a country's gaming laws, or within the jurisdiction of international gaming laws, etc., if applicable. In another embodiment, when traveling over land, such as in a bus, automobile, or train, etc., the global positioning device 40J can be utilized in order to determine when a state or national line has been crossed in order to ascertain that new gaming laws may be or have been put into effect. The global positioning device 40J can also be connected with the CPU 40A.

Figure 6:
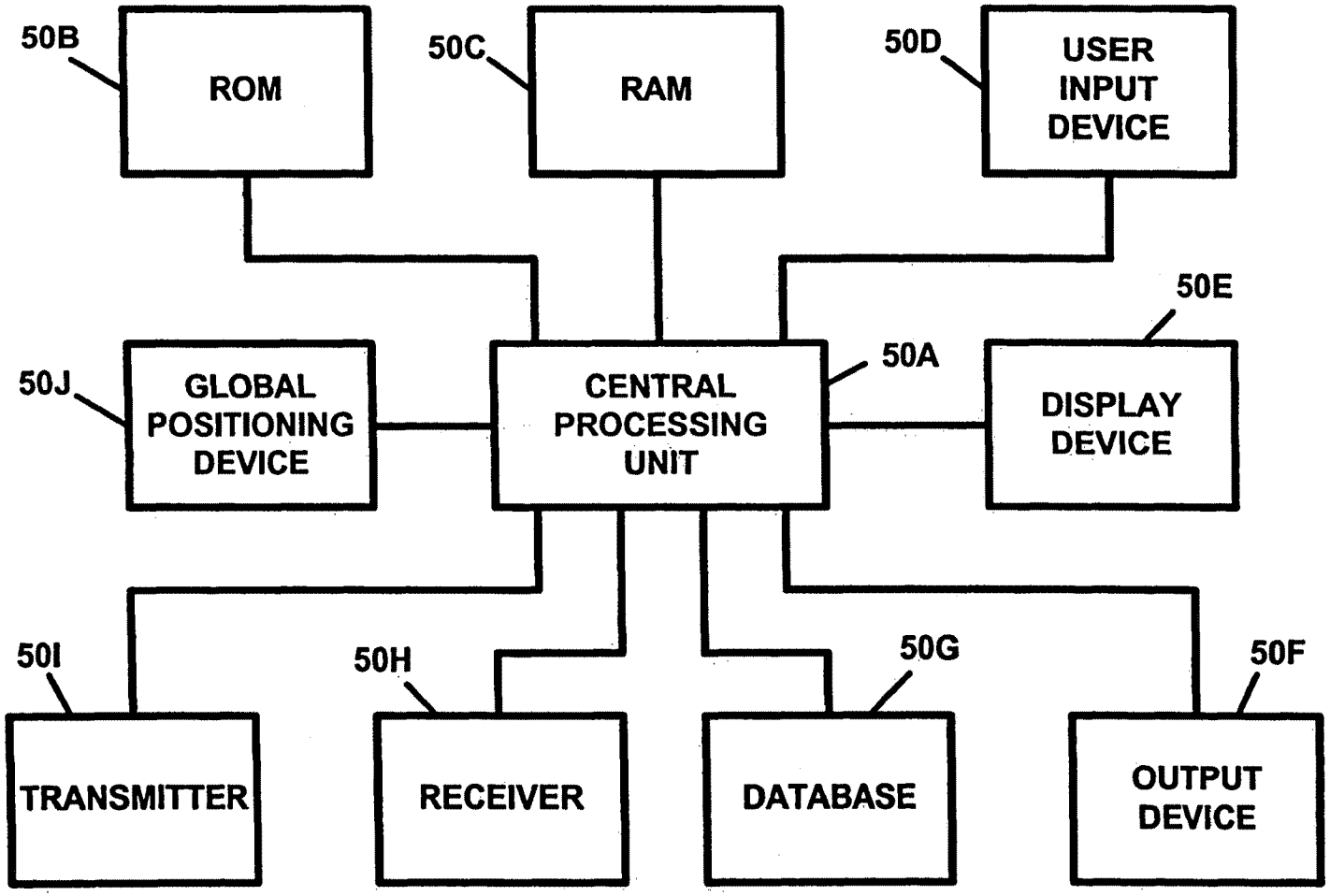
FIG. 6 illustrates a preferred embodiment of the escrow agent computer of FIG. 1, in block diagram form.

FIG. 6 illustrates the escrow agent computer 50 of the apparatus 100, in block diagram form. With reference to FIG. 6, the escrow agent computer 50 includes a central processing unit (CPU) 50A. The central processing unit (CPU) 50A may be a microprocessor, a microcomputer, a minicomputer, a macro-computer, or a mainframe computer, depending upon the application.

The escrow agent computer 50 also includes a read only memory (ROM) device 50B and a random access memory (RAM) device 50C which are also connected to the CPU 50A. The escrow agent computer 50 also includes a user input device(s) 50D which can include any one or more of a keyboard, a scanner, a user pointing device, such as, for example, a mouse, an audio input device, a touch pad, or a touch screen, etc., which input device(s) 50D is also connected to the CPU 50A.

The escrow agent computer 50 also includes a display device 50, such as a display monitor and/or a display screen for providing the herein-described information to the operator of the escrow agent computer 50. The display device 50E is also connected to the CPU 50A.

The escrow agent computer 50 can also include an output device 50F, such as a printer, a display device, and/or a modem, for outputting, in either or both of hard copy form or electronic form, any of the information which is described herein as being provided by, or at, the escrow agent computer 50. The output device 50F can also be connected to the CPU 50A.

The escrow agent computer 50 can also include a database(s) 50G, which can contain any information and/or data which may be required, and/or which may be desired, for performing any of the functionality and/or processing routines described herein as being performed by the escrow agent computer 50 and/or the apparatus 100.

For example, the database 50G can contain account information for any of the users or players, gaming providers, gaming facilities, gaming events, financial institutions, escrow agents, and/or governmental entities, who or which utilize the apparatus 100 and method of the present invention, including, but not limited to, name of the respective user or party, address of the respective user or party, telephone number of the respective user or party, e-mail address of the respective user or party, financial account information of the respective user or party, gaming account information of the respective user or party, limitation or restrictions on a user's or a player's gaming account, gaming account betting limits for a user's or a player's gaming account, games or games of chance which can be played via the apparatus 100 of the present invention, gaming activities, gaming events, and/or games of chance which can be the subject of gaming activity or gambling activity, schedules of gaming activities or gambling activities, results of gaming activities or gambling activities, historical information, including statistical results regarding gaming activities or gambling activities, and/or any other information and/or data described herein and/or otherwise which is needed and/or desired in order to perform any and/or all of the processing routines and/or functionality described herein as being performed and/or provided by the apparatus 100 and method of the present invention and/or by any of the central processing computers 10, user computers 20, gaming facility computers 30, financial institution computers 40, governmental entity computers 60, and/or any of the other escrow agent computers 50 described herein.

The database 50G can also contain information regarding gaming laws, regulations, and rules, income tax laws, regulations, and/or rules, regarding any of the jurisdictions in which the apparatus 100 and method of the present invention can be utilized.

The database 50G can also contain any other data and/or information which may be needed and/or desired for performing any and/or all of the processing routines and/or functionality described herein as being provided by the escrow agent computers 50 and/or the apparatus 100. The database 50G can also be connected to the CPU 50A.

The escrow agent computer 50 can also include a receiver 50H for receiving data and/or information, including any of the herein-described information, and/or any of the other information described herein as being provided to the escrow agent computer 50 from any of the central processing computers 10, from any of the user communication devices 20, from any of the gaming facility computers 30, from any of the financial institution computers 40, from any of the governmental entity computers 60, and/or from any of the other escrow agent computers 50 described herein. The receiver 50H can also be connected to the CPU 50A.

The escrow agent computer 50 can also include a transmitter 50I for transmitting data and/or information, including any of the herein-described information, and/or any of the other information described herein as being provided from the escrow agent computer 50 to any of the central processing computers 10, to any of the user communication devices 20, to any of the gaming facility computers 30, to any of the financial institution computers 40, to any of the governmental entity computers 60, and/or to any of the other escrow agent computers 50, described herein. The transmitter 50I can also be connected to the CPU 50A.

With reference to FIG. 5, the escrow agent computer 50 can also include a global positioning device 50J for determining the position or location of the escrow agent computer 50. In a preferred embodiment, the global positioning device 50J can be utilized in order to determine the position or location of the escrow agent computer 50 so as to, for example, determine a jurisdiction in which the escrow agent computer 50 is located.

For example, if the escrow agent computer 50 is located on board a boat, ship, aircraft, or jet, the global positioning device 50J can be utilized in order to determine if the respective boat, ship, aircraft, or jet, is in or over international waters or international airspace, and, therefore, outside of a state's or a country's gaming laws, or within the jurisdiction of international gaming laws, etc., if applicable. In another embodiment, when traveling over land, such as in a bus, automobile, or train, etc., the global positioning device 50J can be utilized in order to determine when a state or national line has been crossed in order to ascertain that new gaming laws may be or have been put into effect. The global positioning device 50J can also be connected with the CPU 50A.

Figure 7:
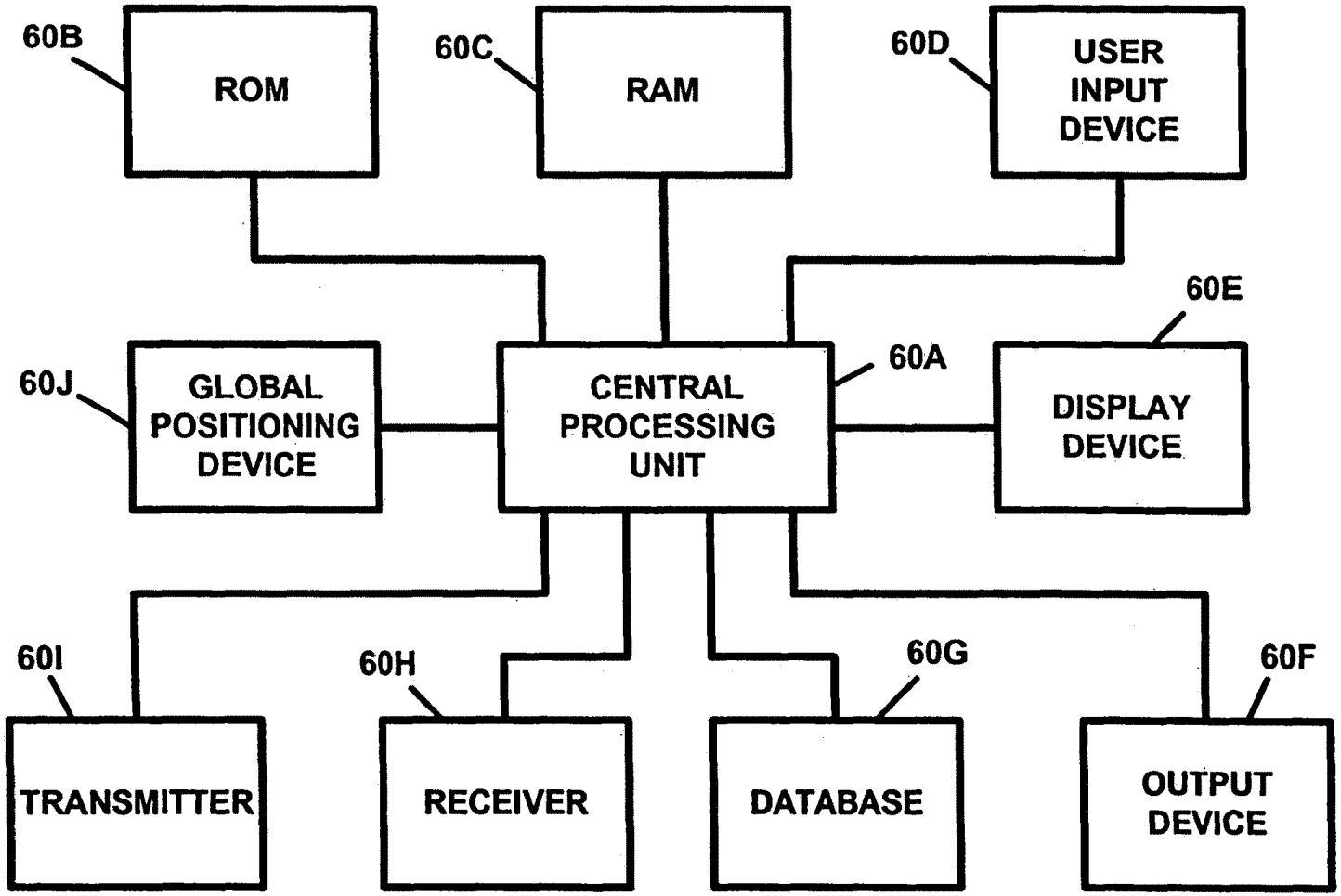
FIG. 7 illustrates a preferred embodiment of the governmental entity computer of FIG. 1, in block diagram form.

FIG. 7 illustrates the governmental entity computer 60 of the apparatus 100, in block diagram form. With reference to FIG. 7, the governmental entity computer 60 includes a central processing unit (CPU) 60A. The central processing unit (CPU) 60A may be a microprocessor, a microcomputer, a minicomputer, a macro-computer, or a mainframe computer, depending upon the application.

The governmental entity computer 60 also includes a read only memory (ROM) device 60B and a random access memory (RAM) device 60C which are also connected to the CPU 60A. The governmental entity computer 60 also includes a user input device(s) 60D which can include any one or more of a keyboard, a scanner, a user pointing device, such as, for example, a mouse, an audio input device, a touch pad, or a touch screen, etc., which input device(s) 60D is also connected to the CPU 60A.

The governmental entity computer 60 also includes a display device 60, such as a display monitor and/or a display screen for providing the herein-described information to the operator of the governmental entity computer 60. The display device 60E is also connected to the CPU 60A.

The governmental entity computer 60 can also include an output device 60F, such as a printer, a display device, and/or a modem, for outputting, in either or both of hard copy form or electronic form, any of the information which is described herein as being provided by, or at, the governmental entity computer 60. The output device 60F can also be connected to the CPU 60A.

The governmental entity computer 60 can also include a database(s) 60G, which can contain any information and/or data which may be required, and/or which may be desired, for performing any of the functionality and/or processing routines described herein as being performed by the governmental entity computer 60 and/or the apparatus 100.

For example, the database 60G can contain account information for any of the users or players, gaming providers, gaming facilities, gaming events, financial institutions, escrow agents, and/or governmental entities, who or which utilize the apparatus 100 and method of the present invention, including, but not limited to, name of the respective user or party, address of the respective user or party, telephone number of the respective user or party, e-mail address of the respective user or party, financial account information of the respective user or party, gaming account information of the respective user or party, limitation or restrictions on a user's or a player's gaming account, gaming account betting limits for a user's or a player's gaming account, games or games of chance which can be played via the apparatus 100 of the present invention, gaming activities, gaming events, and/or games of chance which can be the subject of gaming activity or gambling activity, schedules of gaming activities or gambling activities, results of gaming activities or gambling activities, historical information, including statistical results regarding gaming activities or gambling activities, and/or any other information and/or data described herein and/or otherwise which is needed and/or desired in order to perform any and/or all of the processing routines and/or functionality described herein as being performed and/or provided by the apparatus 100 and method of the present invention and/or by any of the central processing computers 10, user computers 20, gaming facility computers 30, escrow agent computers 50, financial institution computers 40, and/or any of the other governmental entity computers 60 described herein.

The database 60G can also contain information regarding gaming laws, regulations, and rules, income tax laws, regulations, and/or rules, regarding any of the jurisdictions in which the apparatus 100 and method of the present invention can be utilized.

The database 60G can also contain any other data and/or information which may be needed and/or desired for performing any and/or all of the processing routines and/or functionality described herein as being provided by the governmental entity computers 60 and/or the apparatus 100. The database 60G can also be connected to the CPU 60A.

The governmental entity computer 60 can also include a receiver 60H for receiving data and/or information, including any of the herein-described information, and/or any of the other information described herein as being provided to the governmental entity computer 60 from any of the central processing computers 10, from any of the user communication devices 20, from any of the gaming facility computers 30, from any of the financial institution computers 40, from any of the escrow agent computers 50, and/or from any of the other governmental entity computers 60 described herein. The receiver 60H can also be connected to the CPU 60A.

The governmental entity computer 60 can also include a transmitter 601 for transmitting data and/or information, including any of the herein-described information, and/or any of the other information described herein as being provided from the governmental entity computer 60 to any of the central processing computers 10, to any of the user communication devices 20, to any of the gaming facility computers 30, to any of the financial institution computers 40, to any of the escrow agent computers 50, to any of the governmental entity computers 60, and/or to any of the other governmental entity computers 60, described herein. The transmitter 601 can also be connected to the CPU 60A.

With reference to FIG. 7 location of the governmental entity computer 60. In a preferred embodiment, the global positioning device 60J can be utilized in order to determine the position or location of the governmental entity computer 60 so as to, for example, determine a jurisdiction in which the governmental entity computers 60 is located.

For example, if the governmental entity computers 60 is located on board a boat, ship, aircraft, or jet, the global positioning device 60J can be utilized in order to determine if the respective boat, ship, aircraft, or jet, is in or over international waters or international airspace, and, therefore, outside of a state's or a country's gaming laws, or within the jurisdiction of international gaming laws, etc., if applicable. In another embodiment, when traveling over land, such as in a bus, automobile, or train, etc., the global positioning device 60J can be utilized in order to determine when a state or national line has been crossed in order to ascertain that new gaming laws may be or have been put into effect. The global positioning device 60J can also be connected with the CPU 60A.

In any and/or all of the embodiments described herein, any of the processing routines and/or functionality described herein as being provided by the apparatus 100 can be performed by and/or provided by any of the central processing computers 10 described herein and/or can be performed by and/or provided by any of the gaming facility computers 30 described herein. In this manner, the terms "central processing computer 10" and "gaming facility computer 30" can be use interchangeably in order to convey the idea that any of the respective computers can be utilized in performing the described processing routines and/or functionality.

In a preferred embodiment, the apparatus 100 and method of the present invention can be utilized in order to provide information regarding gaming activities, gaming events, gambling activities, and or gambling events (hereinafter referred to as "gaming event") as well as any information relating to the gaming event. The apparatus 100 and method of the present invention can also be utilized in order to allow a user(s) or player(s) (hereinafter referred to as "user" or "users", whichever the case may be) to place bets and/or otherwise engage or participate in the gaming event.

The central processing computer 10, in a preferred embodiment, can be linked to any number of gaming facility computers 30 and can provide information regarding the gaming events which can be accessed at or via the respective gaming facility computers 30. For example, the central processing computer 10 can be linked to, can provide links to, and/or can contain information for allowing a user to link to and/or access one or more gaming facility computers 30.

In this manner, for example, the central processing computer can be linked to a gaming facility computer for each of any number of casinos, betting halls, racetracks, off-track betting facilities, sports stadiums, or arenas, etc., so as to provide a central location from which a user may access any number of gaming events.

The central processing computer 10 can also process bets in order to allow the user to place bets on any of the gaming events which can be accessed via the central processing computer 10 and/or any of the gaming facility computers 30. In another preferred embodiment, the user can access a particular gaming facility computer 30 directly and/or via the central processing computer 10 and place bets at the gaming facility computer 30.

In another preferred embodiment, the central processing computer 10 and/or any of the gaming facility computers 30 can also provide information to the user regarding any one or more of the gaming events. For example, a user can request information regarding the types or kinds of gaming events available on which to place a bet or bets (i.e. state lottery, casino slots, casino table game, casino roulette wheel, horserace, dog race, baseball game or series, football game or series, or basketball game or series, etc.) and information regarding the gaming nature of the bet or the game of chance involved (i.e. lottery odds of winning, last winning draw, last winning pay out, odds of winning, slot pay outs, frequency of user wins, amount of user wins, frequency of user wins at any table games, amount of user wins at table games, roulette wheel wins by users, amounts of roulette wins, teams records, sports players records, averages, and/or statistics, and/or any statistical and/or historical records regarding any of the herein-described gaming events, etc.).

For example, a user desiring to play a game of slots via the apparatus 100 can request information regarding the previous pay outs on a machine prior to playing on one, a user desiring to play a game of roulette can request information regarding previous winning numbers and the probabilistic information regarding same, a user desiring to bet on a professional or college sporting event can request information regarding player statistics against an opposing team, historical records regarding prior meetings of the teams, player injuries, or line-ups for the game, etc., and any other information which a user may find desirable in having prior to placing a bet on a gaming event.

The apparatus 100 can be utilized to allow a user to identify and/or select a gaming event, allow a user to obtain information regarding the gaming event or event players or participants (i.e. teams, individual athletes) and allow a user to place a bet on the gaming event and thereby engage in gaming activity and/or gambling activity via the user communication device 20.

Figure 8A:
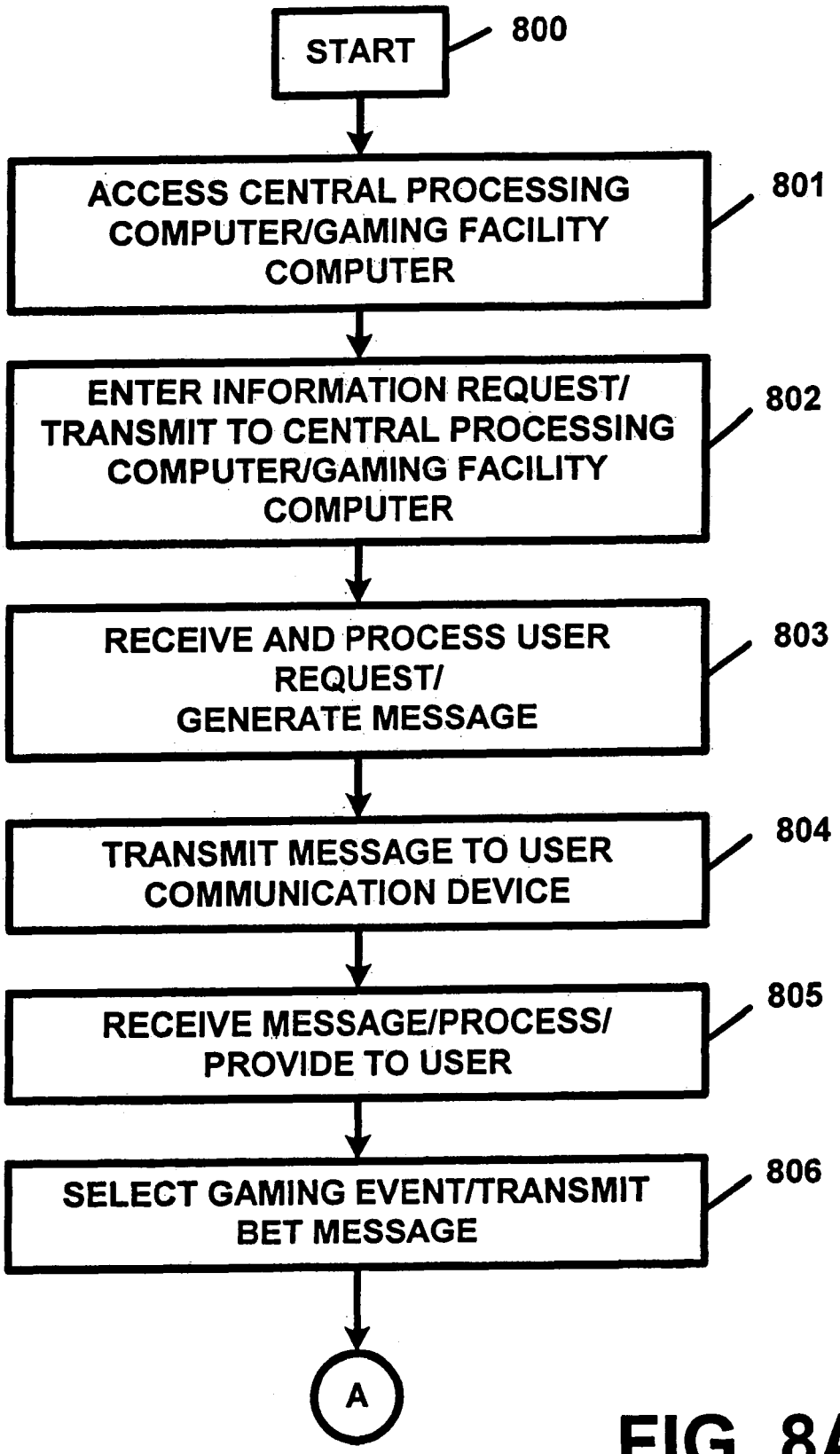
FIGS. 8A and 8B illustrate a preferred embodiment method for utilizing the apparatus and method of the present invention, in flow diagram form.
Figure 8B:
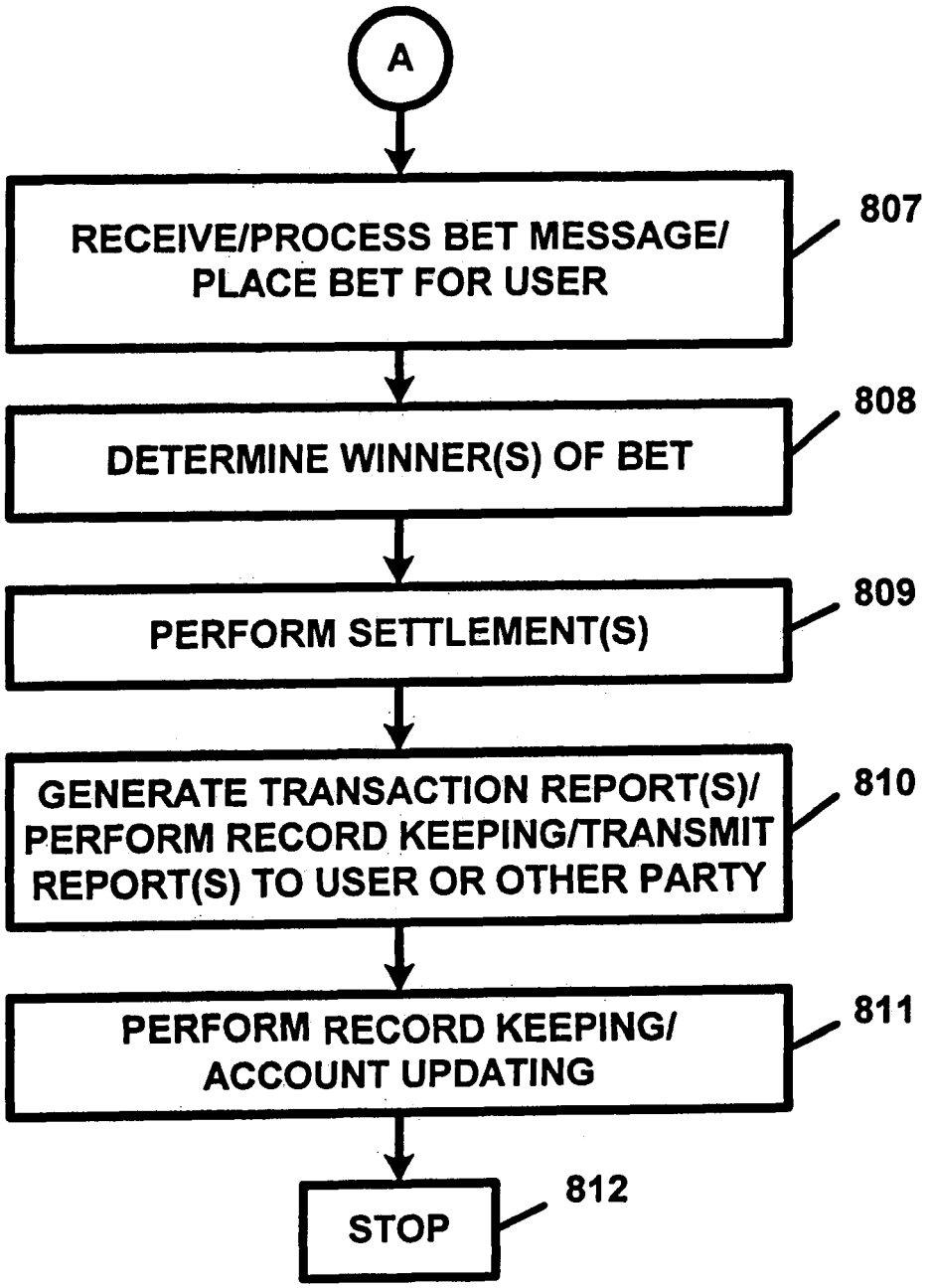

In the embodiment of FIGS. 8A and 8B, as well as any and/or all of the other embodiments described herein, the central processing computer 10 and the gaming facility computer 30 can be used interchangeably depending upon the situation. For example, in an embodiment wherein a number of gaming facility computers 30 can be accessed by a central processing computer, the user can access a particular gaming facility computer 30 via the central processing computer 10 and/or the user can access the particular gaming computer 30 directly. In another preferred embodiment, the central processing computer 10 and the gaming facility computer 30 can perform the same functionality.

FIGS. 8A and 8B illustrate a preferred embodiment method for utilizing the apparatus 100 of the present invention, in flow diagram form. With reference to FIGS. 8A and 8B, the operation of the apparatus commences at step 800. At step 801, the user can access the central processing computer 10 and/or the gaming facility computer 30 via the user communication device. At step 802, the user can enter information regarding a request for information regarding an available gaming event or gaming events. At step 802, the user can also request any additional information regarding a gaming event, such as, for example, information regarding past winning information, statistical information and/or historic information, etc, and/or any information regarding the gaming events or the teams or players involved in the gaming event.

For example, a user desiring to bet on a baseball game or games can request information regarding the available games and information regarding the teams and/or players involved, including statistics, or historical information regarding prior games or match-ups, etc., and/or any other information. The user can also request statistical and/or historic information regarding casino table games, or slot machine games, etc. At step 802, the user's request can be transmitted to the central processing computer 10 and/or the gaming facility computer 30.

At step 803, the central processing computer 10 and/or the gaming facility computer 30 can receive and process the user's request. At step 803, the central processing computer 10 and/or the gaming facility computer 30 can identify the gaming events which are available via the central processing computer 10 and/or the gaming facility computer 30. At step 803, the central processing computer 10 and/or the gaming facility computer 30 can also obtain any of the additional information described herein and/or otherwise regarding the gaming event or gaming events. The additional information, which is understood to be any information which can be recorded and/or stored regarding gaming event, can be retrieved from any of the respective databases of the respective central processing computer(s) 10 and/or from any of the respective gaming facility computers 30.

At step 803, the central processing computer 10 and/or the gaming facility computer 30 can generate a message including information regarding the identified available gaming events and any of the additional information regarding the particular gaming event or gaming events.

At step 804, the message is transmitted to the user communication device 20. At step 805, the user communication device 20 can receive the message, process the information contained therein and provide the information to the user in any one or more of video information, audio information, and/or text information.

At step 806, the user can select the gaming event or gaming events on which he or she desires to place a bet. At step 806, the user can transmit a bet message or betting message regarding any selected gaming event or gaming events. In a preferred embodiment, the user can place any number of bets on any number of gaming events.

The bet message or betting message can include any one or more of information identifying the gaming event, information regarding the amount of the bet, and/or information regarding a payment identifier which can include any one or more of a electronic monetary instrument, a credit card number, a charge card number, a debit card number, a smart card number, a currency card number, a bank account number, a checking account number, a savings account number, a gaming account number associated with the user and which can be maintained and/or administered by the central processing computer 10 and/or a gaming facility computer, 30, and/or any other payment information.

At step 807, the central processing computer 10 and/or the gaming facility computer 30 can receive the bet message and/or the betting message, process same and effectuate and/or place the bet for the user. In another preferred embodiment, the central processing computer 10 can administer financial and/or gaming accounts for any user or users, and any counterparty or counterparties to or for any bets on any of the herein-described gaming events. In another preferred embodiments, the money or the equivalent or indicia of same can be placed in escrow at the escrow computer 50 until the gaming event has been concluded. In another preferred embodiment, the central processing computer 10 and/or the gaming facility computer 30 can process the above-described information for all of the bets placed by the user.

At step 808, the central processing computer 10 and/or the gaming facility computer 30 can, upon the gaming event occurring and/or concluding, determine the results and identify the winning user or party to the bet or bets. In another preferred embodiment, the central processing computer 10 and/or the gaming facility computer 30 can determine the results and winning parties for all of the bets placed by the user.

At step 809, the central processing computer 10 and/or the gaming facility computer 30 can perform the settlements for any and/or all of the bets placed by the user. In this regard, the central processing computer 10 and/or the gaming facility computer 30 can effectuate payment of the winnings for each and/or every gaming event on which the user placed a bet, to the winner and/or to the winners financial account and/or gaming account. In another preferred embodiment, the central processing computer 10 and/or the gaming facility computer 30 can generate and transmit a payout instruction message to the escrow computer 50 if such is utilized.

At step 810, the central processing computer 10 and/or the gaming facility computer 30 can generate a transaction report or gaming report for each bet made by the user and/or by the respective counterparty and store same in the database 10G. In another preferred embodiment, the central processing computer 10 and/or the gaming facility computer 30 can withhold taxes on winnings, generate 1099 or other income or winnings documentation, loss documentation, tax withholdings, and/or perform any other record keeping and/or reporting activities for or on behalf of the user or counterparty. The central processing computer 10 and/or the gaming facility computer 30 can also, at step 810, transmit the transaction report or the gaming report to the user communication device 20 and/or to a communication device associated with any other party.

The central processing computer 10 and/or the gaming facility computer 30 can also, at step 810, generate and transmit tax report messages for the user or the counterparty and transmit same to the appropriate governmental authority, the IRS, and/or state and/or local taxing authority.

At step 811, the central processing computer 10 and/or the gaming facility computer 30 can perform any other record keeping, record storing, and/or any account updating, regarding any of the user's accounts, users accounts, counterparty accounts, and/or accounts of counterparties. Thereafter, the operation of the apparatus 100 will cease at step 812.

As noted above, a gaming facility computer 30 associated with a gaming facility can be utilized in order to perform any of the above-described functionality described herein as being provided by the central processing computer 10. In this manner, the user can access a gaming facility computer 30 directly and/or via the central processing computer 10 and the gaming computer 30 can perform any and/or all of the processing routines and/or functionality described herein-above as being performed by the central processing computer 10.

In another preferred embodiment, a user or users can request to be notified upon a detected or identified availability of a gaming event, a posting of a gaming event, and/or a presence of a gaming event. For example, a user who desires to play a table card game at a remote casino anywhere in the world can be notified of the opening of the table and/or the start of the game for betting. For another example, a user desiring to bet on a prize fighter or boxer can be informed of a next boxing match involving the fighter. As another example, a user desiring to bet on a baseball, football, soccer, basketball and/or other sporting event, can request to be notified when a desired match up is scheduled (i.e. New York Mets vs. New York Yankees game, etc.).

The user can request to be notified of the availability of a gaming event, a scheduled happening of the gaming event, and/or any other information regarding the gaming event or its participants. In another preferred embodiment, the user can also request any of the additional information (i.e. lottery odds of winning, last winning draw, last winning pay out, odds of winning, slot pay outs, frequency of user wins, amount of user wins, frequency of user wins at any table games, amount of user wins at table games, roulette wheel wins by users, amounts of roulette wins, teams records, sports players records, averages, and/or statistics, and/or any statistical and/or historical records regarding any of the herein-described gaming events, information regarding previous winning numbers and the probabilistic information regarding same, player statistics against an opposing team, historical records regarding prior meetings of the teams, player injuries, or line-ups for the game, etc., and/or any other information which a user may find desirable in having prior to placing a bet on a gaming event, etc.) described herein in connection with the description corresponding to the embodiment of FIGS. 8A and 8B.

The user can access the central processing computer 10 and/or a particular gaming facility computer 30 via the user communication device 20 and transmit a message to the central processing computer 10 and/or a particular gaming facility computer 30. The message can contain information regarding the identity, type, or kind, of gaming event, for which the user desires to be notified. The message can also request to receive notification of gaming events having certain betting limits (i.e. maximum bets, or minimum bets, etc.), notification of gaming events having certain winning odds, notification of gaming events having certain participants or teams involved, notification of gaming events having a certain prize (i.e. lottery games over $25 Million, etc.), and/or notification of gaming events having certain criteria of interest to the user.

The message can also contain a user authorization to the respective central processing computer 10 and/or gaming facility computer 30 to automatically place a bet for the user. For example, a user desiring to bet $10.00 on the New York Mets to win against the New York Yankees in a next match-up between the two teams can program the central processing computer 10 and/or the particular gaming facility computer 30 to automatically place the bet for the user. In instances when the user desired to have a bet automatically placed by the central processing computer 10 and/or the particular gaming facility computer 30, the user message can contain a payment identifier such as any of the payment identifiers and/or payment methods described above in connection with the embodiment of FIGS. 8A and 8B.

In another preferred embodiment, the user can also request to be notified if betting odds change regarding a gaming event (i.e. a certain race horse is now paying two to one odds), a handicap or spread for a game has changed (i.e. the NFC team in the NFL Super Bowl formerly favored by three points is now favored by ten points over the AFC team, etc.). Information regarding these types of requests can also be contained in the message transmitted by the user to the central processing computer 10 and/or the particular gaming facility computer 30.

The user's message can be received, processed, and/or stored by the respective central processing computer 10 and/or particular gaming facility computer 30.

Figure 9A:
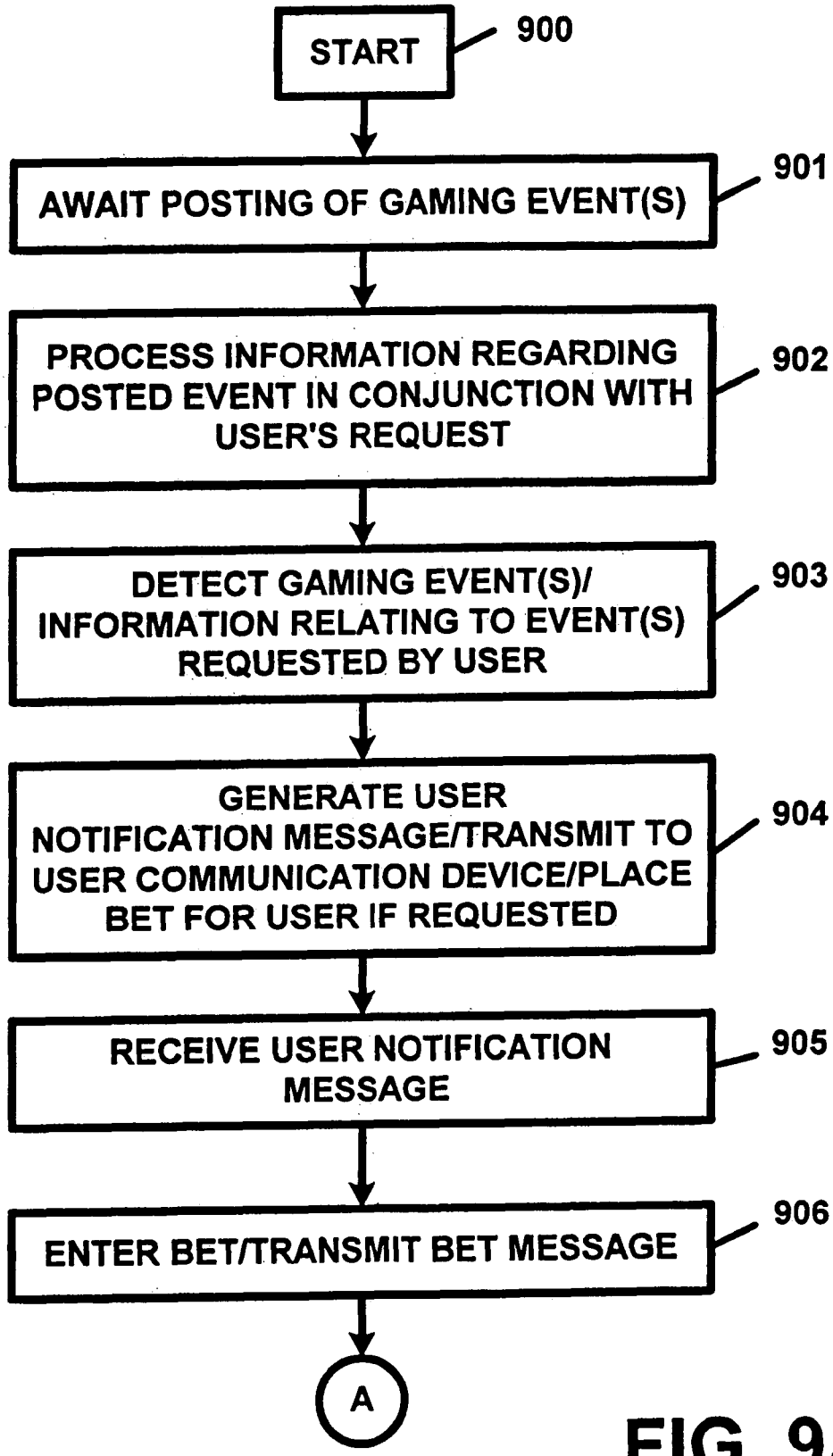
FIGS. 9A and 9B illustrate another preferred embodiment method for utilizing the apparatus and method of the present invention, in flow diagram form.
Figure 9B:
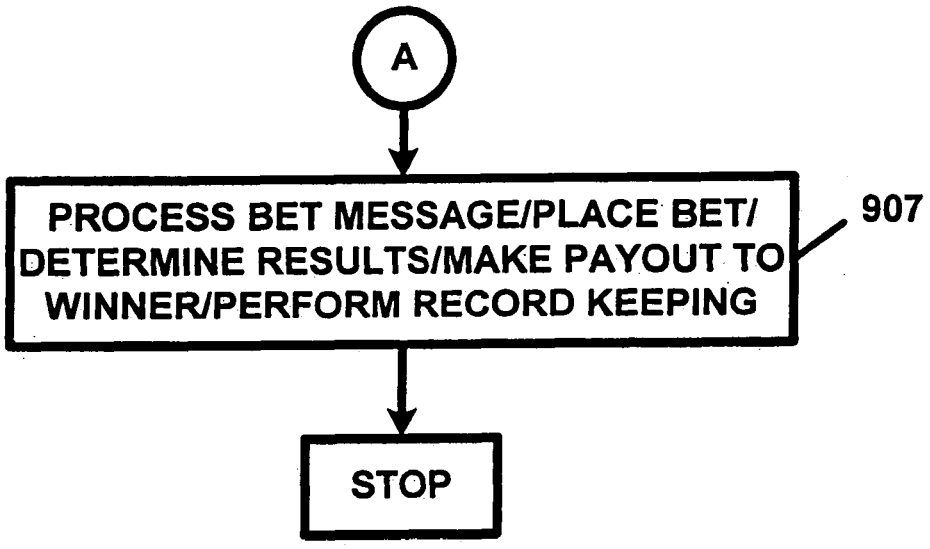

FIGS. 9A and 9B illustrate another preferred embodiment method for utilizing the apparatus 100 and method of the present invention, in flow diagram form. With reference to FIGS. 9A and 9B, the operation of the apparatus and method of the present invention commences at step 900. At step 901, the central processing computer 10 and/or the gaming facility computer 30 can await a posting regarding a gaming event or gaming events. Upon the detection of a posting of a gaming event or gaming events, the central processing computer 10 and/or the gaming facility computer 30 will process the information regarding the posting of the gaming event or gaming events.

In another preferred embodiment, schedules of gaming events can be pre-stored in the respective database of the central processing computer 10 and/or the particular gaming facility computer 30 and the respective central processing computer 10 and/or the particular gaming facility computer 30 can periodically search its own database.

At step 902, the respective central processing computer 10 and/or the particular gaming facility computer 30 can process the information regarding the posting of the gaming event or gaming events, and/or information stored in its database upon the detection of the posting and/or upon the occurrence of a scheduled review of the database in conjunction with the user's request. At step 903, the central processing computer 10 and/or the gaming computer 30 can detect a gaming event or gaming events for which the user has desired to be notified. The central processing computer 10 and/or the gaming facility computer 30 can also search for and detect a change of odds for a gaming event for which the user desired to be notified.

At step 904, upon detecting a gaming event or gaming events for which the user desires to be notified, the respective central processing computer 10 and/or the gaming facility computer 30 can generate a user notification message and transmit same to the user communication device 20 in real-time and/or otherwise. The user notification message can be transmitted to a respective user communication device 20 as any one or more of a pager message, a beeper message, a telephone call, a pre-recorded telephone message, and instant message, a facsimile message, and/or any e-mail message.

At step 904, the respective central processing computer 10 and/or the gaming facility computer 30 can also automatically place a user's bet on a gaming event or gaming events.

The user notification message can contain information regarding the gaming event or gaming events, any additional requested information regarding the gaming event or gaming events (i.e. lottery odds of winning, last winning draw, last winning pay out, odds of winning, slot pay outs, frequency of user wins, amount of user wins, frequency of user wins at any table games, amount of user wins at table games, roulette wheel wins by users, amounts of roulette wins, teams records, sports players records, averages, and/or statistics, and/or any statistical and/or historical records regarding any of the herein-described gaming events, information regarding previous winning numbers and the probabilistic information regarding same, player statistics against an opposing team, historical records regarding prior meetings of the teams, player injuries, or line-ups for the game, etc., and/or any other information which a user may find desirable in having prior to placing a bet on a gaming event, etc.), and, if the user has programmed or requested that a bet be placed automatically, information regarding the placing of the bet or bets.

At step 905, the user can receive the user notification message at the user communication device 20 and can review same. At step 906, the user can decide whether to place a bet and/or place additional bets. If, at step 906, the user has entered information into the user communication device 20, the user communication device 20 will transmit a bet message to the respective central processing computer 10 and/or gaming facility computer 30. The betting message can contain information regarding the gaming event or gaming events being bet on, the amount of the user's bet or wager, and any payment identifiers as described herein.

Thereafter, the operation of the apparatus 100 will proceed to step 907 and respective central processing computer 10 and/or the gaming computer 30 will process the bet, place the bet, determine the results of the gaming event, make any winning pay out to the user if the user wins or make a pay out to the winning counterparty is the user losses, and/or perform any record keeping and/or reporting, such as, for example, performing the operations similar to, the same as, and/or analogous to the operations described herein as being performed by the central processing computer 10 and/or the gaming facility computer 30 in steps 807 through 811 as described herein in connection with the preferred embodiment of FIGS. 8A and 8B. Thereafter, the operation of the apparatus will cease at step 908.

In another preferred embodiment, the apparatus 100 and method of the present invention can be utilized to provide notification to an individual account holder of a gaming account or a user of a gaming account that the account has been utilized or is being utilized. In a preferred embodiment of the present invention, or more gaming accounts can be assigned to a user or player.

In one preferred embodiment, a user can be assigned a single account on which the user may engage in a gaming and/or gambling activity. In another preferred embodiment, a user can have multiple accounts assigned to him or her, with each account being utilized for a certain type or kind of account (i.e. lottery account, casino gaming account, race track account, or professional sports betting account, etc.).

In another preferred embodiment, the apparatus and method of the present invention can be utilized in order to provide a user or other individual gaming account holder with notification of gaming account use. The notification can be provided as information contained in any one or more of a pager message, a beeper message, a telephone call, a pre-recorded telephone message, and instant message, a facsimile message, and/or any e-mail message, which can be transmitted to a respective user communication device 20, which can be any one or more of the user communication devices 20 described herein.

Figure 10A:
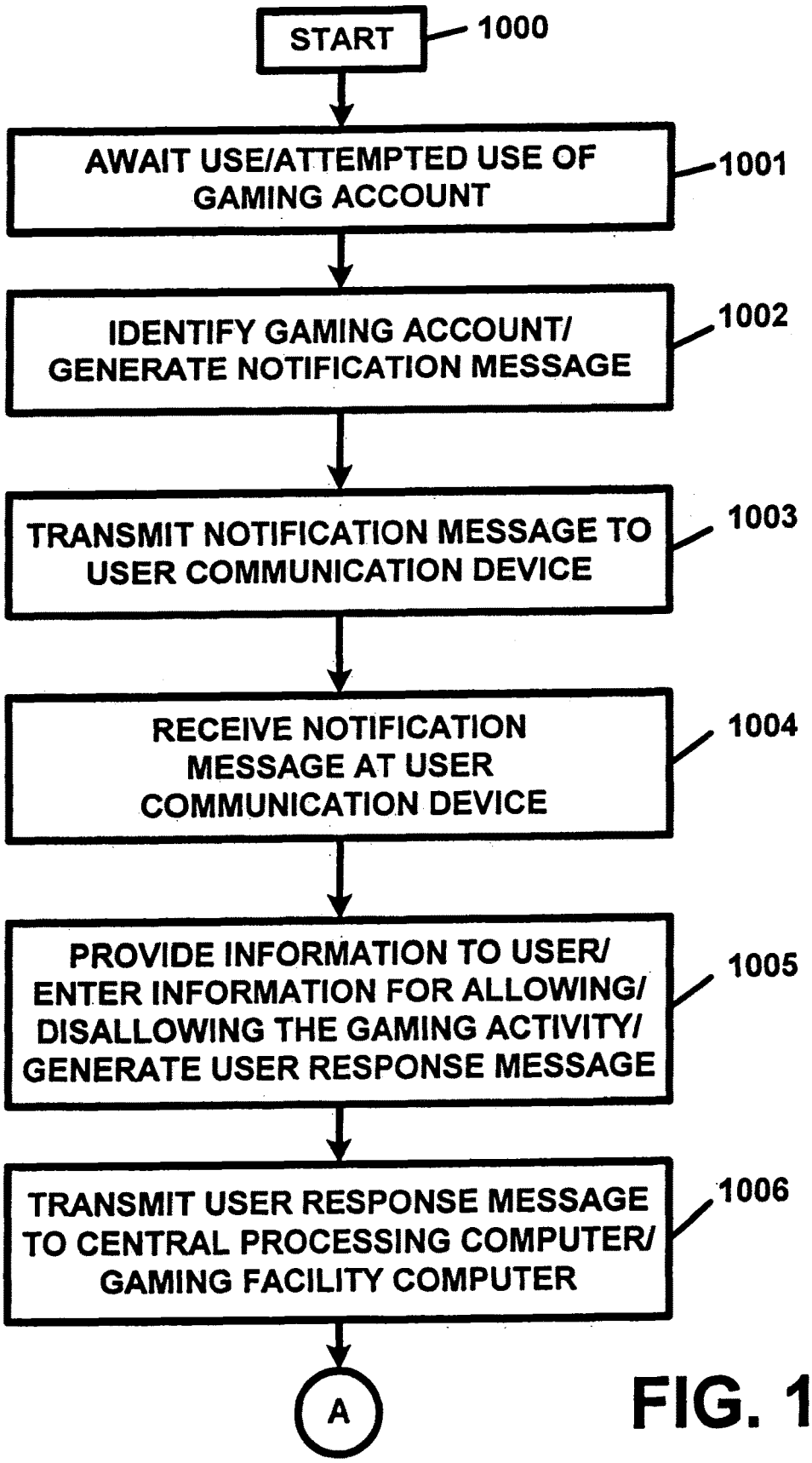
FIGS. 10A and 10B illustrate still another preferred embodiment method for utilizing the apparatus and method of the present invention, in flow diagram form.
Figure 10B:
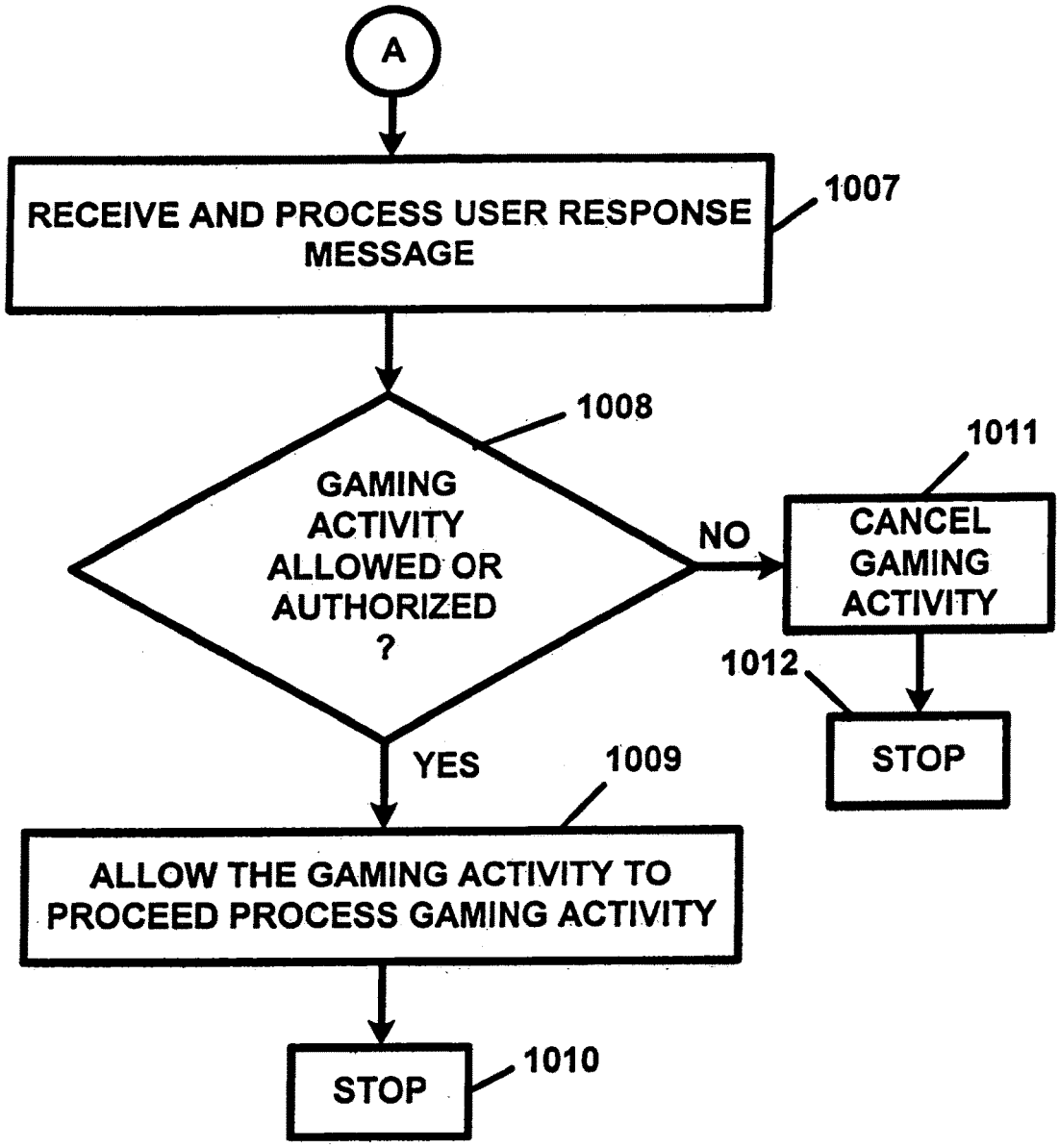

FIGS. 10A and 10B illustrate another preferred embodiment method for utilizing the apparatus 100 and method of the present invention. With reference to FIGS. 10A and 10B, the operation of the apparatus 100 commences at step 1000. At step 1001, the central processing computer 10 and/or the gaming facility computer 30, whichever is being utilized in the particular situation, will await use or attempted use of the gaming account.

Upon detecting a use or attempted use of the gaming account, such as when the gaming account is accessed in order to place a bet and/or engage in other gaming activity, the central processing computer 10 and/or the gaming facility computer 30 can, at step 1002, identify the gaming account being utilized and generate a notification message containing information regarding the use of the gaming account. At step 1003, the respective central processing computer 10 and/or the gaming facility computer 30 can transmit the notification message to the user communication device 20 associated with the gaming account and/or to the user communication device 20 associated with the user or individual gaming account holder.

In the preferred embodiment, the notification message can be transmitted to the user communication device 20 in real-time. In another preferred embodiment, the notification message can be transmitted to the user communication device 20 in a non-real-time manner (i.e. e-mail transmission to network computer (not shown) for later transmission to the user).

At step 1004, the user communication device 20 can receive the notification message. At step 1005, the information contained in the notification message can be provided to the user. The information provided can include the time of the gaming activity, the type of gaming activity involved, the place of the gaming activity or the place of the gaming facility providing the gaming activity, the gaming facility involved, the game or game of chance involved, the amount of the bet, information regarding the individual making the bet, and/or any other information which may be desired in providing the herein-described notification.

At step 1005, the user can enter information for allowing and/or authorizing the gaming activity or for disallowing the gaming activity. At step 1005, the user communication device 20 can generate a user response message containing the information provided by the user. At step 1006, the user communication device 20 can transmit the user response message to the respective central processing computer 10 and/or gaming facility computer 30. At step 1007, the respective central processing computer 10 and/or gaming facility computer 30 can receive the user response message and process the information contained therein.

At step 1008, the respective central processing computer 10 and/or gaming facility computer 30 can determine if the gaming activity is allowed or authorized. If, at step 1008, the respective central processing computer 10 and/or gaming facility computer 30 determines that the gaming activity is allowed or authorized, the operation of the apparatus 100 will proceed to step 1009 and the respective central processing computer 10 and/or gaming facility computer 30 will allow the gaming activity to proceed and, therefore, continue to process the gaming activity on the gaming account. Thereafter, the operation of the apparatus 100 will cease at step 1010.

If, at step 1008, the respective central processing computer 10 and/or gaming facility computer 30 determines that the gaming activity is disallowed, the operation of the apparatus 100 will proceed to step 1011 and the respective central processing computer 10 and/or gaming facility computer 30 will cancel the gaming activity. Thereafter, the operation of the apparatus 100 will cease at step 1012.

In another preferred embodiment, the apparatus of FIGS. 10A and 10B, and/or the respective central processing computer 10 and/or gaming facility computer 30, can be programmed to cancel and/or to de-activate the gaming account if a pre-determined number of disallowed gaming activities are determined to have occurred on the account.

In another preferred embodiment, the apparatus 100 of the present invention can be utilized to provide notification to a user or individual gaming account holder regarding a withdrawal made from a gaming account and/or a deposit made to the gaming account. In this manner, the apparatus 100 can provide notification regarding a withdrawal from a gaming account and/or a deposit made into a gaming account.

Figure 11A:
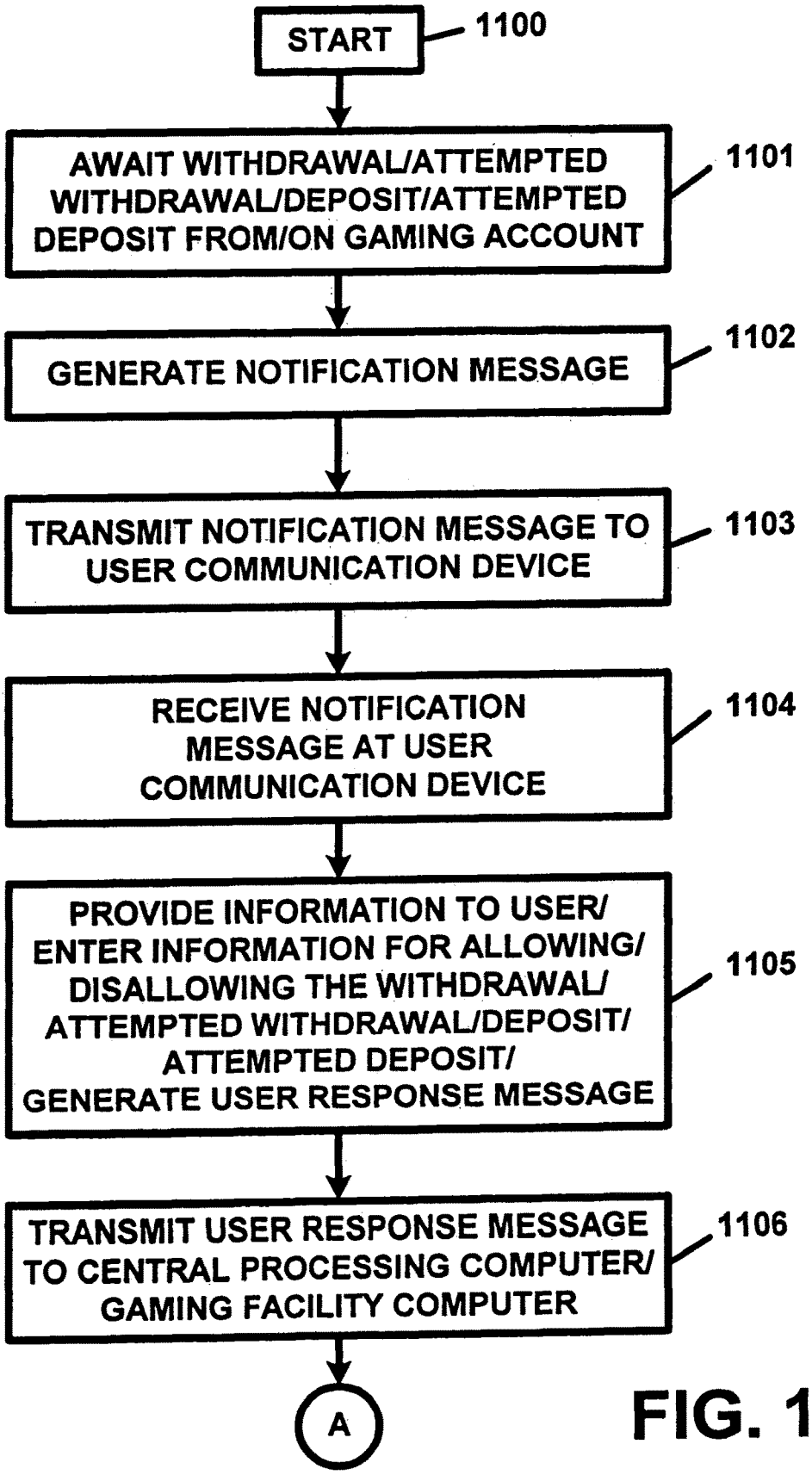
FIGS. 11A and 11B illustrate yet another preferred embodiment method for utilizing the apparatus and method of the present invention, in flow diagram form.
Figure 11B:
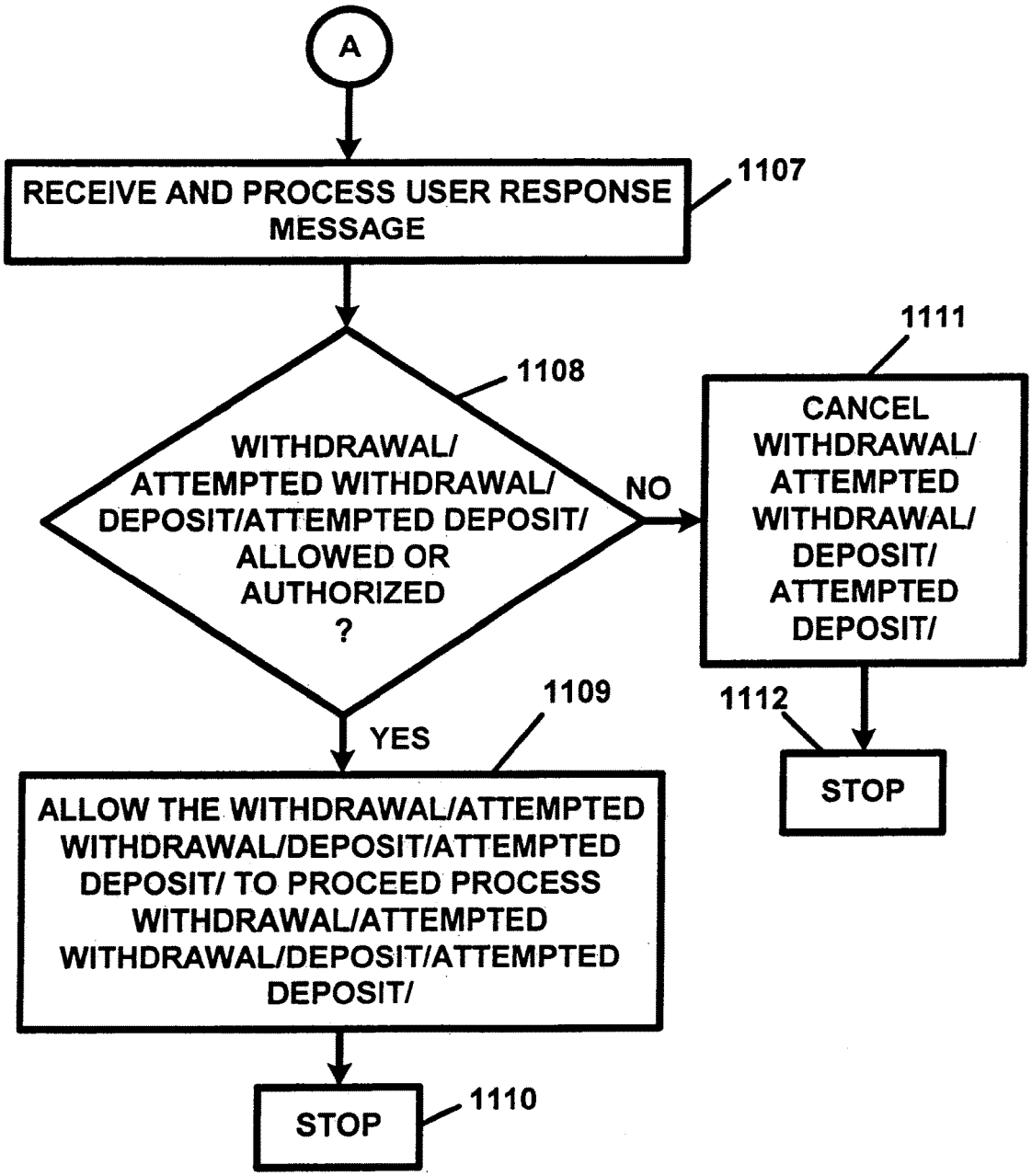

FIGS. 11A and 11B illustrate another preferred embodiment method for utilizing the apparatus 100 and method of the present invention. With reference to FIGS. 11A and 11B, the operation of the apparatus 100 commences at step 1100. At step 1101, the central processing computer 10 and/or the gaming facility computer 30, whichever is being utilized in the particular situation, will await the occurrence of a withdrawal or an attempted withdrawal from a gaming account and/or a deposit or an attempted deposit on the gaming account.

Upon detecting a withdrawal or an attempted withdrawal from a gaming account, such as when a bet is being made on the gaming account, or a deposit or an attempted deposit into the gaming account, such as when a payment is being made into a gaming account, the central processing computer 10 and/or the gaming facility computer 30 can, at step 1102, can generate a notification message containing information regarding the respective withdrawal, attempted withdrawal, deposit, and/or attempted deposit, regarding the gaming account.

At step 1103, the respective central processing computer 10 and/or the gaming facility computer 30 can transmit the notification message to the user communication device 20 associated with the gaming account and/or to the user communication device 20 associated with the user or individual gaming account holder. In the preferred embodiment, the notification message can be transmitted to the user communication device 20 in real-time. In another preferred embodiment, the notification message can be transmitted to the user communication device 20 in a non-real-time manner (i.e. e-mail transmission to network computer (not shown) for later transmission to the user).

At step 1104, the user communication device 20 can receive the notification message. At step 1105, the information contained in the notification message can be provided to the user. The information provided can include the time of the withdrawal or withdrawal attempt, the time of the deposit or deposit attempt, the type of gaming activity corresponding to the withdrawal, attempted withdrawal, deposit, or attempted deposit, the place of the gaming activity or the place of the gaming facility providing the gaming activity corresponding with the withdrawal, attempted withdrawal, deposit, or attempted deposit, the gaming facility involved, the game or game of chance involved, the amount of the bet involved, information regarding the individual making the withdrawal, attempted withdrawal, deposit, or attempted deposit, and/or any other information which may be desired in providing the herein-described notification.

At step 1105, the user can enter information for allowing and/or authorizing the withdrawal, attempted withdrawal, deposit, or attempted deposit. At step 1105, the user communication device 20 can generate a user response message containing the information provided by the user. At step 1106, the user communication device 20 can transmit the user response message to the respective central processing computer 10 and/or gaming facility computer 30. At step 1107, the respective central processing computer 10 and/or gaming facility computer 30 can receive the user response message and process the information contained therein.

At step 1108, the respective central processing computer 10 and/or gaming facility computer 30 can determine if the withdrawal, attempted withdrawal, deposit, or attempted deposit, is allowed or authorized.

If, at step 1108, the respective central processing computer 10 and/or gaming facility computer 30 determines that the withdrawal, attempted withdrawal, deposit, or attempted deposit, is allowed or authorized, the operation of the apparatus 100 will proceed to step 1109 and the respective central processing computer 10 and/or gaming facility computer 30 will allow the gaming activity to proceed and, therefore, continue to process the withdrawal, attempted withdrawal, deposit, or attempted deposit, on the gaming account. Thereafter, the operation of the apparatus 100 will cease at step 1110.

If, at step 1108, the respective central processing computer 10 and/or gaming facility computer 30 determines that the withdrawal, attempted withdrawal, deposit, or attempted deposit, is disallowed, the operation of the apparatus 100 will proceed to step 1111 and the respective central processing computer 10 and/or gaming facility computer 30 will cancel the withdrawal, attempted withdrawal, deposit, or attempted deposit. Thereafter, the operation of the apparatus 100 will cease at step 1112.

In another preferred embodiment, the apparatus of FIGS. 11A and 11B, and/or the respective central processing computer 10 and/or gaming facility computer 30, can be programmed to cancel and/or to de-activate the gaming account if a pre-determined number of disallowed withdrawals, attempted withdrawals, deposits, or attempted deposits, are determined to have occurred on the account.

In another preferred embodiment, the apparatus 100 and method of the present invention can be utilized in order to facilitate gaming activity and/or gambling activity from a remote location. The apparatus and method of the present invention can also be utilized in order to facilitate gaming activity and/or gambling activity at a gaming venue remote from the user's or individual's physical location. The apparatus and method of the present invention can also be utilized in order to facilitate a user or individual participating in live gaming activity and/or gambling activity via a user communication device.

For example, and for purposes of an illustrative example, a user desiring to bet at a casino gaming table can access a camera or video device located at the table, obtain, at the communication device, audio and video information at the table, including being able to interact with dealers or betting house officials and/or other betters at the table, place bets, and engage in gaming activity and/or gambling activity at the table live and/or in real-time via the user communication device and any one or more of video equipment, audio equipment, and/or video conferencing equipment. In this manner, the apparatus and method of the present invention can be utilized in order to allow a user or individual to engage in gaming activity, and/or place bets, at one or at a plurality of gaming establishments remotely via a user communication device.

For example, an individual can gain remote access to, and bet at, a table at a Las Vegas, Nev. casino and, at any time, access, and bet at, a table in an Atlantic City, N.J. casino, access and place bets at Yonkers Raceway, and/or engage in remote gaming activities and/or gambling activities via a user communication device and/or the apparatus of the present invention.

The apparatus and method of the present invention can also be utilized in order to allow a remote player(s) to place virtual betting pieces, chips, and/or currency, at a respective gaming table, gaming machine, or slot machine, etc. In this embodiment, a display screen can be located at or adjacent to a respective gaming table, gaming machine, or slot machine, etc. A remote player(s) can also utilize a display screen and one or more user input devices or user interactive devices in order to view a betting inventory of virtual betting pieces, chips, and/or currency which the player can virtually "move" to the respective gaming table, gaming machine, or slot machine, etc., in order to place a bet at the respective gaming table, gaming machine, or slot machine, etc.

The user's display screen, which can be a component of, or associated with, the user's user communication device or computer, can display the user's inventory of virtual betting pieces, chips, and/or currency, show the movement of the user's virtual betting pieces, chips, and/or currency, to the respective gaming table, gaming machine, or slot machine, etc., and show any virtual betting pieces, chips, and/or currency, of the house or of any other remote players.

The player can utilize an input device or an interactive device in order to "drag" virtual betting pieces, chips, and/or currency, from the user's inventory to the respective gaming table, gaming machine, or slot machine, etc. A user's winnings can also be transferred to the user's inventory of virtual betting pieces, chips, and/or currency. The apparatus and method of the present invention can also be utilized so as to allow a player or players to engage in gaming activity and/or gambling activity at remotely accessed gaming venues, tables, or machines, etc.

Figure 12:
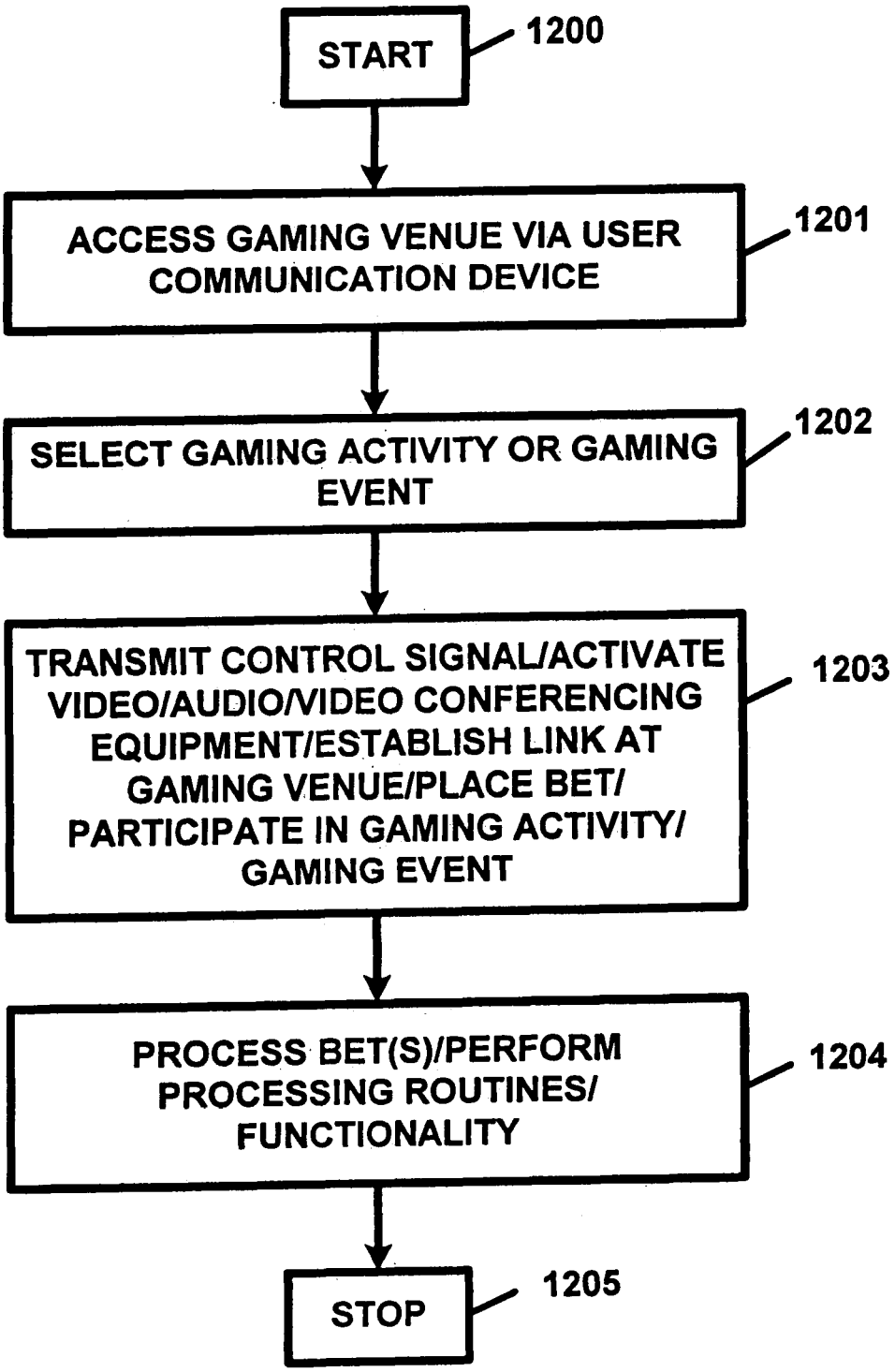
FIG. 12 illustrates another preferred embodiment method for utilizing the apparatus and method of the present invention, in flow diagram form.

FIG. 12 illustrates another preferred embodiment method for utilizing the apparatus and method of the present invention. With reference to FIG. 12, the operation of the apparatus 100 commences at step 1200. At step 1201, the user can access a gaming venue via the user communication device 20. In a preferred embodiment, the user can access the gaming venue via the central processing computer 10 and/or via the gaming facility computer 30. For example, a user desiring to play a table game (i.e. poker, Black jack, or roulette wheel, etc.) at a casino in Las Vegas, Nev. can access a gaming facility computer 30 associated with, and/or linked with, the respective gaming table or gaming venue or a separate gaming facility computer 30 associated with the particular gaming table or gaming venue.

In another example, a user desiring to bet on a sporting event can access the gaming facility computer 30 servicing the respective sporting event. At step 1202, the user can select the gaming activity or gaming event he or she desired to bet on. At step 1203, the user can transmit a control signal for allowing the user to activate any one or more of a video recording equipment 70, audio recording equipment 80, and/or video conferencing equipment 90, at the gaming table or gaming venue and/or otherwise establish a live video link, a live audio link, and/or a live video conferencing link, between himself or herself and the house and other players at the gaming table or gaming venue. In this manner, a user can access the gaming table and/or gaming venue and interact with the parties thereat in order to remotely engage in gaming activity at the gaming table and/or gaming venue.

For example, a user remote from the gaming table or gaming venue can establish an electronic or virtual presence at the gaming table or gaming venue in order to engage in gaming activity at the gaming table and/or gaming venue.

At step 1203, the user can bet and/or otherwise participate and/or view the gaming activity at the gaming table or gaming venue. For example, the user can place a bet and view the game being played via the user communication device 20. In another preferred embodiment, the user can place bets using virtual chips which chips can be displayed to others at the gaming table or gaming venue via a gaming facility computer 30 located at the gaming table or gaming venue.

In another preferred embodiment, the apparatus 100 and method of the present invention can also be utilized in order to allow a remote player(s) to place virtual betting pieces, chips, and/or currency, at a respective gaming table, gaming machine, or slot machine, etc. In this embodiment, a display screen associated with the gaming facility computer 30 can be located at or adjacent to a respective gaming table, gaming machine, or slot machine, etc. A user or other remote player(s) can also utilize the display screen and one or more user input devices or user interactive devices of the user communication device 20 in order to view a betting inventory of virtual betting pieces, chips, and/or currency which the player can virtually "move" to the respective gaming table, gaming machine, or slot machine, etc., in order to place a bet at the respective gaming table, gaming machine, or slot machine, etc.

The user's display screen, which, in the preferred embodiment can be a component of, or can be associated with, the user's user communication device 20, can display the user's inventory of virtual betting pieces, chips, and/or currency, show the movement of the user's virtual betting pieces, chips, and/or currency, to the respective gaming table, gaming machine, or into the slot machine, etc., and show any virtual betting pieces, chips, and/or currency, of the house or of any other remote players.

The user can utilize an input device or an interactive device of the user communication device 20 in order to "drag" virtual betting pieces, chips, and/or currency, from the user's inventory to the respective gaming table, gaming machine, or slot machine, etc. A user's winnings can also be transferred to the user's inventory of virtual betting pieces, chips, and/or currency. In this manner, the apparatus 100 and method of the present invention can be utilized in order to allow a user to engage in gaming activity and/or gambling activity at remotely accessed gaming venues, tables, or machines, etc.

The house dealer or employee supervising or conducting the gaming activity can interact with the user via the gaming facility computer 30, the video equipment 70, the audio equipment, and/or the video conferencing equipment 90, all of which can be located at or in the vicinity of the gaming table and/or the gaming venue.

In a preferred embodiment the respective video equipment 70, the audio equipment, and/or the video conferencing equipment 90, can include multiple units or components of each which can, for example, be located above the table, at various locations on or around the table in order to allow the user to view obtain as complete a viewing as possible of the gaming table and as many players as possible. The respective video equipment 70, the audio equipment, and/or the video conferencing equipment 90, in the preferred embodiment, can be located so as to allow the user to interact with the house dealer or gaming supervisor at the gaming table or gaming venue and any other players situated about the gaming table or gaming venue. For example, a user can be able to view the game table from any angle, communicate in real-time with others at the gaming table or gaming venue and, in effect, place bets and/or observe the gaming activity as if he or she were physically at the gaming table or gaming venue.

In a preferred embodiment, the user can obtain split screen and/or multiple screen views from any one or more of the multiple cameras at the gaming table or gaming venue, if desired. In a preferred embodiment, at step 1204, the gaming facility computer 30 can process the user's bet or bets in any appropriate manner and/or can perform any and/or all of the processing routines and/or functionality as described herein in steps 807-811 which are described herein in conjunction with the embodiment of FIGS. 8A and 8B. Thereafter, upon the user ceasing play at the gaming table or gaming venue, the operation of the apparatus 100 will cease at step 1205.

In the above-described manner, the apparatus 100 and method of the present invention can be utilized in order to allow a user to engage in gaming activity and/or observe and/or participate in gaming activity and/or a gaming event from a remote location.

In another preferred embodiment, the apparatus 100 and method of the present invention can be utilized in order to allow a user to limit and/or restrict use of his or her gaming account or gaming accounts. The user and/or individual gaming account holder can pre-limit and/or pre-restrict gaming account activity and/or gaming account use by accessing the central processing computer 10 and/or a gaming facility computer 30 and transmitting information regarding the limitation(s) and/or restriction(s) to the respective central processing computer 10 and/or a gaming facility computer 30.

The respective central processing computer 10 and/or a gaming facility computer 30 can automatically receive and automatically store the limitation(s) and/or restriction(s) in its respective database. Thereafter, the respective central processing computer 10 and/or a gaming facility computer 30 can process gaming activity on the gaming account in conjunction with the limitation(s) and/or restriction(s) and can determine whether the gaming activity is allowed and disallowed.

In a preferred embodiment, the limitation(s) or restriction(s) can be positive limitation(s) or restriction(s), defined herein to mean a limitation or restriction which if met allows the gaming activity on the gaming account (i.e. gaming activity only for a certain game, a time period during which gaming activity can occur, or a gaming facility where gaming activities are allowed, etc.) and/or the limitation(s) and/or restriction(s) can be negative limitation(s) or restriction(s), meaning a limitation(s) or restriction(s) which if met disallows the gaming activity (i.e. a time period during which gaming activity is disallowed, a gaming activity which is not allowed, or a gaming facility at which a user is not allowed to engage in gaming activities, etc.).

In the preferred embodiment, the limitation(s) and/or restriction(s) can, for example, include a name of a user of a gaming account, a name of an authorized user of a gaming account, a name of a user or names of users allowed to use a gaming account, gaming activities which are allowed on a gaming account, gaming activities which are not allowed on a gaming account, betting limits on a gaming account, account spending limits on a gaming account, daily betting amount limits on a gaming account, weekly betting amount limits on a gaming account, monthly betting amount limits on a gaming account, yearly betting amount limits on a gaming account, allowed gaming venues, disallowed gaming venues, allowed betting time period(s), disallowed betting time period(s), allowed games which can be bet on, disallowed games which can be bet on, allowed team(s) and/or player(s) which can be bet on, allowed betting amount, disallowed betting amounts, allowed betting venues, locations or places, disallowed betting venues, locations, or places, stop loss limits, allowed betting subject matter, or disallowed betting subject matter, etc., and/or any other limitation or restriction described herein and/or which could otherwise be envisioned for any of the gaming or gambling activities with which the apparatus and method of the present invention can be utilized.

Figure 13:
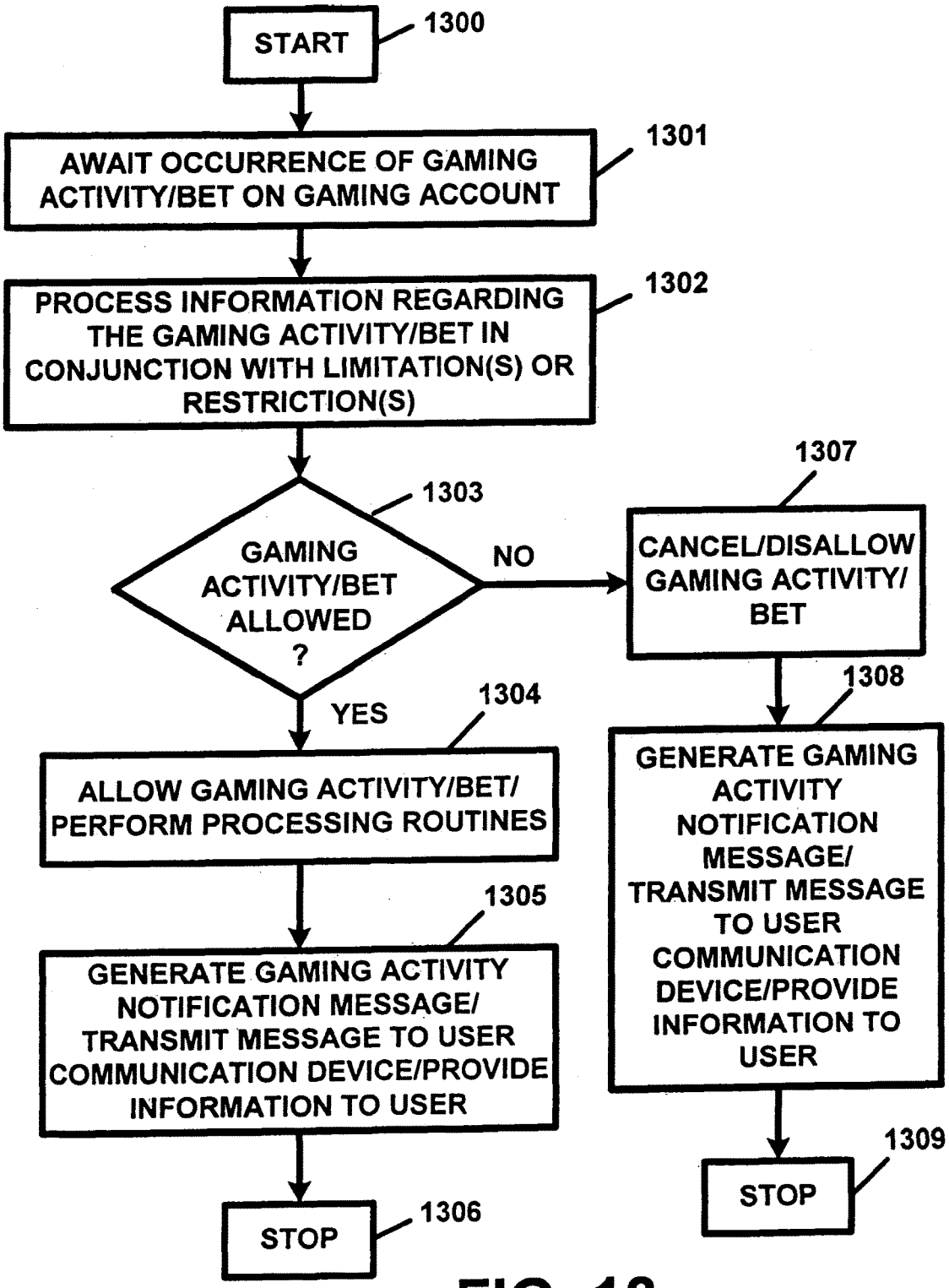
FIG. 13 illustrates still another preferred embodiment method for utilizing the apparatus and method of the present invention, in flow diagram form.

FIG. 13 illustrates another preferred embodiment method for utilizing the apparatus 100 and method of the present invention. With reference to FIG. 13, the operation of the apparatus 100 commences at step 1300. At step 1301, the respective central processing computer 10 and/or the gaming facility computer 30 can await an occurrence of gaming activity and/or a bet being made on and/or in conjunction with the gaming account.

Upon detecting the occurrence of gaming activity and/or a bet on a gaming account, the operation of the respective central processing computer 10 and/or gaming facility computer 30 can proceed to step 1302 and process the information regarding the gaming activity and/or bet in conjunction with the limitation(s) and/or restriction(s) information previously provided by the user and/or which may have been previously dictated by the gaming account and/or gaming facility and/or a gaming administrator. At step 1302, the respective central processing computer 10 and/or gaming facility computer 30 can perform processing routines in order to determine whether the gaming activity and/or bet is allowed or disallowed.

At step 1303, the respective central processing computer 10 and/or gaming facility computer 30 can determine if the gaming activity and/or bet is allowed. If, at step 1303, it is determined that the gaming activity and/or bet is allowed, then the operation of the respective central processing computer 10 and/or gaming facility computer 30 will proceed to step 1304 and the respective central processing computer 10 and/or gaming facility computer 30 will allow the gaming activity and/or bet, process the gaming activity and/or bet, and perform any and/or all of the processing routines described herein as being capable of being performed by the respective central processing computer 10 and/or gaming facility computer 30 at step 807 through 811, described in connection with the embodiment of FIGS. 8A and 8B.

Thereafter, at step 1305, the respective central processing computer 10 and/or gaming facility computer 30 can generate a gaming activity notification message, which can contain information regarding the allowed gaming activity and/or bet, and transmit same to the user communication device 20. At step 1305, the gaming activity notification message can also be transmitted from the respective central processing computer 10 and/or gaming facility computer 30 to the user communication device 20 as any one or more of an electronic transmission, a communication transmission, a beeper message, a pager message, an instant message, an electronic mail message, a telephone message, a telephone call, a facsimile transmission, and/or any other communication transmission.

The user communication device 20 can receive the gaming activity notification massage and provide any of the information contained therein to the user. Thereafter, the operation of the apparatus will cease at step 1306.

If, at step 1304, it is determined that the gaming activity and/or bet is not allowed, then the operation of the respective central processing computer 10 and/or gaming facility computer 30 will proceed to step 1307 and the respective central processing computer 10 and/or gaming facility computer 30 will cancel and/or disallow the gaming activity and/or bet. Thereafter, at step 1308, the respective central processing computer 10 and/or gaming facility computer 30 can generate a gaming activity notification message, which can contain information regarding the disallowed gaming activity and/or bet, and transmit same to the user communication device 20.

At step 1308, the gaming activity notification message can also be transmitted from the respective central processing computer 10 and/or gaming facility computer 30 to the user communication device 20 as any one or more of an electronic transmission, a communication transmission, a beeper message, a pager message, an instant message, an electronic mail message, a telephone message, a telephone call, a facsimile transmission, and/or any other communication transmission. The user communication device 20 can receive the gaming activity notification massage and provide any of the information contained therein to the user. Thereafter, the operation of the apparatus will cease at step 1309.

In the above-described manner, the apparatus 100 of the present invention can be utilized to control and/or monitor use of a gaming account.

In another preferred embodiment, the apparatus 100 and method of the present invention can also perform financial account administration for a user. In a preferred embodiment, the apparatus 100 can provide a system for allowing a user to establish gaming accounts and engage in gaming activities via the gaming accounts. The user can establish financial gaming accounts or gaming fund accounts from which to withdraw funds for gaming activities and/or bets. A user's winnings can also be deposited into these accounts.

The apparatus 100 and method of the present invention can be utilized to administer, provide account and/or record keeping for, withhold and/or pay income taxes on winnings, reconcile winnings and losses for a user, withdraw and pay gaming fees and/or dues and/or other charges incurred in connection with utilizing the gaming account(s) described herein and/or the apparatus 100 and method of the present invention (i.e. gaming fees, gaming activity fees, account dues, or account servicing fees, etc.). The apparatus 100 can also provide gaming account statements, gaming account activity statements, or reports to third parties, etc. regarding any gaming account(s).

The apparatus 100 and method of the present invention, and/or any of the user communication devices 20, central processing computers 10, server computers, and/or any computer or computer system associated with any of the entities described herein as being able to utilize or participate in the use or operation of the apparatus 100 and method of the present invention, can be programmed and/or be can be capable of maintaining a financial gaming account or accounts for any of the users or players described herein, perform credit and/or debit operations regarding financial gaming accounts, perform account record-keeping, perform tax withholding with regards to the financial gaming accounts, report taxable events to the appropriate taxing authorities, maintain periodic records of winnings and losses for the financial gaming accounts, provide periodic transaction summaries and/or gaming account statements for the financial gaming accounts, including the transactions or activities engaged in and any winnings or losses resulting therefrom.

The apparatus 100 and method of the present invention, or any of the computers, computer systems, and/or servers, can be programmed to automatically pay withholding taxes on gaming winnings for a user or player, and can automatically perform any of the herein-described functions.

In a preferred embodiment, a user can select the gaming account services he or she desired to be provided with by the apparatus 100 of the present invention. In a preferred embodiment, the user can access the respective central processing computer 10 and/or gaming facility computer 30 via the user communication device 20 and transmit information regarding the service and/or services the user desires to have performed. For example, the user can request that the respective central processing computer 10 and/or gaming facility computer 30 perform account administration for the account, reconcile winnings versus losses on the gaming account for any time period, withhold income taxes, electronically pay or transfer income tax payments and/or estimated payments to a computer system associated with a governmental taxing authority and/or to a governmental entity computer 60.

The respective central processing computer 10 and/or gaming facility computer 30 can receive, process and store, the information regarding the user's servicing request(s). Thereafter, the respective central processing computer 10 and/or gaming facility computer 30 can perform the desired functions and/or services for the gaming account to gaming accounts regularly, periodically and/or any time period prescribed by any applicable law or laws and/or as prescribed user.

Figure 14:
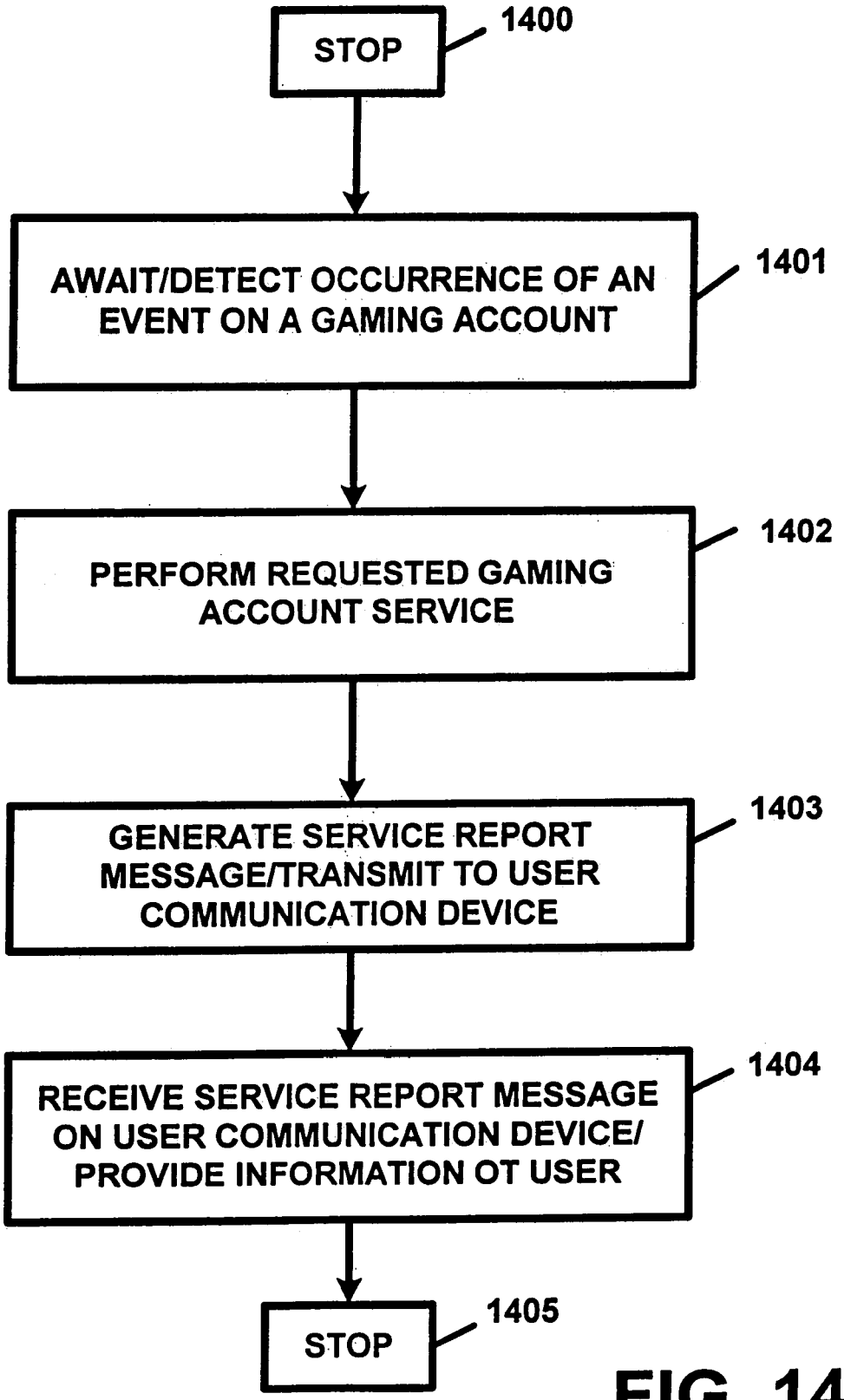
FIG. 14 illustrates yet another preferred embodiment method for utilizing the apparatus and method of the present invention, in flow diagram form.

FIG. 14 illustrates another preferred embodiment method for utilizing the apparatus 100 and method of the present invention, in flow diagram form. With reference to FIG. 14, the operation of the apparatus 100 and method the present invention commences at step 1400. At step 1401, the respective central processing computer 10 and/or gaming facility computer 30 will await and/or detect the occurrences of an event on a gaming account. The event can be any one or more of a withdrawal from a gaming account to place a bet, a deposit of winnings into an account, a payment of taxes to a taxing authority, a payment of gaming fees, gaming activity fees, gaming account dues and/or any other payment requiring a withdrawal from the account, a notification that a payment of taxes, gaming fees, gaming activity fees, gaming account dues, is due, and/or the elapsing of a prescribed time period for reporting gaming account activity, reconciling winnings and/or losses, and/or paying taxes.

Upon the occurrence of the event and/or the elapsing of a predetermined time interval, the operation of the respective central processing computer 10 and/or gaming facility computer 30 will proceed to step 1402 and the respective central processing computer 10 and/or gaming facility computer 30 will perform the requested gaming account service. At the step 1402, the respective central processing computer 10 and/or gaming facility computer 30 can perform any one or more of perform credit and/or debit operations regarding the gaming account(s), perform account record-keeping, perform tax withholding with regards to the gaming account(s), report taxable events to the appropriate taxing authority or authorities, maintain periodic records of winnings and losses for the gaming account(s), provide periodic transaction summaries and/or gaming account statements for the gaming account(s), automatically pay withholding taxes on gaming winnings for a user or player, perform account administration for the gaming account, reconcile winnings versus losses on the gaming account for any time period, withhold income taxes, electronically pay or transfer income tax payments and/or estimated payments to a computer system associated with a governmental taxing authority and/or to a governmental entity computer 60 electronically pay gaming fees, gaming activity fees, gaming account dues and/or any other payment requiring a withdrawal from the gaming account, and/or generate and/or transmit gaming account activity statements to a user communication device 20 and/or to any appropriate authority or gaming authority.

At step 1403, the respective central processing computer 10 and/or gaming facility computer 30 can then generate a service report message containing information regarding the service or services performed by the respective central processing computer 10 and/or gaming facility computer 30 and transmit same to the user communication device 20. At step 1404, the user communication device 20 can receive the service report message and provide the information contained therein to the user. Thereafter, the operation of the apparatus 100 will cease at step 1405.

In another preferred embodiment, the apparatus 100 and method of the present invention can be utilized in order to provide information for and/or to promote or advertise gaming activities, gaming events, gambling activities, and/or gambling events (hereinafter referred to as "gaming activities and/or gaming events"). Information regarding gaming activities and/or gaming events can be stored at a respective central processing computer 10 and/or gaming facility computer 30.

Information regarding a gaming activity and/or gaming event (i.e. a game(s) at a casino or betting hall, a horse race, or a sporting event, etc.) can be entered by an individual or enterprise who or which may access the central processing computer 10 and/or gaming facility computer 30 and transmit the pertinent information and/or enter the pertinent information regarding the gaming activity and/or gaming event into the respective central processing computer 10 and/or gaming facility computer 30 so as to thereby "post" the information at the respective central processing computer 10 and/or gaming facility computer 30.

In another preferred embodiment, the information which can be posted regarding the gaming activity and/or gaming event can also include information regarding changed odds of winning, a changed score spread, an increased lottery prize or jackpot, a changed and/or updated historical and/or statistical information, and/or new and/or updated information regarding the gaming activity and/or gaming event, new and/or updated information and/or statistics regarding any of the gaming activities, gaming events, gambling activities, and/or gambling events, and/or any of the teams, players, athletes, participants, animals (i.e. horses in horse racing, etc.), which may be involved in or be the subject of any of the gaming activities, gaming events, gambling activities, and/or gambling events.

New and/or updated information can also include, but not be limited to, a casino's win percentage for a slot machine or for a table game, the average winnings of the house, users' or players' winning percentages, users' or players' losing percentages, average losses by users or players, a professional boxer's won/loss record, a sports team's won/loss record and/or historic record against another team, a respective athlete's batting average, rushing average, or scoring average, etc., and past statistics or performance against a specific opponent, a race horse's racing won/loss record and/or statistics in a given setting, and/or any other information which a user or player may be interested in obtaining in order to make a more informed bet.

For example, although a user who may already be aware of a gaming activity and/or gaming event, but find odds of winning not satisfactory enough to place a bet on the gaming activity and/or gaming event, may find the gaming activity and/or gaming event of more interest if the odds of winning change and/or become more favorable. In this manner, the apparatus 100 and method of the present invention can alert the user of, and/or provide the user with, any new or updated information regarding a gaming activity and/or gaming event.

The information regarding the gaming activity and/or gaming event can then be stored in a respective database of a respective central processing computer 10 and/or gaming facility computer 30. The stored information can then be retrieved via a user search and/or user searching activity and/or by automatic message generation by the respective central processing computer 10 and/or gaming facility computer 30. For example, a user may access the respective central processing computer 10 and/or gaming facility computer 30 and perform a search for a particular gaming activity and/or gaming event and/or search for newly posted gaming activities or gaming events.

A user can also pre-request to be automatically notified, or receive an alert regarding a posting or postings of new gaming activities and/or gaming events and/or new and/or updated information regarding the gaming activity and/or gaming event.

The apparatus and method of the present invention can be programmed to notify a user or player regarding the posting of information regarding a new gaming activity or event, and/or of new or changed information regarding the gaming activity and/or gaming event. A notification message can be provided in the form of information provided in real-time and/or otherwise, as any one or more of an electronic transmission, a communication transmission, a beeper message, a pager message, an instant message, an electronic mail message, a telephone message, a telephone call, a facsimile transmission, and/or any other communication transmission to any of the user communication devices described herein as being utilized in conjunction with the present invention. The apparatus 100 and method of the present invention can provide wireless alerts to the user or player in order to provide the herein-described notification operations.

In a preferred embodiment, the user, by utilizing the user communication device 20, can program a respective central processing computer 10 and/or gaming facility computer 30 to provide him or her with notification of any new gaming activities or gaming events and/or new and/or updated information regarding gaming activities and/or gaming events about which the user desires to be notified.

In another preferred embodiment, the user, by utilizing the user communication device 20, can access a respective central processing computer 10 and/or gaming facility computer 30 and search for information regarding a gaming activity, gaming activities, a gaming event, gaming events, and/or new and/or updated information regarding same.

Figure 15:
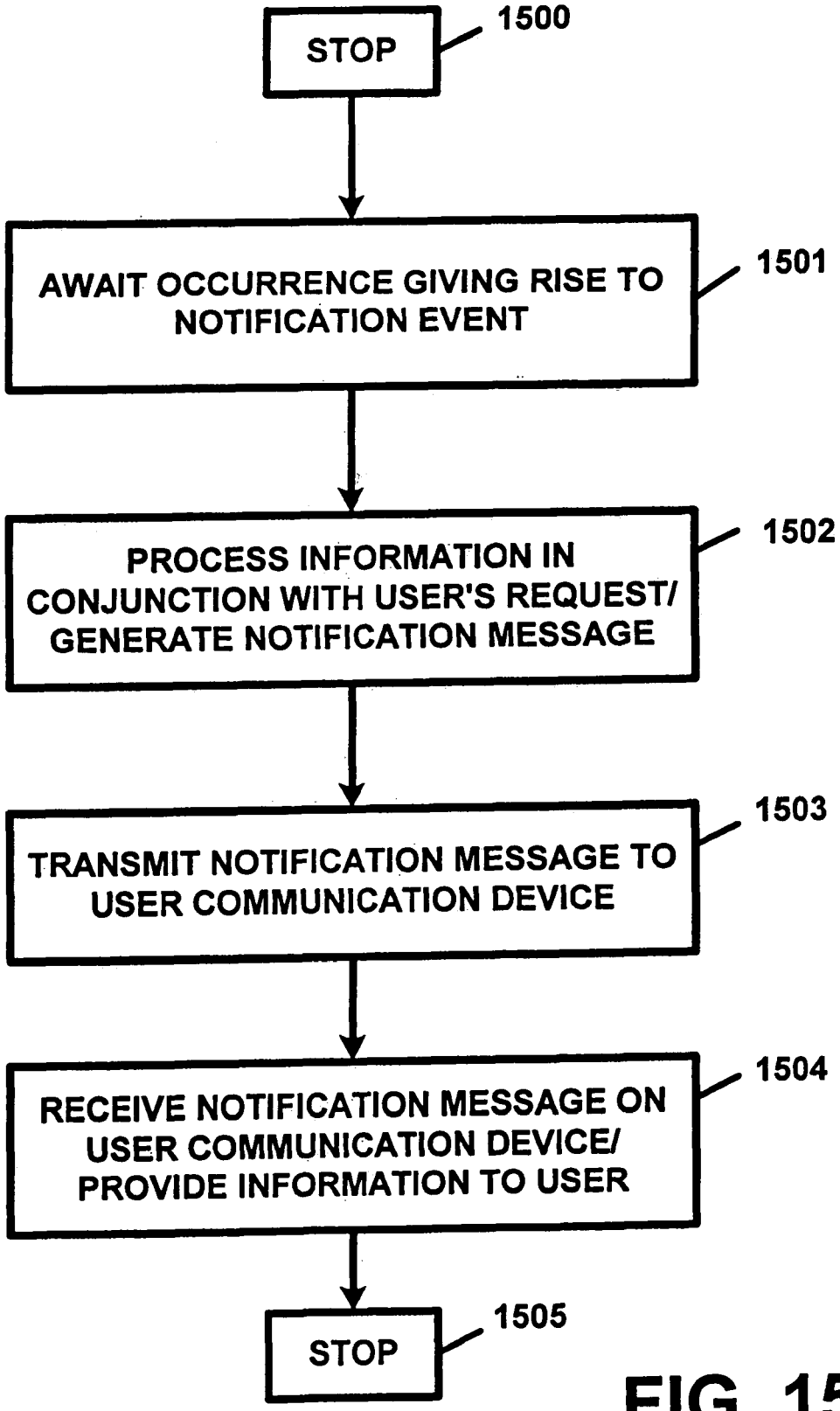
FIG. 15 illustrates another preferred embodiment method for utilizing the apparatus and method of the present invention, in flow diagram form.

FIG. 15 illustrates another preferred embodiment method for utilizing the apparatus 100 and method of the present invention, in flow diagram form. With reference to FIG. 15, the operation of the apparatus 100 and method the present invention commences at step 1500. At step 1501, the respective central processing computer 10 and/or gaming facility computer 30 can await an occurrence giving rise to a notification event.

In a preferred embodiment, the occurrence giving rise to a notification event can be a posting of information regarding a new gaming activity, gaming activities, a gaming event, and/or gaming events, and/or any of the herein-described and/or other new and/or updated information regarding a gaming activity, gaming activities, a gaming event, and/or gaming events. In another preferred embodiment, the occurrence giving rise to a notification event can also be a search request or query by a user for information regarding newly posted information regarding a new gaming activity, gaming activities, a gaming event, and/or gaming events, and/or any of the herein-described and/or other new and/or updated information regarding a gaming activity, gaming activities, a gaming event, and/or gaming events.

Upon the detection by the respective central processing computer 10 and/or gaming facility computer 30, of the occurrence giving rise to the notification event, the operation of the respective central processing computer 10 and/or gaming facility computer 30, will proceed to step 1502 and the respective central processing computer 10 and/or gaming facility computer 30, will process the necessary information in conjunction with any one or more of a user's previously stored request to receive the pertinent information, the respective central processing computer's 10 and/or gaming facility computer's 30 practice and/or agreement to provide such notification of the information, and/or the user's search request.

At step 1502, the respective central processing computer 10 and/or gaming facility computer 30 will generate a notification message containing any information regarding the new gaming activity, gaming activities, a gaming event, and/or gaming events, and/or any of the herein-described and/or other new and/or updated information regarding a gaming activity, gaming activities, a gaming event, and/or gaming events.

At step 1503, the respective central processing computer 10 and/or gaming facility computer 30 will transmit the notification message to the user communication device in real-time and/or in any other appropriate manner. In the preferred embodiment, the notification message can be provided in the form of an electronic transmission, a communication transmission, a beeper message, a pager message, an instant message, an electronic mail message, a telephone message, a telephone call, a facsimile transmission, and/or any other communication transmission to any of the user communication devices 20 described herein as being utilized in conjunction with the present invention.

The apparatus 100 and method of the present invention can provide wireless alerts to the user or player in order to provide the herein-described notification operations. The notification message and/or the wireless alerts containing same can be provided in real-time, via e-mail, via instant messaging and/or otherwise.

At step 1504, the user communication device 20 can receive the notification message and provide the information contained therein to the user. Thereafter, the user can utilize the information and/or disregard same. At step 1504, the user can then decide whether or not he or she wants to act on the information such as by placing a bet regarding the gaming activity and/or gaming event. Thereafter, the operation of the apparatus 100 will cease at step 1505.

In another preferred embodiment, the apparatus 100 and method of the present invention can also be utilized in order to facilitate gaming or gambling on gaming derivatives and/or gambling derivatives. For example, a gaming derivative and/or a gambling derivative can be a bet or a game of chance entered into with a counterparty which can, among other things, include, for example, a bet that a casino or betting house may win a certain amount of money during a pre-specified time period, a bet that a casino or betting house may make a certain level or amount of payoffs to winning users or players during a pre-specified time period, a bet that a casino or betting house may win a certain amount to money from a particular game, games, gaming activity, or gaming activities, etc., during a pre-specified time period, a bet that a casino or betting house may win more bets than it loses during a pre-specified time period and/or in a particular game, games, gaming activity, or gaming activities, etc., a bet that players and/or users, as a whole or group, may win more bets than they lose during a pre-specified time period and/or in a particular game, games, gaming activity, or gaming activities, etc., and/or a bet regarding the percentage of time(s) that spreads are met in outcomes of gaming activities and/or gaming events.

The present invention can be utilized in order to allow or facilitate the making of bets and/or the providing for gaming activities and/or gambling activities involving any of the above-described and/or any other derivative bets which can be made on any and/or all facets of a gaming environment and/or a gambling environment.

Figure 16A:
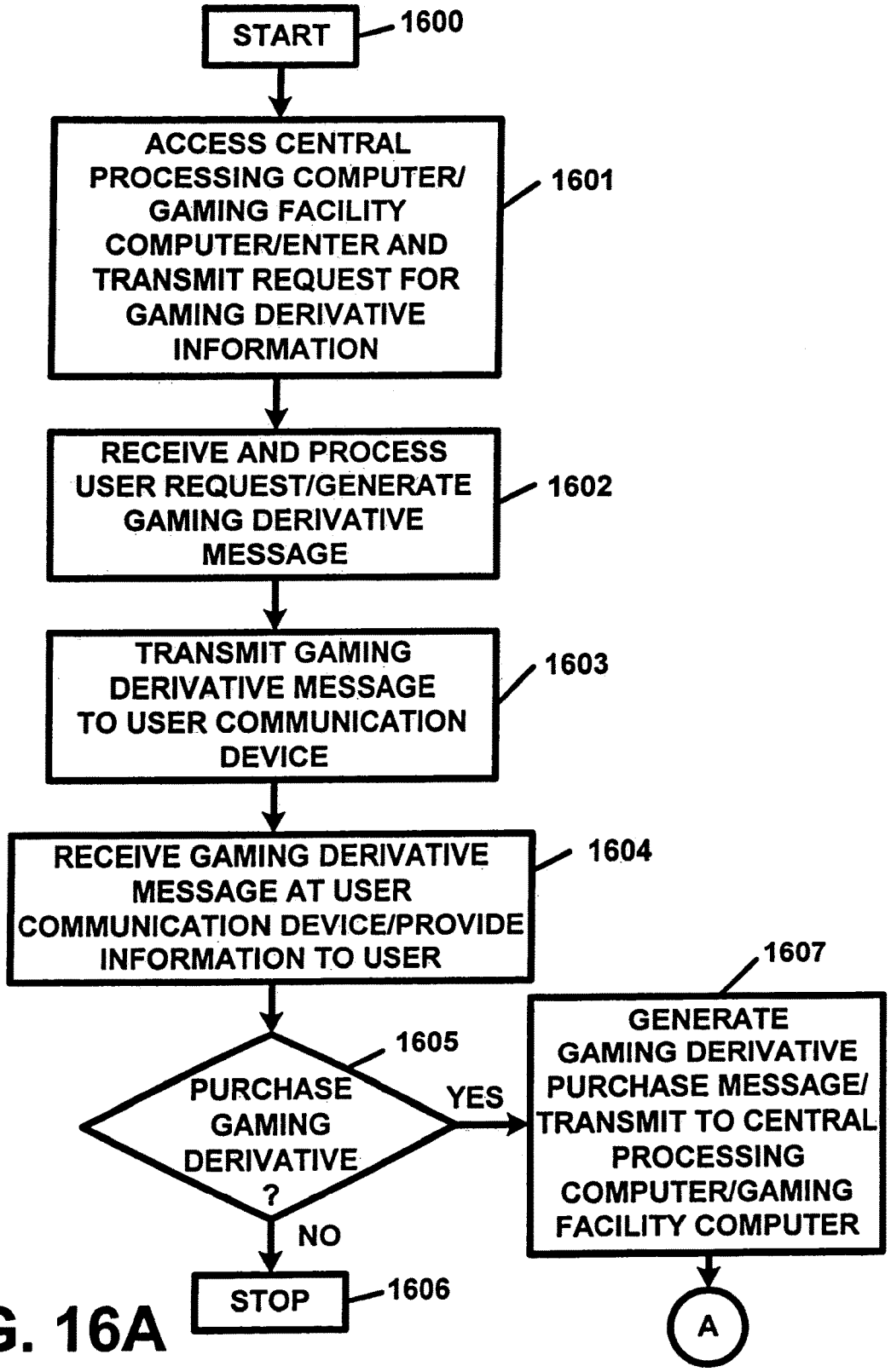
FIGS. 16A and 16B illustrate still another preferred embodiment method for utilizing the apparatus and method of the present invention, in flow diagram form.
Figure 16B:
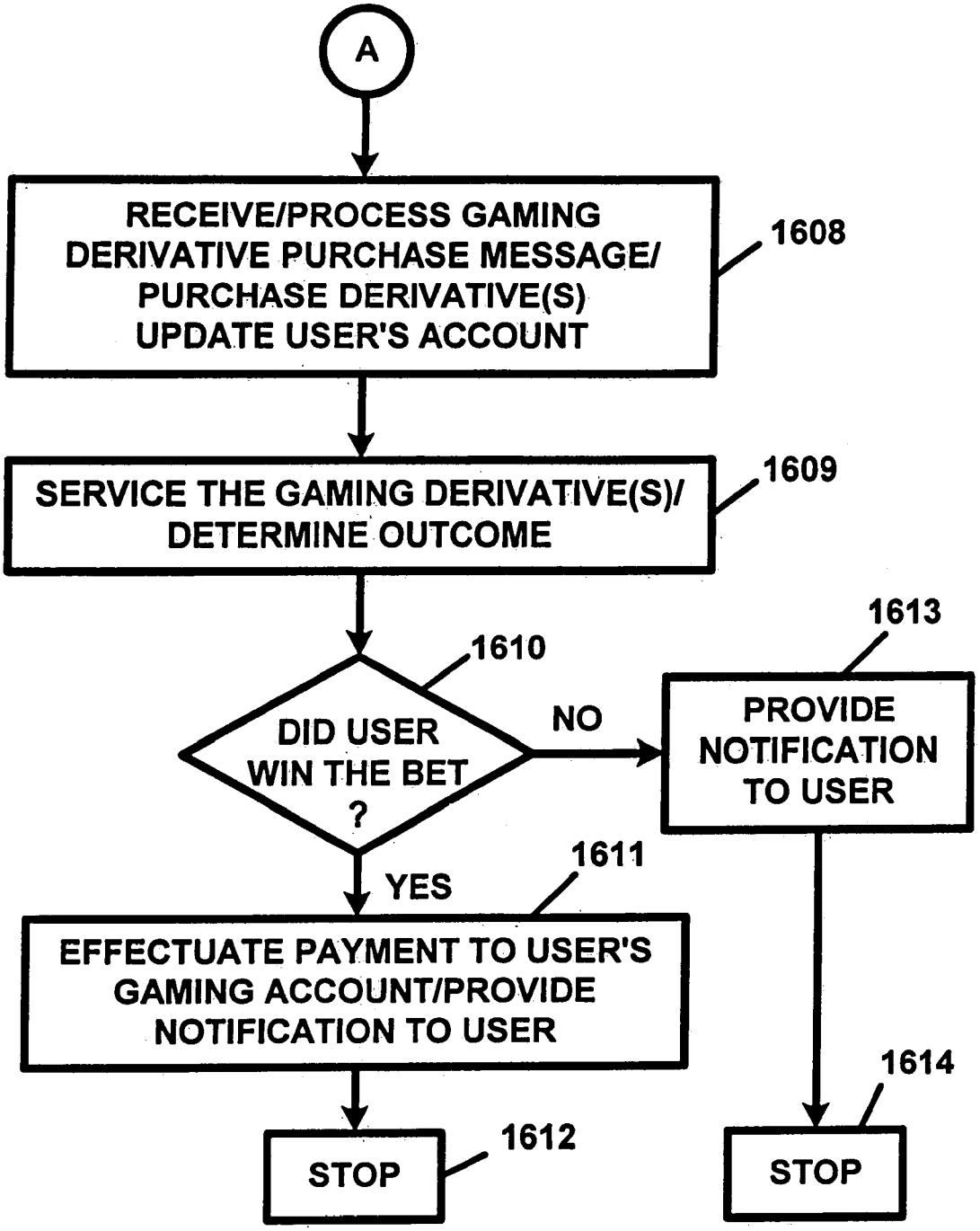

FIGS. 16A and 16B illustrate another preferred embodiment method for utilizing the apparatus 100 and method of the present invention, in flow diagram form. With reference to FIGS. 16A and 16B, the operation of the apparatus 100 and method the present invention commences at step 1600. At step 1601, the user can access the respective central processing computer 10 and/or gaming facility computer 30 via the user communication device and enter and transmit a request for information regarding available gaming derivatives and/or gambling derivatives.

At step 1602, the respective central processing computer 10 and/or gaming facility computer 30 can receive the user's request and process same. At step 1602, the respective central processing computer 10 and/or gaming facility computer 30 can generate a gaming derivative and/or gambling derivative message containing information regarding the respective gaming derivatives and/or gambling derivatives, the type or kind of each gaming derivative and/or gambling derivative, the odds of winning corresponding to each gaming derivative and/or gambling derivative, and/or the price or cost of each gaming derivative and/or gambling derivative.

In another preferred embodiment, the respective central processing computer 10 and/or gaming facility computer 30 can automatically select, identify, and/or recommend, a gaming derivative or derivatives and/or a gambling derivative or derivatives which may be suitable for the user, and generate a gaming derivative and/or gambling derivative message containing information regarding the selected, identified, and/or recommended gaming derivative(s) and/or gambling derivative(s).

At step 1603, the respective central processing computer 10 and/or gaming facility computer 30 can transmit the gaming derivative and/or gambling derivative message to the user communication device 20. At step 1604, the user communication device 20 can receive the gaming derivative and/or gambling derivative message and the information contained therein can be provided to the user. Thereafter, the user can decide whether or not to purchase the gambling derivative.

At step 1605, the user communication device 20 can determine if the user has decided to purchase one or more of gaming derivative and/or gambling derivative. If, at step 1605, it is determined that the user has decided to not purchase a gaming derivative and/or gambling derivative, the operation of the apparatus 100 will cease at step 1606.

If, however, at step 1605, it is determined that the user has decided to purchase a gaming derivative and/or gambling derivative, the operation of the apparatus 100 will proceed to step 1607 and a derivative purchase message can be transmitted to the respective central processing computer 10 and/or gaming facility computer 30. At step 1608, the respective central processing computer 10 and/or gaming facility computer 30 can receive and process the derivative purchase message.

At step 1608, the respective central processing computer 10 and/or gaming facility computer 30 can purchase the gaming derivative(s) and/or gambling derivative(s) for the user and/or for the user's gaming account. At step 1608, the respective central processing computer 10 and/or gaming facility computer 30 can update the user's gaming account to reflect the derivative(s) purchase and/or effectuate payment for the derivative(s) by deducting the purchase price from the user's gaming account. Thereafter, at step 1609, the respective central processing computer 10 and/or gaming facility computer 30 can service the user's derivative purchase as a bet.

At step 1609, the respective central processing computer 10 and/or gaming facility computer 30 can determine the outcome of the bet or gaming activity represented by the gaming or gambling derivative and determine the winner of the bet. At step 1610, the respective central processing computer 10 and/or gaming facility computer 30 can determine if the user won the bet or gaming activity represented by the gaming or gambling derivative. If, at step 1610, it is determined that the user won the bet or gaming activity represented by the gaming or gambling derivative, the respective central processing computer 10 and/or gaming facility computer 30 will, at step 1611, effectuate payment to the user's gaming account and provide notification to the user, via any of the herein-described notification methods or means, so as to notify the user to that effect. Thereafter, the operation of the apparatus 100 will cease at step 1612.

If, however, at step 1610, it is determined that the user lost the bet or gaming activity represented by the gaming or gambling derivative, the respective central processing computer 10 and/or gaming facility computer 30 can, at step 1613, provide notification to the user, via any of the herein-described notification methods or means, so as to notify the user to that effect. Thereafter, the operation of the apparatus 100 will cease at step 1614.

In another preferred embodiment, the apparatus 100 and method of the present invention can be utilized in order to provide, and/or to allow a user or player to purchase, a gaming loss insurance policy or coverage and/or a gambling loss insurance policy or coverage which can provide insurance coverage for gaming losses and/or gambling losses. In this manner, a user can purchase a gaming loss insurance policy and/or a gambling loss insurance policy which can be underwritten by a gaming facility, an insurance provider, and/or any other third party underwriter.

In another preferred embodiment, the apparatus 100 and method of the present invention can facilitate the sale of gaming loss insurance policies and/or gambling loss insurance policies. The apparatus 100 and/or method of the present invention can facilitate the sale of a gaming loss insurance policy or coverage and/or a gambling loss insurance policy or coverage and/or can automatically process claims relating to and/or made pursuant to such gaming and/or gambling loss insurance policies and/or coverage. In this manner, a user can obtain insurance in order to mitigate any gaming losses or gambling losses which he or she may sustain.

Figure 17A:
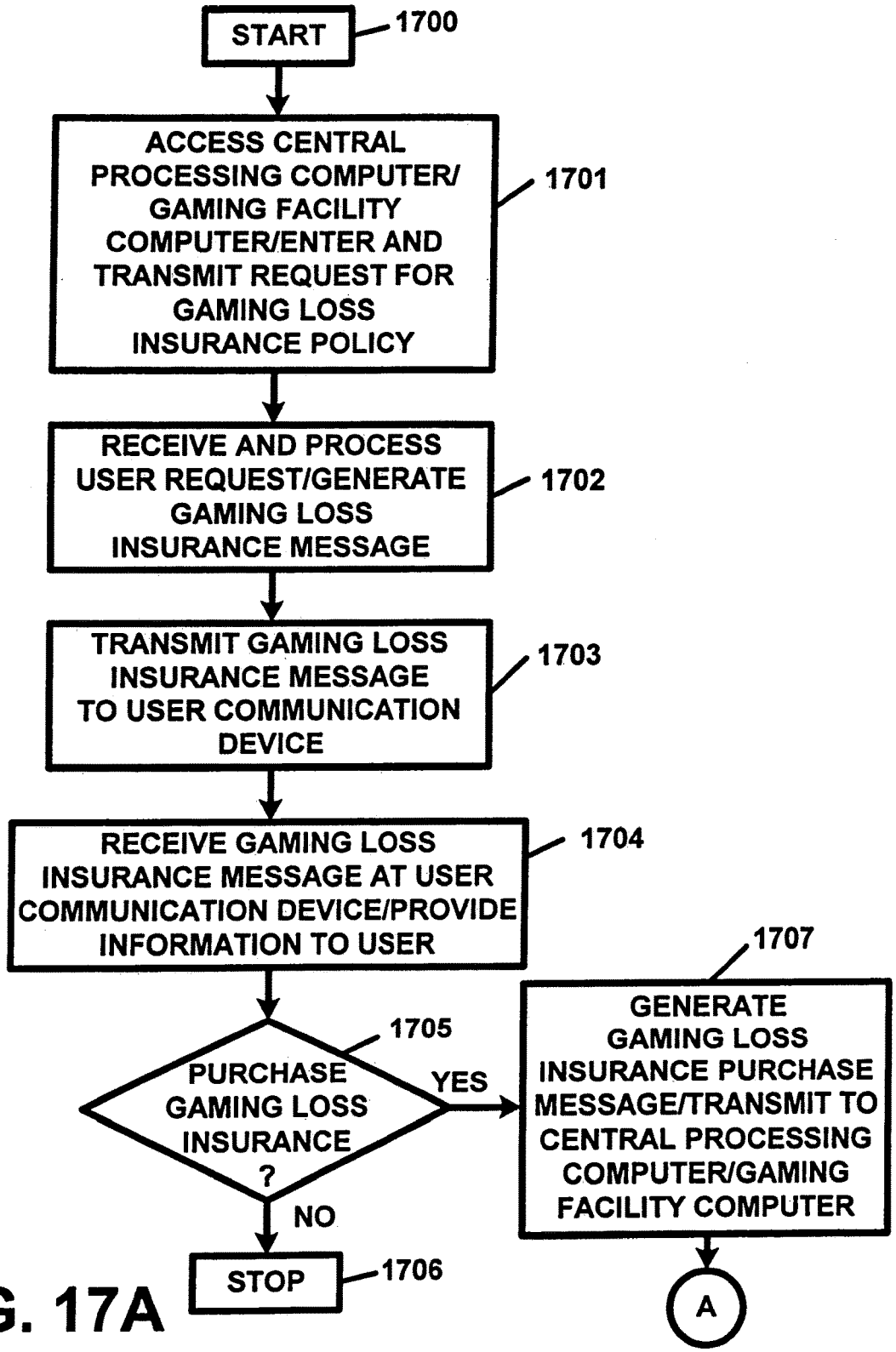
FIGS. 17A and 17B illustrate yet another preferred embodiment method for utilizing the apparatus and method of the present invention, in flow diagram form.
Figure 17B:
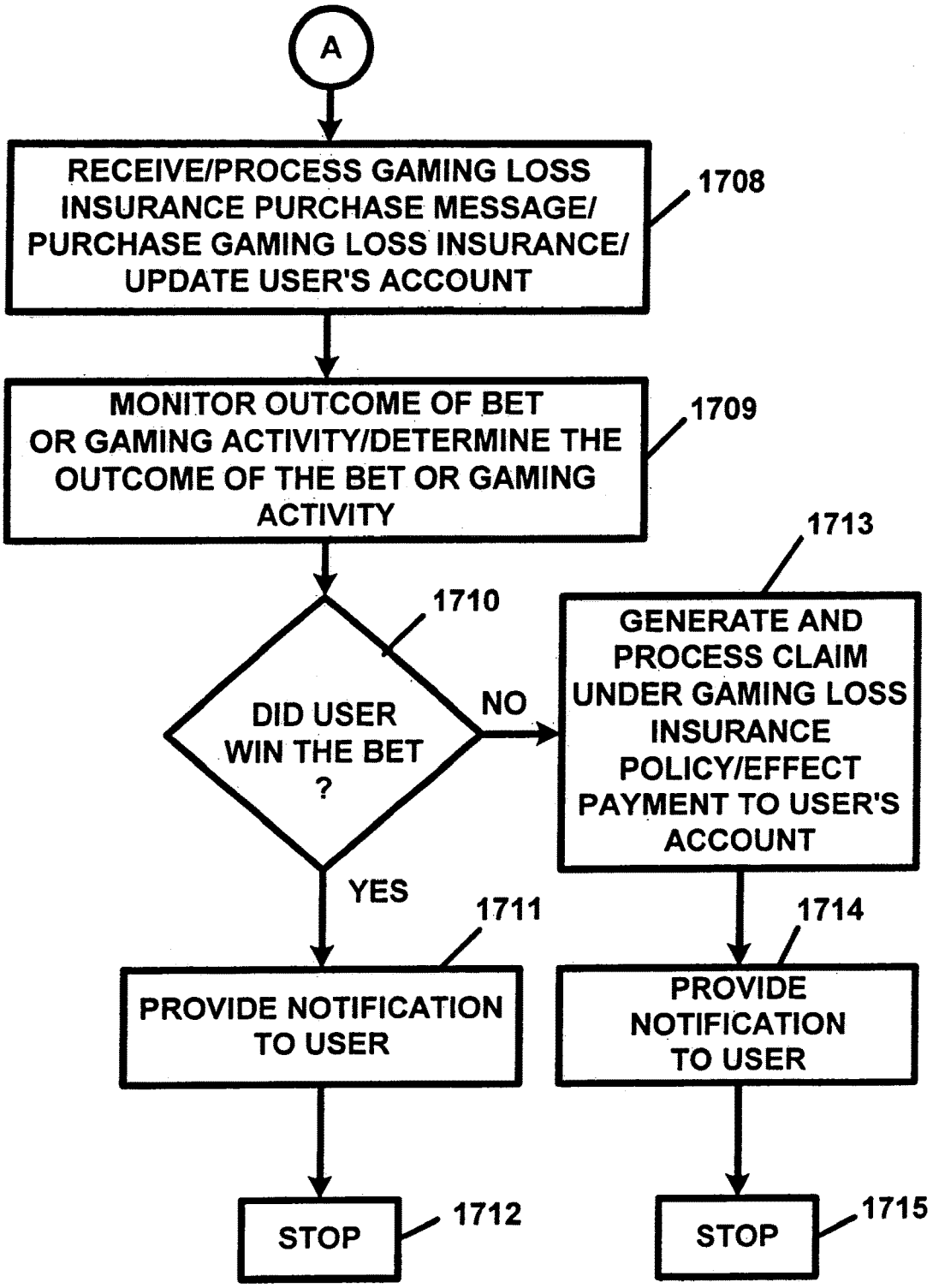

FIGS. 17A and 17B illustrate another preferred embodiment method for utilizing the apparatus 100 and method of the present invention, in flow diagram form. With reference to FIGS. 17A and 17B, the operation of the apparatus 100 and method the present invention commences at step 1700. At step 1701, the user can access the respective central processing computer 10 and/or gaming facility computer 30 via the user communication device and enter and transmit a request for information regarding an available gaming loss insurance policy or policies and/or a gambling loss insurance policy or policies.

In another preferred embodiment, a similar request can accompany and/or be transmitted with a bet being made by the user. At step 1702, the respective central processing computer 10 and/or gaming facility computer 30 can receive the user's request and process same. At step 1702, the respective central processing computer 10 and/or gaming facility computer 30 can generate a gaming loss insurance message and/or a gambling loss insurance message containing information regarding an available gaming loss insurance policy or policies and/or a gambling loss insurance policy or policies, the type or kind of each gaming loss insurance policy or policies and/or gambling loss insurance policy or policies, a deductible relating to each of the gaming loss insurance policy or policies and/or gambling loss insurance policy or policies, and/or the price or cost of each gaming loss insurance policy or policies and/or gambling loss insurance policy or policies.

In another preferred embodiment, the respective central processing computer 10 and/or gaming facility computer 30 can automatically select, identify, and/or recommend, a gaming loss insurance policy or policies and/or a gambling loss insurance policy or policies which may be suitable for the user, and generate a gaming loss insurance message and/or gambling loss insurance message containing information regarding the selected, identified, and/or recommended policy or policies.

At step 1703, the respective central processing computer 10 and/or gaming facility computer 30 can transmit the gaming loss insurance message and/or gambling loss insurance message to the user communication device 20. At step 1704, the user communication device 20 can receive the gaming loss insurance message and/or gambling loss insurance message and the information contained therein can be provided to the user. Thereafter, the user can decide whether or not to purchase the gaming loss insurance policy and/or gambling loss insurance policy.

At step 1705, the user communication device 20 can determine if the user has decided to purchase one or more of gaming loss insurance policy or policies and/or gambling loss insurance policy or policies. If, at step 1705, it is determined that the user has decided to not purchase a gaming loss insurance policy or policies and/or gambling loss insurance policy or policies, the operation of the apparatus 100 will cease at step 1706.

If, however, at step 1705, it is determined that the user has decided to purchase a gaming loss insurance policy or policies and/or gambling loss insurance policy or policies, the operation of the apparatus 100 will proceed to step 1707 and a gaming loss insurance policy message and/or gambling loss insurance policy purchase message can be transmitted to the respective central processing computer 10 and/or gaming facility computer 30.

At step 1708, the respective central processing computer 10 and/or gaming facility computer 30 can receive and process the gaming loss insurance policy message and/or gambling loss insurance policy purchase message. At step 1708, the respective central processing computer 10 and/or gaming facility computer 30 can purchase the gaming loss insurance policy or policies and/or gambling loss insurance policy or policies for the user and/or for the user's gaming account.

At step 1708, the respective central processing computer 10 and/or gaming facility computer 30 can update the user's gaming account to reflect the purchase of the respective policy or policies and/or effectuate payment for the respective policy or policies by deducting the purchase price from the user's gaming account. Thereafter, at step 1709, the respective central processing computer 10 and/or gaming facility computer 30 can automatically monitor the outcome of the bet or gaming activity covered by the respective gaming loss and/or gambling loss insurance policy or policies.

At step 1709, the respective central processing computer 10 and/or gaming facility computer 30 can determine the outcome of the bet or gaming activity covered by the respective gaming loss and/or gambling loss insurance policy or policies and determine the winner of the bet or gaming activity. At step 1710, the respective central processing computer 10 and/or gaming facility computer 30 can determine if the user won the bet or gaming activity covered by the respective gaming loss and/or gambling loss insurance policy or policies.

If, at step 1710, it is determined that the user won the bet or gaming activity covered by the respective gaming loss and/or gambling loss insurance policy or policies, the respective central processing computer 10 and/or gaming facility computer 30 can, at step 1711, provide notification to the user, via any of the herein-described notification methods or means, so as to notify the user of the cancellation of the respective insurance policy or insurance policies. Thereafter, the operation of the apparatus 100 will cease at step 1712.

If, however, at step 1710, it is determined that the user lost the bet or gaming activity covered by the respective gaming loss and/or gambling loss insurance policy or policies, the respective central processing computer 10 and/or gaming facility computer 30 will, at step 1713, automatically generate and process a claim or claims under the respective gaming loss and/or gambling loss insurance policy or policies and effectuate payment of the insurance proceeds to the user's gaming account.

At step 1714, the respective central processing computer 10 and/or gaming facility computer 30 can provide notification to the user, via any of the herein-described notification methods or means, so as to notify the user of the processed claim under the insurance policy or policies and the payment or payments made his or her gaming account. Thereafter, the operation of the apparatus 100 will cease at step 1715.

In another preferred embodiment, the apparatus 100 and method of the present invention can be utilized in order to provide a credit derivative product, in the form of a gaming loss insurance credit derivative and/or a gambling loss credit derivative, which can be an instrument which a gaming facility, a gaming loss insurance provider, and/or a gambling loss insurance provider, can sell and/or issue to a user or users of the present invention, and/or or to any other interested parties, in order to reduce its risk of loss associated with its exposure or potential exposure from the sale or issuance of the respective gaming loss insurance policies and/or gambling loss insurance policies.

In this regard, the apparatus 100 and method of the present invention can provide a credit derivative or instrument to users, players, or other parties, which will enable the provider(s) of the respective gaming loss insurance policies and/or gaming loss insurance policies to reduce its risk of loss in the event of claims paid out to user insureds under the respective policies. The credit derivative can also enable the user to invest in, and/or bet and/or gamble on, whether a respective gaming loss insurance provider and/or gambling loss insurance provider will realize more revenues from premiums obtained under the respective insurance policies than it pays out to claimants under the respective insurance policies.

In one preferred embodiment, in the event a respective insurer(s) needs to pay out more for claims than it takes obtains in premiums, it can utilize the proceeds obtained from the sale of credit derivatives. In another preferred embodiment, in the event a respective insurer(s) pays out less in claims than it pays out in claims, it can return the purchase price plus a percentage return (i.e. interest payment, or payment for assuming the risk of the investment in the credit derivative, etc.) to the user or purchaser of the credit derivative.

In a preferred embodiment, the return to the user or other party for his, her, or its, investment can be provided from profits realized by the respective insurer (i.e. total premiums less claims paid, etc.). The credit derivative can also be structured and/or devised in any other appropriate manner so as to cover an insured's risk of loss while providing a rate of return to the investing user or other party in the event the insured does not sustain a loss.

Figure 18A:
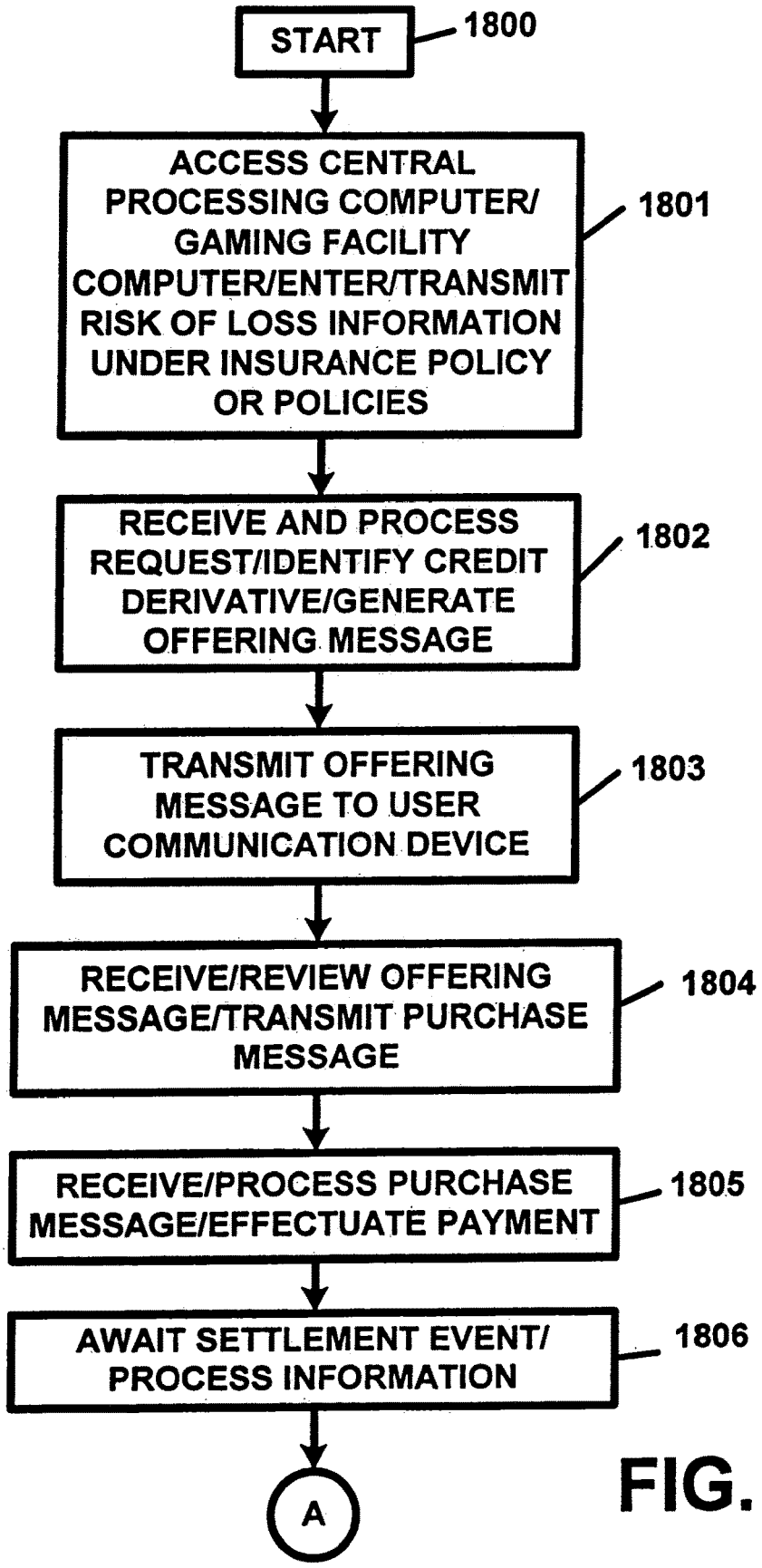
FIGS. 18A and 18B illustrate another preferred embodiment method for utilizing the apparatus and method of the present invention, in flow diagram form.
Figure 18B:
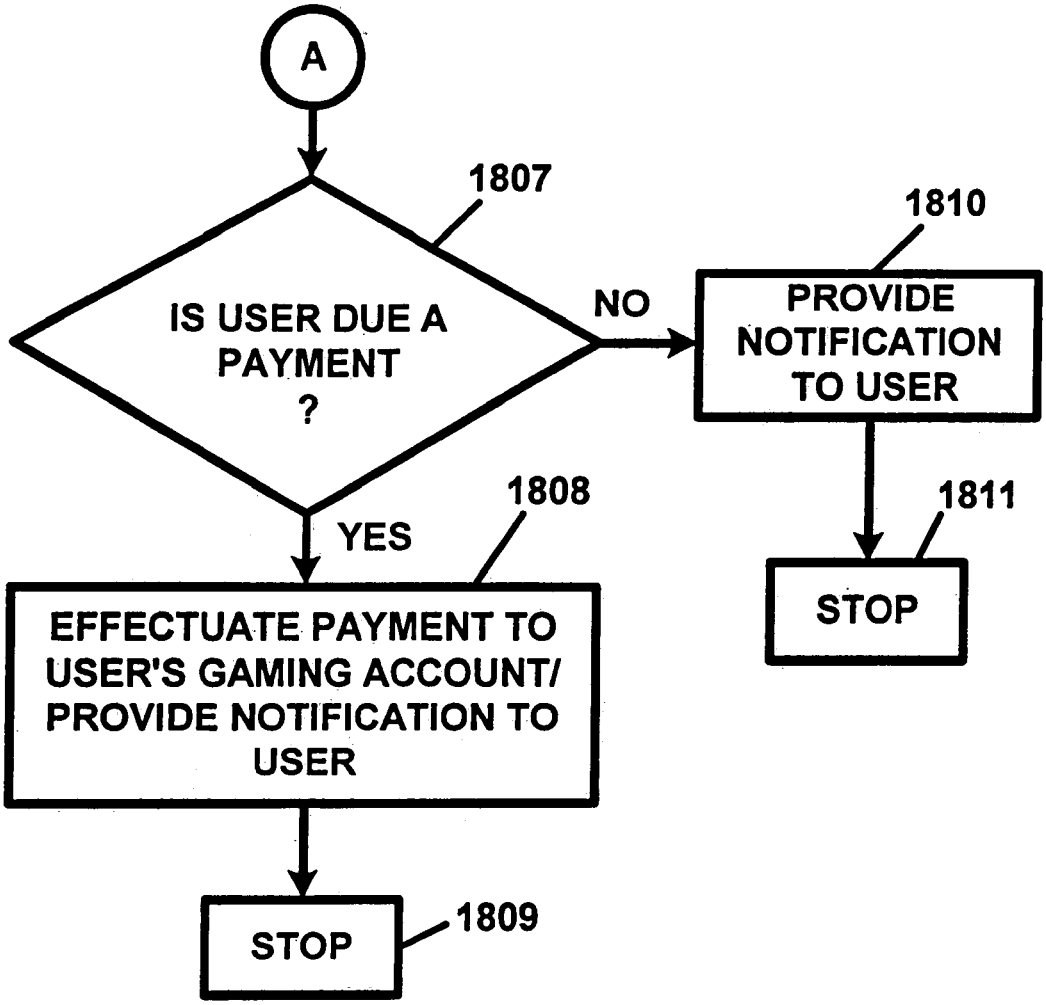

FIGS. 18A and 18B illustrate another preferred embodiment method for utilizing the apparatus 100 and method of the present invention, in flow diagram form. With reference to FIGS. 18A and 18B, the operation of the apparatus 100 and method the present invention commences at step 1800. At step 1801, the insurance provider of the respective gaming loss insurance policies and/or gambling loss insurance policies can access the respective central processing computer 10 and/or gaming facility computer 30 via the user communication device 20 and enter and transmit information regarding a risk of loss assumed under issued gaming loss and/or gambling loss insurance policies along with a request for information regarding an available credit derivative.

At step 1802, the central processing computer 10 and/or gaming facility computer 30 can receive the insurer's request, process same, and identify a credit derivative suitable for the insurer. At step 1802, the respective central processing computer 10 and/or gaming facility computer 30 can generate a credit derivative offering message containing information regarding the credit derivative, the risk associated with an investment in same, and the rate of return, or a range of a rate of return expected to be paid if paid out at all.

At step 1803, the respective central processing computer 10 and/or gaming facility computer 30 can transmit the credit derivative offering message to the user communication devices 20 of any number of users or other parties. In another preferred embodiment, the credit derivative offering message can be transmitted to users or other parties when the users or other parties access the respective central processing computer 10 and/or gaming facility computer 30.

At step 1804, the user, users, or other parties, can receive the credit derivative offering message, review the information contained therein, and decide whether or not to purchase the credit derivative. If, at step 1804, the users or other parties decide to purchase the credit derivative, the user or other party can transmit a purchase message to the respective central processing computer 10 and/or gaming facility computer 30.

At step 1805, the respective central processing computer 10 and/or gaming facility computer 30 can receive and process the information contained in the purchase message. At step 1805, the respective central processing computer 10 and/or gaming facility computer 30 can effectuate the purchase of the credit derivative(s) for the user, users, or other parties, and/or for the gaming account(s) of the user, users, or other parties.

In a preferred embodiment, the respective central processing computer 10 and/or gaming facility computer 30 can also, at step 1805, effectuate payment for the derivative(s) from the user's gaming account and/or from a payment identifier provided by the user. At step 1806, the respective central processing computer 10 and/or gaming facility computer 30 can await a settlement event. Upon the occurrence of the settlement event, the respective central processing computer 10 and/or gaming facility computer 30 can, at step 1807, determine if the user or other party is due to receive its purchase price back with a rate of return (i.e. the insurer paid out less in claims than it took in revenues).

If, at step 1807, it is determined that the user or party is due to receive its purchase price back and a rate of return, then the operation of the respective central processing computer 10 and/or gaming facility computer 30 will proceed to step 1808 and respective central processing computer 10 and/or gaming facility computer 30 can effectuate payment to the user's gaming account for each user or the party that invested in the credit derivative.

At step 1808, the respective central processing computer 10 and/or gaming facility computer 30 can also provide notification to the user or other party, via any of the herein-described notification methods or means, so as to notify the user or other party of the payment made pursuant to the credit derivative. Thereafter, the operation of the apparatus 100 will cease at step 1809.

If, at step 1807, it is determined that the user or party is not due to receive its purchase price back and a rate of return (i.e. the insurer paid out more in claims than it received in premiums) then the operation of the respective central processing computer 10 and/or gaming facility computer 30 will proceed to step 1810 and the respective central processing computer 10 and/or gaming facility computer 30 can provide notification to the user or other party, via any of the herein-described notification methods or means, so as to notify the user or other party that no payment will be made pursuant to the credit derivative. Thereafter, the operation of the apparatus 100 will cease at step 1811.

In another preferred embodiment, the apparatus 100 and method of the present invention can also be utilized in order to notify users or players of the availability of any of the herein-described gaming loss insurance policies and/or gambling loss insurance policies and/or of the availability of any of the herein-described gaming loss insurance credit derivatives and/or gambling loss insurance credit derivatives. The users can thereafter effectuate a purchase of any of any of the herein-described gaming loss insurance policies and/or gambling loss insurance policies and/or of the availability of any of the herein-described gaming loss insurance credit derivatives and/or gambling loss insurance credit derivatives via a respective central processing computer 10 and/or gaming facility computer 30.

In another preferred embodiment, the apparatus 100, and/or the central processing computer 10 and/or the gaming facility computer 30, can administer the sale of, and/or process, and/or service, any claims and/or payments made to the user pursuant to a respective gaming loss insurance policy and/or gambling loss insurance policy and/or of the availability of any of the herein-described gaming loss insurance credit derivatives and/or gambling loss insurance credit derivatives.

Figure 19A:
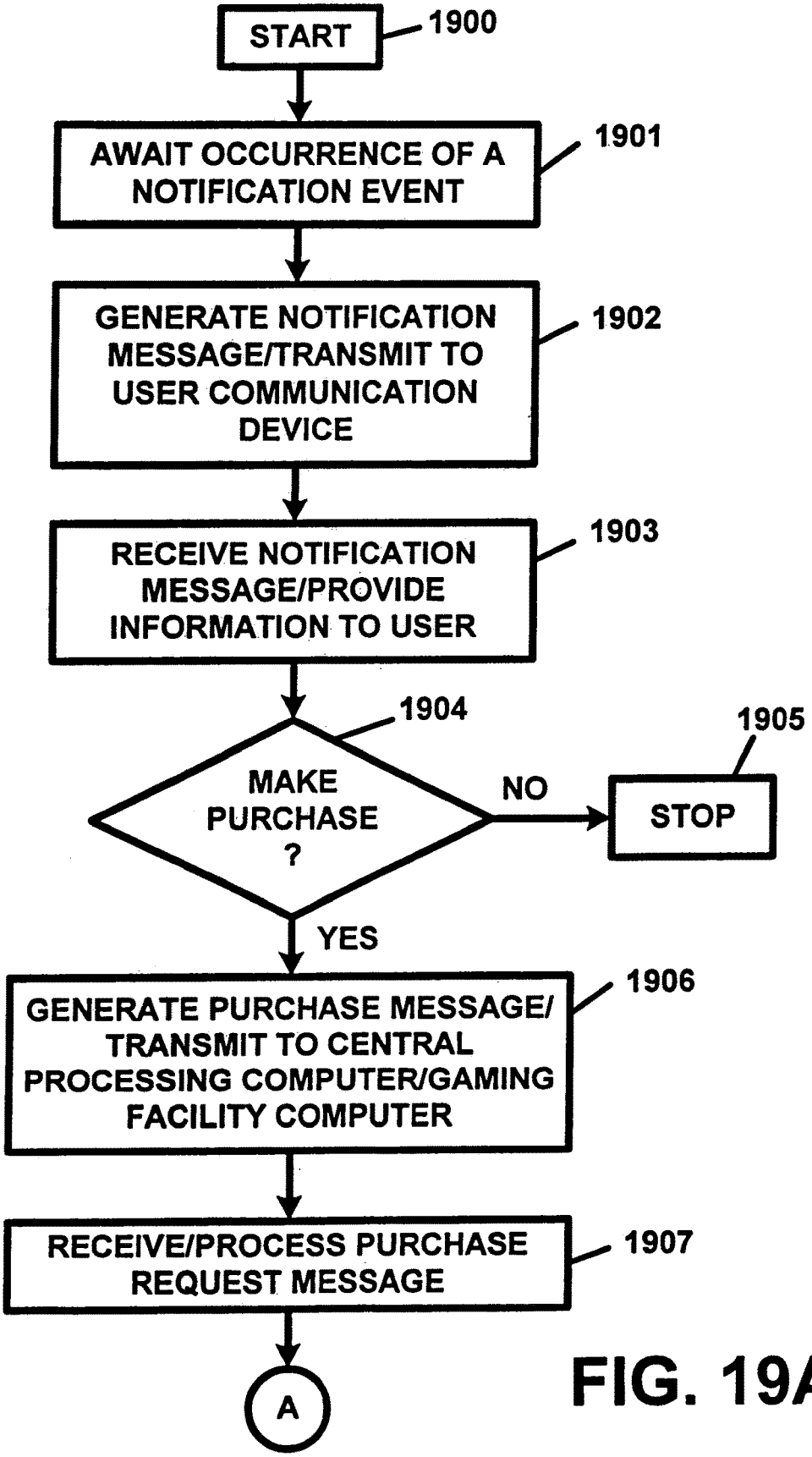
FIGS. 19A and 19B illustrate still another preferred embodiment method for utilizing the apparatus and method of the present invention, in flow diagram form.
Figure 19B:
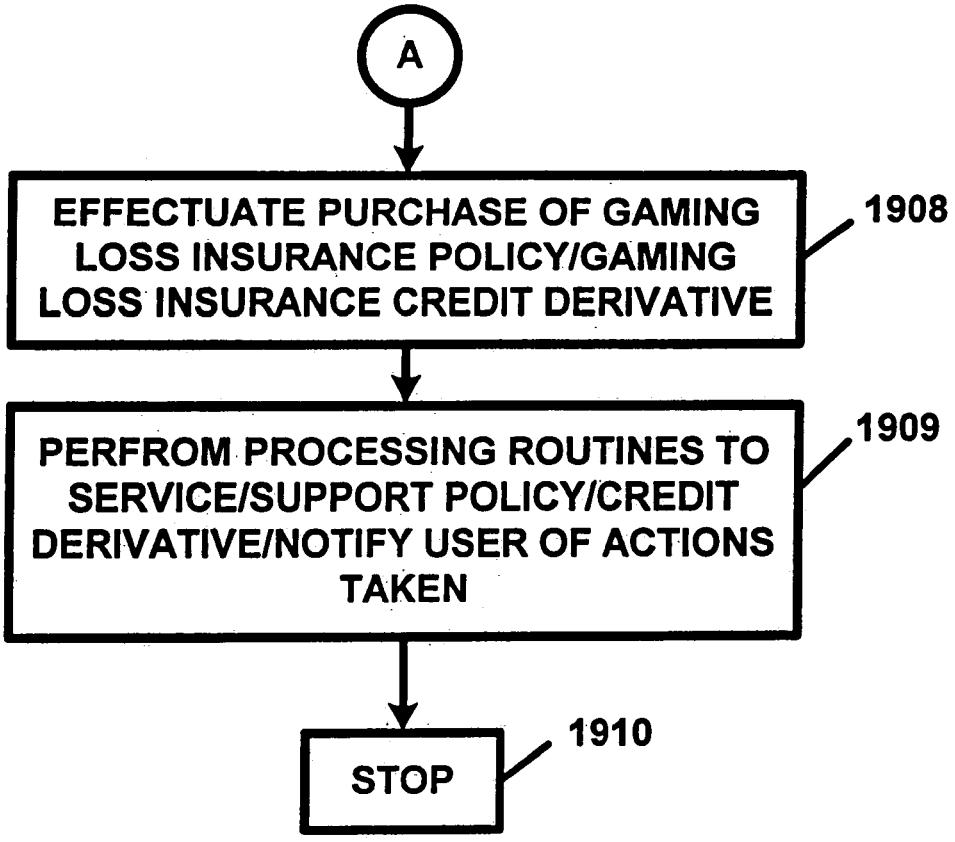

FIGS. 19A and 19B illustrate another preferred embodiment method for utilizing the apparatus 100 and method of the present invention. With reference to FIGS. 19A and 19B, the operation of the apparatus 100 commences at step 1900. At step 1901, the apparatus 100 will await an occurrence of a notification event. In a preferred embodiment, the notification event can be a new posting of available gaming loss insurance policies, gambling loss insurance policies, gaming loss insurance credit derivatives, and/or gambling loss insurance credit derivatives.

In another preferred embodiment, the notification event can be a user's request for information regarding available gaming loss insurance policies, gambling loss insurance policies, gaming loss insurance credit derivatives, and/or gambling loss insurance credit derivatives, and/or a user's placing a bet and/or engaging in gaming activity at a respective central processing computer 10 and/or gaming facility computer 30.

Upon the occurrence of the notification event, the respective central processing computer 10 and/or gaming facility computer 30 can, at step 1902, generate a notification message containing any appropriate information regarding the available gaming loss insurance policies, gambling loss insurance policies, gaming loss insurance credit derivatives, and/or gambling loss insurance credit derivatives, including respective pricing information, deductible information, risk information, and/or rate or return information. At step 1902, the notification message can be transmitted to the user's communication device 20.

At step 1903, the user communication device 20 can receive the notification message and provide the information to the user. At step 1904, the user can decide to purchase a respective gaming loss insurance policy, gambling loss insurance policy, gaming loss insurance credit derivative, and/or gambling loss insurance credit derivative. If, at step 1904, the user decides not to purchase a respective gaming loss insurance policy, gambling loss insurance policy, gaming loss insurance credit derivative, and/or gambling loss insurance credit derivative, the operation of the apparatus 100 will cease at step 1905. If, however, the user decide to purchase a respective gaming loss insurance policy, gambling loss insurance policy, gaming loss insurance credit derivative, and/or gambling loss insurance credit derivative, the user communication device 20, at step 1906, will generate a purchase request message and transmit same to the respective central processing computer 10 and/or gaming facility computer 30.

At step 1907, the respective central processing computer 10 and/or gaming facility computer 30 can receive and process the purchase request message. At step 1908, the respective central processing computer 10 and/or gaming facility computer 30 will effectuate the purchase of the respective gaming loss insurance policy, gambling loss insurance policy, gaming loss insurance credit derivative, and/or gambling loss insurance credit derivative, for or on behalf of the user.

At step 1909, the respective central processing computer 10 and/or gaming facility computer 30 can perform any of the herein described processing routines for servicing and/or supporting the respective gaming loss insurance policy, gambling loss insurance policy, gaming loss insurance credit derivative, and/or gambling loss insurance credit derivative. For example, in the case of a gaming loss insurance policy or gambling loss insurance policy, the respective central processing computer 10 and/or gaming facility computer 30 can determine if a gaming loss or a gambling loss has occurred, file and process a claim pursuant to the respective insurance policy and effectuate payment of the claim proceeds to the user's gaming account.

In the case of a gaming loss insurance credit derivative or a gambling loss insurance credit derivative, the respective central processing computer 10 and/or gaming facility computer 30 can determine if a payment, with a rate or return, is due to be received by user and effectuate such payment to the user's gaming account.

At step 1909, the respective central processing computer 10 and/or gaming facility computer 30 can also provide notification to the user or other party, via any of the herein-described notification methods or means, so as to notify the user or other party of any actions taken, or not taken, pursuant to the respective gaming loss insurance policy, gambling loss insurance policy, gaming loss insurance credit derivative, and/or gambling loss insurance credit derivative. Thereafter, the operation of the apparatus 100 will cease at step 1910.

In another preferred embodiment, the apparatus 100 and method of the present invention can also be utilized in conjunction with state gaming activities of a respective state, country or sovereignty. As used herein the term "state" means any state, region, territory, and/or possession of the United States of America, any nation, country, sovereign state, monarchy, principality, and/or any region, territory, possession, and/or subdivision of same. In this manner, the apparatus and method of the present invention can also be utilized in a manner consistent with gaming laws, rules, and/or regulations, in the various states, countries, or sovereignties, in which, or in conjunction with which, the apparatus 100 and method of the present invention can also be utilized. In this manner, the apparatus 100 and method of the present invention can also be utilized in order to facilitate compliance with the various and respective state, country, and/or sovereignty, gaming laws and/or gambling laws and/or so as to facilitate any reporting of gaming activities and/or gambling activities to the appropriate state, country, and/or sovereignty, authorities and/or so as to facilitate any payments of fees and/or taxes relating to the gaming activities and/or gambling activities.

In a preferred embodiment, the apparatus 100 and method of the present invention can also be utilized in a scenario in which each of the herein-described types or kinds of states may have gaming law, gaming regulations, gaming rules, gambling laws, gambling regulations, and/or gambling rules, in effect. In certain scenarios, certain states may only allow certain types of gaming and/or gambling (i.e. lotteries, or horse racing, etc.). In certain other scenarios, certain states may affirmatively ban certain types of gaming activities and/or gambling activities (i.e. card games, or sports gambling, etc.). In certain other scenarios, certain states may allow all gaming activities and/or gambling activities and/or allow same if supervised by a licensing authority and/or upon the payment of gaming fees and/or gambling fees.

In another preferred embodiment, the apparatus 100 and method of the present invention can also be utilized in a scenario in which a state from which a remote gaming activity and/or gambling activity originates ("the originating state") would be deemed legal and/or in compliance with the originating state's gaming laws and/or gambling laws if any one or more of a gaming license is obtained by the user and/or the gaming facility involved in the gaming activity and/or gambling activity, a gaming fee is paid to the originating state, a gaming fee is paid to the originating state by the user and/or the gaming facility involved in the gaming activity and/or gambling activity for each gaming activity and/or gambling activity which occurs, and/or upon the satisfaction of any other originating state dictated requirements and/or the payment of any originating state prescribed fees. The gaming facility can be the operator of and/or be associated with any of the herein-described central processing computers 10 and/or gaming facility computers 30.

For example, if a state, such as New York State, only allows state lotteries, horse racing, and/or slot machine gaming, a user utilizing the apparatus 100 and method of the present invention via his or her own communication device and/or personal computer 20 from his or her home in Anytown, N.Y., can legally engage in remote gaming activities from New York upon any one or more of obtaining a license from New York State, the gaming facility obtaining a license from New York State, the user and/or the gaming facility paying a gaming fee to New York State, and/or the user and/or the gaming facility paying a gaming fee to New York State for each gaming activity and/or gambling activity and/or for any number of gaming activities and/or gambling activities. In this type of proposed scenario, states and countries can receive gaming activity fees and/or gambling activity fees, thereby resulting in a financial benefit to the participating state, states, country, and/or countries.

In a preferred embodiment, it is envisioned that certain states either or both may claim jurisdiction over gaming activities and/or gambling activities which physically occur inside the state, on waters within the state's jurisdiction, and/or within the state's airspace, and/or that certain states may claim jurisdiction over remote gaming activities and/or gambling activities which originate from a user communication device 20 which is permanently and/or temporarily inside the state, on waters within the state's jurisdiction, and/or within the state's airspace, at the time the remote gaming activity and/or gaming activity occurs or takes place.

For example, if a state claims jurisdiction over gaming activities and/or gambling activities which originate from a user communication device 20 which is located inside the state, on waters within the state's jurisdiction, and/or within the state's airspace, at the time the remote gaming activity and/or gaming activity occurs or takes place, the state may require a license be obtained beforehand and/or afterward by the user and/or the gaming facility which is the counterparty to the gaming activity and/or gambling activity. In this manner, gaming activity and/or gambling activity, otherwise prohibited by a state's laws, can be legal and the state can realize financial revenues from such remote gaming activity and/or gambling activity.

Figure 20A:
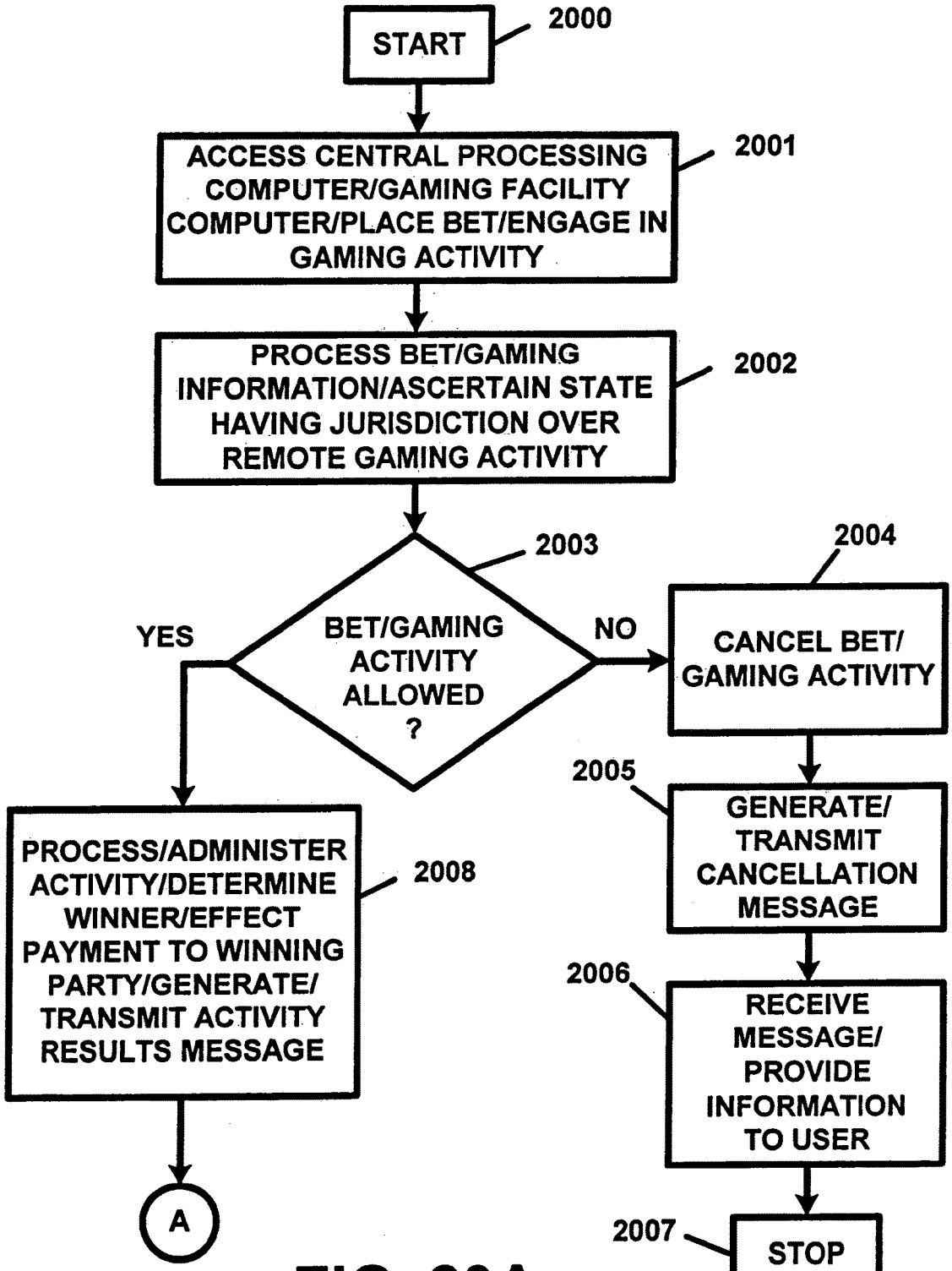
FIGS. 20A and 20B illustrate yet another preferred embodiment method for utilizing the apparatus and method of the present invention, in flow diagram form.
Figure 20B:
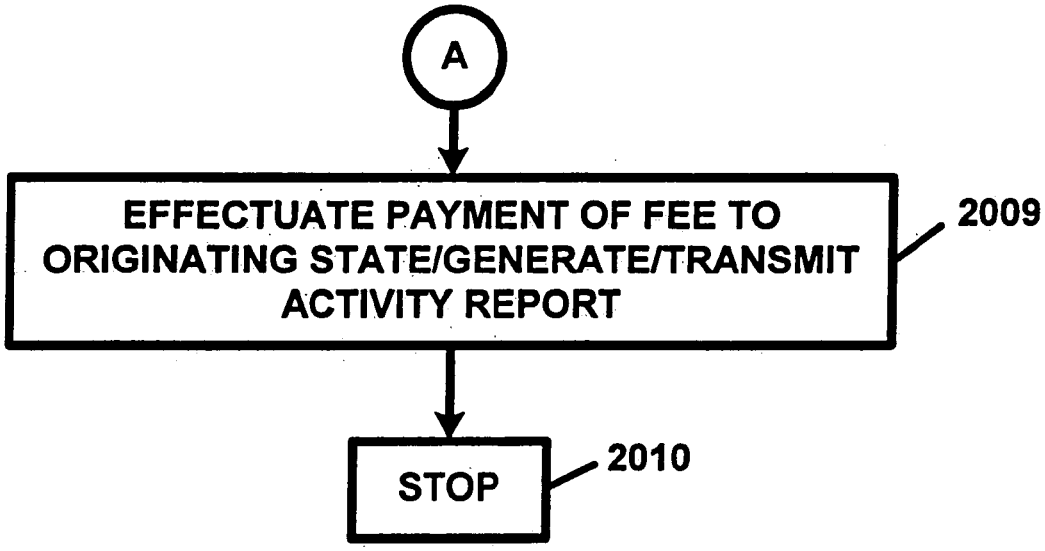

In another preferred embodiment, the apparatus 100 and method of the present invention can also be utilized in order to administer remote gaming activity and/or gambling activity. FIGS. 20A and 20B illustrate another preferred embodiment method for utilizing the apparatus 100 and method of the present invention.

With reference to FIGS. 20A and 20B, the operation of the apparatus 100 commences at step 2000. At step 2001, a user can access a respective central processing computer 10 and/or gaming facility computer 30 via the user communication device 20 and place a bet, wager, and/or otherwise engage in gaming activity and/or gambling activity. At step 2001, the user can transmit a betting message from the user communication device 20 to the respective central processing computer 10 and/or gaming facility computer 30. The betting message can contain information regarding the bet, wager, gaming activity, or gambling activity.

At step 2001, the information regarding the user's bet, wager, and/or gaming activity, can include a payment identifier for the amount of the bet, wager, and/or gaming activity, and/or a payment identifier for payment of any gaming fee or fees to the originating state, if applicable.

At step 2002, the respective central processing computer 10 and/or gaming facility computer 30 can process the information regarding the user's bet and/or gaming activity and effectuate the placing of the user's bet and/or gaming activity. At step 2002, the respective central processing computer 10 and/or gaming facility computer 30 can ascertain the state having jurisdiction over the remote gaming activity and/or gambling activity.

In one preferred embodiment, wherein the user communication device 20 is registered with the respective central processing computer 10 and/or gaming facility computer 30 as a line connected device (i.e. personal computer, telephone, personal digital assistant, television, or interactive television, etc., which is connected to a telephone line, a cable television line, a digital television line, a DSL line, a T-1 line, and/or any other hard wired communication line, etc.), information regarding the user's state and/or the state having jurisdiction over the remote gaming activity and/or gambling activity can be pre-registered with, and/or be known by, the respective central processing computer 10 and/or gaming facility computer 30.

In another preferred embodiment, wherein the user communication device 20 is a wireless communication device and/or a mobile communication device (i.e. personal digital assistant, wireless videophone, wireless telephone, or palm-held device, etc., which can be equipped with a global positioning system (GPS) device 20J), the location of the user communication device 20 and, therefore, the location from which the gaming activity and/or gambling activity originates and/or from which it takes place can be determined by the user communication device 20 automatically transmitting position data and/or information to the respective central processing computer 10 and/or gaming facility computer 30 at the time of the user's accessing of the respective central processing computer 10 and/or gaming facility computer 30.

In another preferred embodiment, such as in a case when a user is placing bets from an airplane, boat, cruise ship, train, or automobile, etc., wherein the user's location may change at any time, the user communication device 20 can be programmed to automatically transmit position data and/or information along with the signal containing information regarding the user's bet, wager and/or gaming activity. In this manner, the respective central processing computer 10 and/or gaming facility computer 30, at step 2002, can both process the user's bet, wager, and/or gaming activity and ascertain the state which has jurisdiction over the remote gaming activity and/or gambling activity.

At step 2003, the respective central processing computer 10 and/or gaming facility computer 30 can determine if the remote gaming activity and/or gambling activity is allowed by the state having jurisdiction over the remote gaming activity and/or gambling activity.

If, at step 2003, the respective central processing computer 10 and/or gaming facility computer 30 determines that the remote gaming activity and/or gambling activity is disallowed by the identified state having jurisdiction over same, then the operation of the apparatus 100 will proceed to step 2004 and the respective central processing computer 10 and/or gaming facility computer 30 will cancel the respective bet, wager, and/or gaming activity and/or gambling activity.

At step 2005, the respective central processing computer 10 and/or gaming facility computer 30 will generate a gaming activity cancellation message and transmit same to the user communication device 20. At step 2006, the user communication device 20 will receive the gaming activity cancellation message and the information contained therein can be provided to the user. Thereafter, the operation of the apparatus 100 will cease at step 2007.

If, however, at step 2003, the respective central processing computer 10 and/or gaming facility computer 30 determines that the remote gaming activity and/or gambling activity is allowed by the identified state having jurisdiction over same, then the operation of the apparatus 100 will proceed to step 2008 and respective central processing computer 10 and/or gaming facility computer 30 will place, process and/or administer, the respective gaming activity and/or gambling activity. At step 2008, the respective central processing computer 10 and/or gaming facility computer 30 can determine the winner of the bet, wager, or gaming activity and effectuate payment of the proceeds to the winning party.

At step 2008, the respective central processing computer 10 and/or gaming facility computer 30 can also generate an activity results message and transmit same to the user communication device 20 which can receive the activity results message and provide information contained therein to the user. At step 2009, the respective central processing computer 10 and/or gaming facility computer 30 can effectuate payment of any gaming fee and/or gambling fee for the remote gaming activity and/or gambling activity to the originating state.

In a preferred embodiment, the payment of any fee or fees to the originating state can be effectuated by an electronic monetary transmission and/or electronic transfer from the respective central processing computer 10 and/or gaming facility computer 30 to the governmental entity computer 60 associated with the originating state. In another preferred embodiment, any other accounting methods (i.e. account crediting, etc.) can also be utilized in order to effectuate a payment or payments to the originating state.

At step 2009, the respective central processing computer 10 and/or gaming facility computer 30 can also transmit an activity report containing information regarding the time of the gaming activity and/or gambling activity, the location of origination of the gaming activity and/or gambling activity, the user involved, the gaming facility involved, the amount of the bet or wager, the activity or game which was the subject of the bet, wager, and/or gaming activity, the amount to the fee paid, the amount of a user's winning for reporting purposes and/or for tax reporting purposes, and/or any other information which may be of interest or use to the originating state.

At step 2009, a message containing any and/or all of the information described herein as being provided to the originating state's governmental entity computer 60 can also be transmitted to the user communication device 20. In another preferred embodiment, the fee payable to the originating state can be a portion of the amount bet by the user and/or can be a portion of the amount won by the user and/or by the gaming facility.

In another embodiment, the fee can be paid from a gaming activity license fund and/or a gambling activity license fund which can be associated with the user and/or with the gaming facility and which can be administered by the respective central processing computer 10 and/or gaming facility computer 30. In another preferred embodiment, the user can transmit payment for, and/or an authorization for payment for, the requisite fee to the respective central processing computer 10 and/or gaming facility computer 30 along with the user's bet or wager which was transmitted to the respective central processing computer 10 and/or gaming facility computer 30 at step 2001.

Thereafter, the operation of the apparatus 100 will cease at step 2010.

In another preferred embodiment, the apparatus and method of FIGS. 20A and 20B can also be utilized in order to allow a user to play lottery games in any number of states, countries, and/or other localities. The apparatus 100 can determine a user's originating state and can facilitate the playing of a lottery game or games, including the collection of winnings and/or prizes for and/or on behalf of the user for any number of state lottery games.

In another preferred embodiment, the apparatus 100 and method of the present invention can also be utilized in order to allow a user or user's to place remote bets, wagers, and/or otherwise engage in gaming activity and/or gambling activity on, in, and/or from, a vehicle.

In another preferred embodiment, the apparatus 100 and method of the present invention can also provide for gaming activities and/or gambling activities on board any one or more of a gaming establishment or gambling establishment aboard a boat, ship, cruise ship, commercial boat or cruise ship, passenger boat, ferry, marine vehicle, marine vessel, aircraft, airplane, jet, passenger aircraft, shuttle aircraft, commercial aircraft, train, subway train, bus, automobile, and/or any other vehicle, etc., (hereinafter referred to as "vehicle").

The present invention can utilize global positioning technology at the user communication device 20 and/or at a central processing computer 10 and/or a gaming facility computer 30 on board the respective boat, ship, cruise ship, commercial boat or cruise ship, passenger boat, ferry, marine vehicle, marine vessel, aircraft, airplane, jet, passenger aircraft, shuttle aircraft, and/or commercial aircraft, a train, a subway train, a bus, and/or an automobile, etc., in order to ascertain the jurisdiction in which the respective boat, ship, cruise ship, commercial boat or cruise ship, passenger boat, ferry, marine vehicle, marine vessel, aircraft, airplane, jet, passenger aircraft, shuttle aircraft, commercial aircraft, train, subway train, bus, automobile, and/or any other vehicle, on which any one or more of the respective user communication device 20, central processing computer 10, and/or gaming facility computer 30, is located and apply the gaming laws and rules for the identified jurisdiction in which the respective user communication device 20, central processing computer 10, and/or gaming facility computer 30, is located, to the respective gaming activities and/or gambling activities.

The apparatus 100 can also facilitate the payment of any gaming activities and/or gambling activity fees to an appropriate state or states. As noted above, term "state" means any state, region, territory, and/or possession of the United States of America, any nation, country, sovereign state, monarchy, principality, and/or any region, territory, possession, and/or subdivision of same.

Figure 21A:
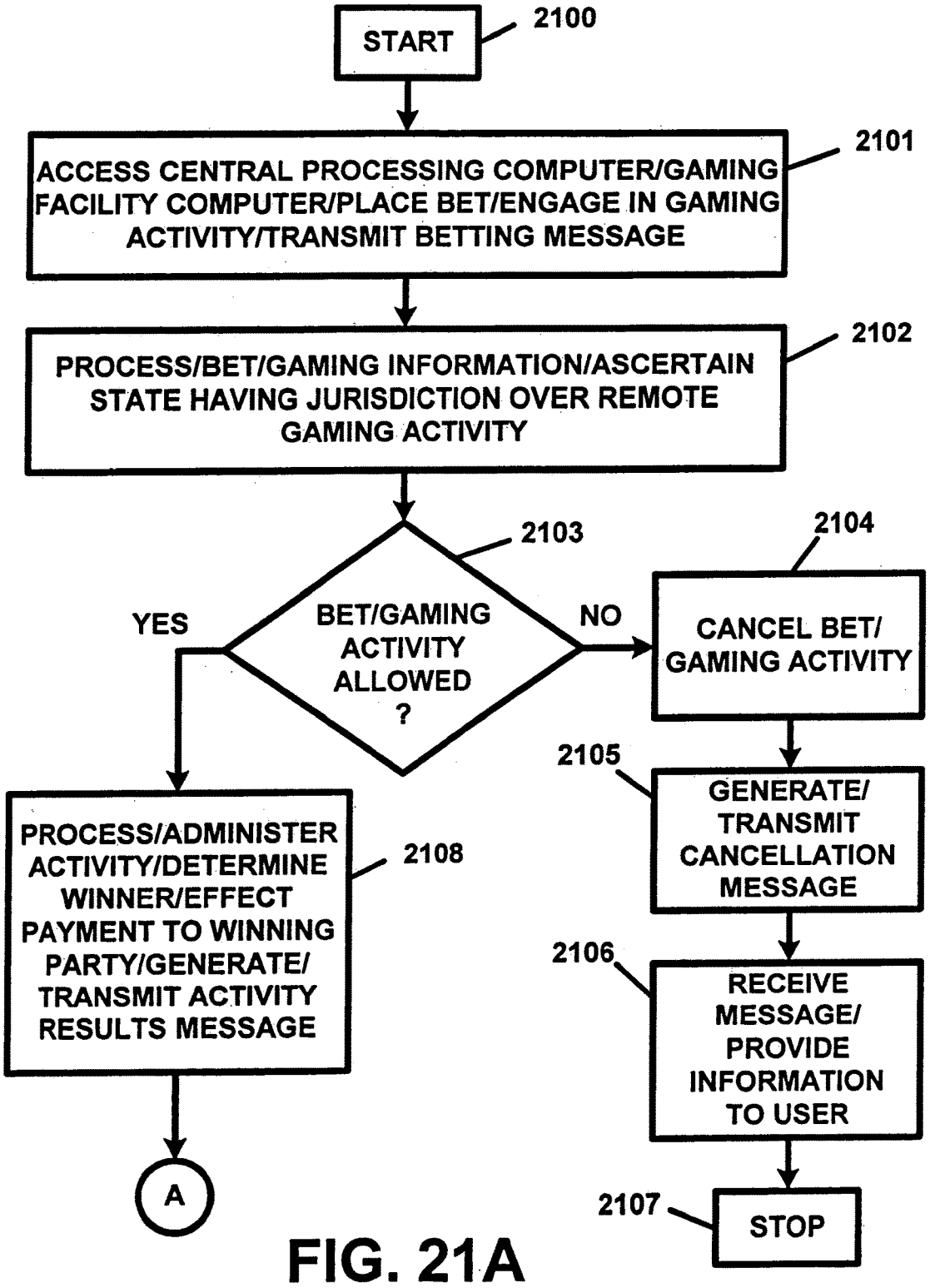
FIGS. 21A and 21B illustrate another preferred embodiment method for utilizing the apparatus and method of the present invention, in flow diagram form.
Figure 21B:
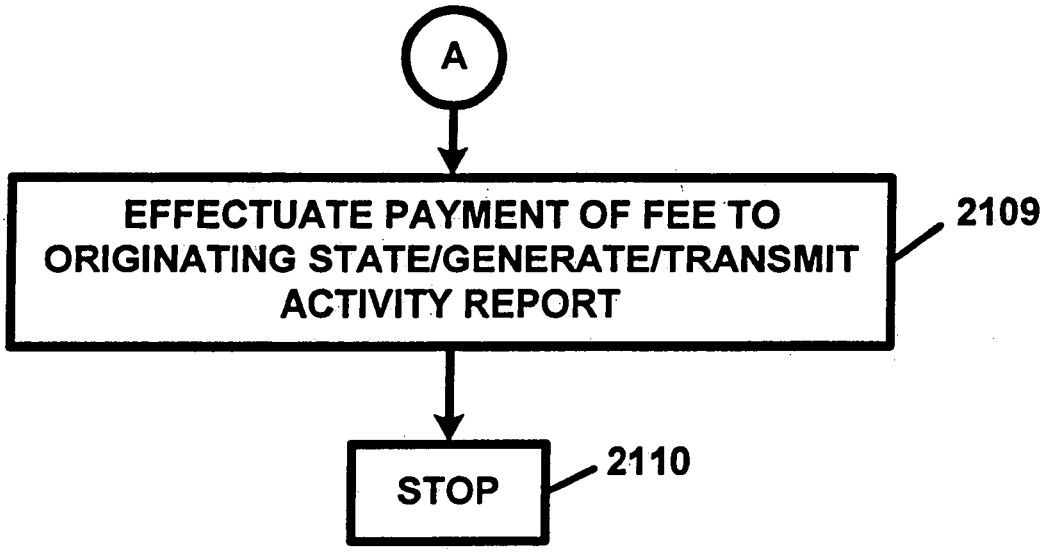

FIGS. 21A and 21B illustrate another preferred embodiment method for utilizing the apparatus 100 and method of the present invention, in flow diagram form. With reference to FIGS. 21A and 21B, the operation of the apparatus 100 commences at step 2100. At step 2101, a user can access a respective central processing computer 10 and/or gaming facility computer 30 via the user communication device 20 and place a bet, wager, and/or otherwise engage in gaming activity and/or gambling activity. At step 2101, the user can transmit a betting message from the user communication device 20 to the respective central processing computer 10 and/or gaming facility computer 30. The betting message can contain information regarding the bet, wager, gaming activity, or gambling activity.

The respective central processing computer 10 and/or gaming facility computer 30 can be located on board the vehicle and/or can be located remote from the vehicle and/or on board a different vehicle. At step 2101, the information regarding the user's bet, wager, and/or gaming activity, can include a payment identifier for the amount of the bet, wager, and/or gaming activity, and/or a payment identifier for payment of any gaming fee or fees to the originating state, if applicable.

At step 2102, the respective central processing computer 10 and/or gaming facility computer 30 can process the information regarding the user's bet and/or gaming activity and effectuate the placing of the user's bet and/or gaming activity. At step 2102, the respective central processing computer 10 and/or gaming facility computer 30 can ascertain the state having jurisdiction over the remote gaming activity and/or gambling activity.

At step 2102, the respective central processing computer 10 and/or gaming facility computer 30 can ascertain the position or location of the user communication device 20. The position or location information regarding the position or location of the user communication device 20 can be transmitted from the user communication device 20 after being determined by a global positioning device 20J associated with the user communication device 20 and/or by a global positioning device associated with the vehicle carrying the user and/or the user communication device 20.

The position or location information regarding the position or location of the respective central processing computer 10 and/or gaming facility computer 30 can be determined by a global positioning device 10J or 30J, respectively, associated with the respective central processing computer 10 and/or gaming facility computer 30 and/or by a global positioning device associated with the vehicle carrying the respective central processing computer 10 and/or gaming facility computer 30.

In another preferred embodiment, any position and/or location information regarding any of the herein user communication devices 20, central processing computers 10 and/or gaming facility computers 30, can be ascertained beforehand and stored in a respective central processing computer 10 and/or gaming facility computer 30.

In another preferred embodiment, such as in a case when a user is placing bets from the vehicle, wherein the user's location may change at any time, the user communication device 20 can be programmed to automatically transmit new or updated position data and/or information along with the signal containing information regarding the user's bet, wager and/or gaming activity. In this manner, the respective central processing computer 10 and/or gaming facility computer 30, at step 2002, can both process the user's bet, wager, and/or gaming activity and ascertain the state which has jurisdiction over the remote gaming activity and/or gambling activity.

In another preferred embodiment, such as in a case when a respective central processing computer 10 and/or gaming facility computer 30 is on an airplane, boat, cruise ship, train, or automobile, etc., wherein the location of the respective central processing computer 10 and/or gaming facility computer 30 may change at any time, the respective central processing computer 10 and/or gaming facility computer 30 can be programmed to automatically determine new and/or updated position data and/or information regarding the respective central processing computer 10 and/or gaming facility computer 30.

In the above-described manner, the apparatus 100 can determine any and/or all applicable jurisdictions in which gaming activity and/or gambling activity is taking place.

At step 2103, the respective central processing computer 10 and/or gaming facility computer 30 can determine if the remote gaming activity and/or gambling activity, from the perspective of all interested parties, including the user, the central processing computer, if utilized, the gaming facility computer, if utilized, and/or the gaming facility, if applicable, is allowed by the state having jurisdiction over the remote gaming activity and/or gambling activity of the user, and/or the respective central processing computer 10 and/or the gaming facility computer 30.

If, at step 2103, the respective central processing computer 10 and/or gaming facility computer 30 determines that the remote gaming activity and/or gambling activity is disallowed by the identified state having jurisdiction over the user communication device 20, and/or by the identified state having jurisdiction over the over the respective central processing computer 10 and/or the gaming facility computer 30, then the operation of the apparatus 100 will proceed to step 2104 and the respective central processing computer 10 and/or gaming facility computer 30 will cancel the respective bet, wager, and/or gaming activity and/or gambling activity.

At step 2105, the respective central processing computer 10 and/or gaming facility computer 30 will generate a gaming activity cancellation message and transmit same to the user communication device 20. At step 2106, the user communication device 20 will receive the gaming activity cancellation message and the information contained therein can be provided to the user. Thereafter, the operation of the apparatus 100 will cease at step 2107.

If, however, at step 2103, the respective central processing computer 10 and/or gaming facility computer 30 determines that the remote gaming activity and/or gambling activity is allowed by the identified state having jurisdiction the user communication device 20 and by the identified state having jurisdiction over the respective central processing computer 10 and/or gaming facility computer 30, then the operation of the apparatus 100 will proceed to step 2108 and the respective central processing computer 10 and/or gaming facility computer 30 will place, process and/or administer, the respective gaming activity and/or gambling activity.

At step 2108, the respective central processing computer 10 and/or gaming facility computer 30 can determine the winner of the bet, wager, or gaming activity and effectuate payment of the proceeds to the winning party.

At step 2108, the respective central processing computer 10 and/or gaming facility computer 30 can also generate an activity results message and transmit same to the user communication device 20 which can receive the activity results message and provide information contained therein to the user. At step 2109, the respective central processing computer 10 and/or gaming facility computer 30 can effectuate payment of any gaming fee and/or gambling fee for the remote gaming activity and/or gambling activity to the state having jurisdiction over the user communication device 20 and to the state having jurisdiction over the respective central processing computer 10 and/or gaming facility computer 30, if applicable.

In a preferred embodiment, the payment of any fee or fees to the state having jurisdiction over the user communication device 20 and to the state having jurisdiction over the respective central processing computer 10 and/or gaming facility computer 30, if applicable, can be effectuated by an electronic monetary transmission and/or electronic transfer from the respective central processing computer 10 and/or gaming facility computer 30 to the governmental entity computer 60 associated with the originating state.

In another preferred embodiment, any other accounting methods (i.e. account crediting, etc.) can also be utilized in order to effectuate a payment or payments to the state having jurisdiction over the user communication device 20 and to the state having jurisdiction over the respective central processing computer 10 and/or gaming facility computer 30, if applicable. At step 2109, the respective central processing computer 10 and/or gaming facility computer 30 can also transmit an activity report containing information regarding the time of the gaming activity and/or gambling activity, the location of origination of the gaming activity and/or gambling activity, the user involved, the gaming facility involved, the amount of the bet or wager, the activity or game which was the subject of the bet, wager, and/or gaming activity, the amount to the fee paid, the amount of a user's winning for reporting purposes and/or for tax reporting purposes, and/or any other information which may be of interest or use to the state having jurisdiction over the user communication device 20 and to the state having jurisdiction over the respective central processing computer 10 and/or gaming facility computer 30, if applicable.

At step 2109, a message containing any and/or all of the information described herein as being provided to the governmental entity computer 60 of the state or states can also be transmitted to the user communication device 20. In another preferred embodiment, the fee payable to the state having jurisdiction over the user communication device 20 and to the state having jurisdiction over the respective central processing computer 10 and/or gaming facility computer 30, if applicable, can be a portion of the amount bet by the user and/or can be a portion of the amount won by the user and/or by the gaming facility. In another embodiment, the fee can be paid from a gaming activity license fund and/or a gambling activity license fund which can be associated with the user and/or with the gaming facility and which can be administered by the respective central processing computer 10 and/or gaming facility computer 30.

In another preferred embodiment, the user can transmit payment for, and/or an authorization for payment for, the requisite fee to the respective central processing computer 10 and/or gaming facility computer 30 along with the user's bet or wager which was transmitted to the respective central processing computer 10 and/or gaming facility computer 30 at step 2101.

Thereafter, the operation of the apparatus 100 will cease at step 2110.

In another preferred embodiment, the apparatus 100 and method of the present invention can also be utilized in order to allow a user to purchase lottery tickets for lotteries in any number of states and/or countries. As indicated above, the term "state" means any state, region, territory, and/or possession of the United States of America, any nation, country, sovereign state, monarchy, principality, and/or any region, territory, possession, and/or subdivision of same.

In a preferred embodiment, the user can access a respective central processing computer 10 and/or gaming facility computer 30 and purchase a lottery tickets in any one or more state lotteries via the user communication device 20. In a preferred embodiment, the user can access the respective central processing computer 10 and/or gaming facility computer 30 at any time at his or her own initiative. In another preferred embodiment, the user can pre-program the respective central processing computer 10 and/or gaming facility computer 30 to provide him or her with an alert, in real-time and/or otherwise, when a lottery is available and/or when a lottery prize reaches a certain prize amount.

The respective central processing computer 10 and/or gaming facility computer 30 can transmit a notification message to the user's user communication device 20. In a preferred embodiment, the notification message can contain a link to the respective central processing computer 10 and/or gaming facility computer 30. In another preferred embodiment, the user can access the respective central processing computer 10 and/or gaming facility computer 30 and purchase a ticket or tickets for the respective lottery.

In another preferred embodiment, the respective central processing computer 10 and/or gaming facility computer 30 can monitor the results of the various state lotteries and receive any winnings on behalf of the user which can be electronically transferred into the user's gaming account. In another preferred embodiment, the respective central processing computer 10 and/or gaming facility computer 30 can generate a lottery results message and transmit same to the user communication device 20.

In another preferred embodiment, the respective central processing computer 10 and/or gaming facility computer 30 can also perform any and/or all of the gaming account administration processing routines and/or functionality such as, but not limited to, recording a user's winnings, recording a user's losses, recording a user's net winnings, recording a user's net losses, reporting a user's winnings and/or losses to appropriate taxing authorities, withholding income taxes for a user, or paying withholding taxes to a taxing authority, etc.

In a preferred embodiment, the respective central processing computer 10 and/or gaming facility computer 30 can be linked with one or more governmental entity computers 60 for any one or more of purchasing lottery tickets, receiving lottery game results, receiving electronic transfers of a user's winnings on behalf of the user, paying via electronic transfer a user's withholding taxes and/or income taxes on winnings, and reporting the user's gaming activities to an appropriate governmental entity computer 60 associated with the appropriate governmental authority and/or taxing authority.

Figure 22A:
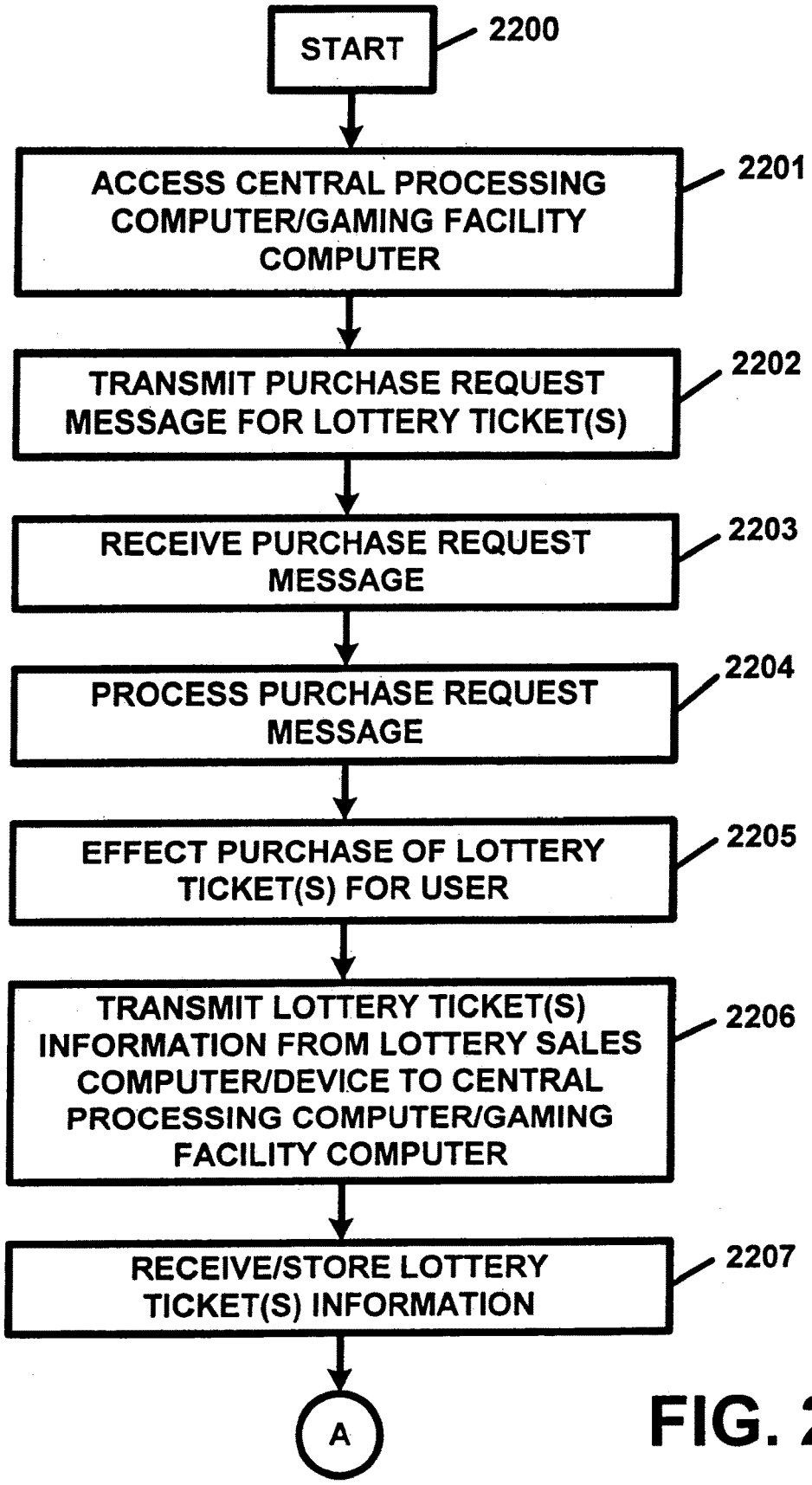
FIGS. 22A, 22B and 22C illustrate still another preferred embodiment method for utilizing the apparatus and method of the present invention, in flow diagram form.
Figure 22B:
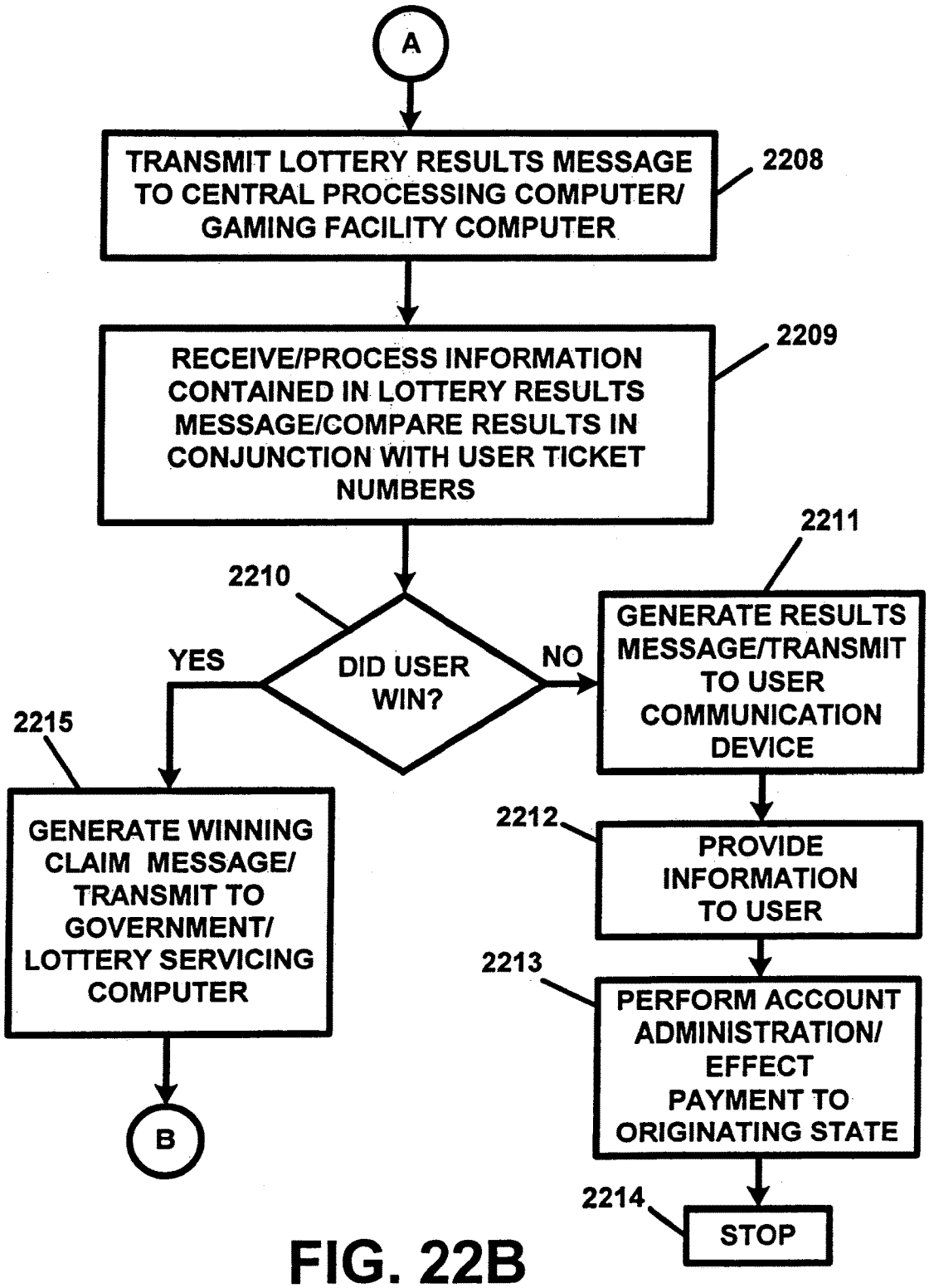
Figure 22C:
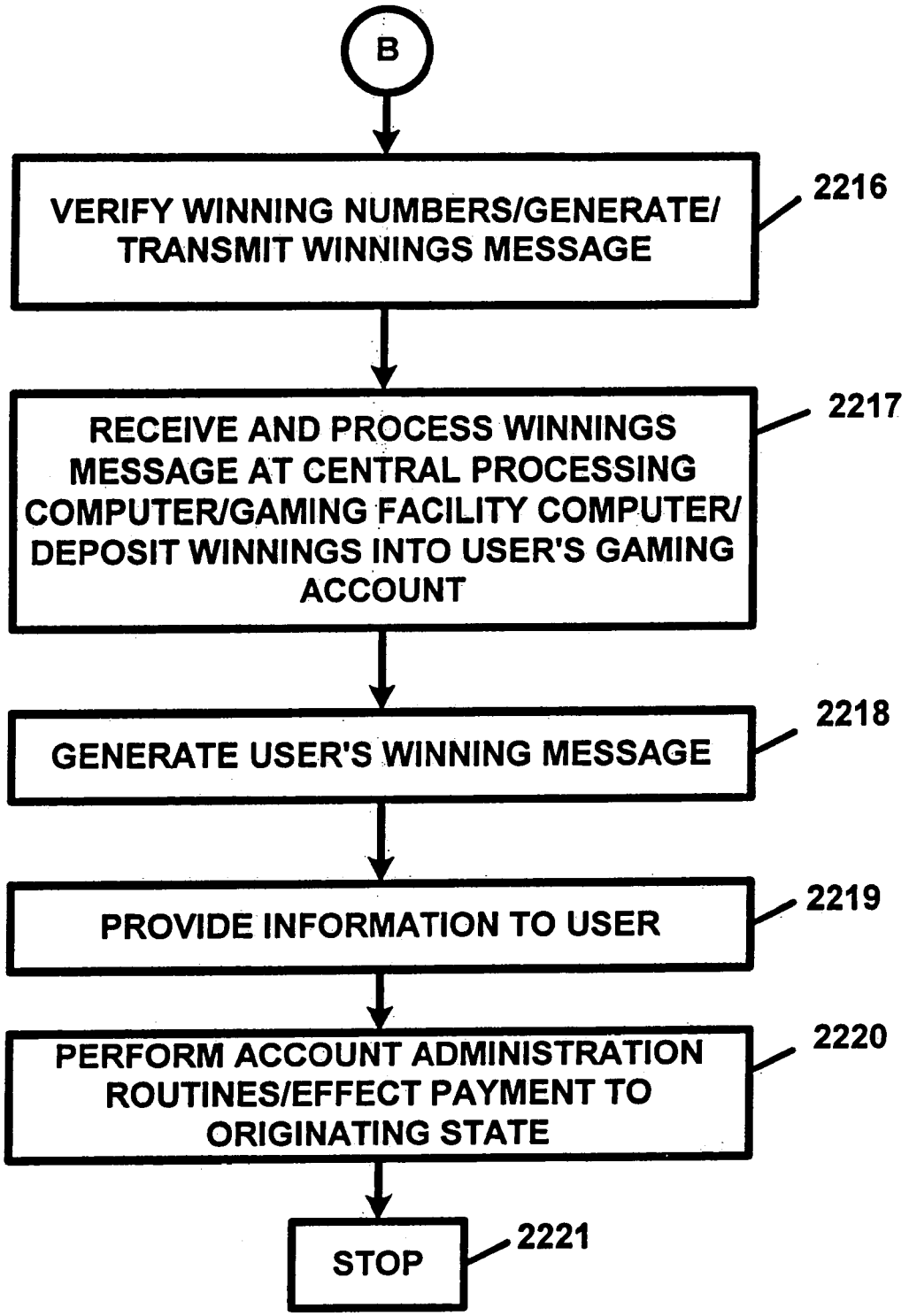

FIGS. 22A, 22B and 22C illustrate another preferred embodiment method for utilizing the apparatus 100 and method of the present invention, in flow diagram form. With reference to FIGS. 22A, 22B and 22C, the operation of the apparatus commences at step 2200. At step 2201, the user can access the respective central processing computer 10 and/or gaming facility computer 30. In a preferred embodiment, the user can access the respective central processing computer 10 and/or gaming facility computer 30 via the user communication device 20 at any time at his or her own initiative.

In another preferred embodiment, the user can program the respective central processing computer 10 and/or gaming facility computer 30 via the user communication device 20 in order to receive notification of the availability of a lottery game in any one or more states.

In the preferred embodiment, the various lottery games can have governmental entity computer 60 associated therewith which can be linked to the respective central processing computer 10 and/or gaming facility computer 30. Each time a new lottery game is available, each time a new lottery game prize is available, the respective central processing computer 10 and/or gaming facility computer 30 can be notified from the respective governmental entity computer 60. The user can program the respective central processing computer 10 and/or gaming facility computer 30 to notify him or her of the availability of a new lottery game and/or of a lottery game with a new and/or updated prize.

The respective central processing computer 10 and/or gaming facility computer 30, upon detecting the posting or availability of a new lottery game and/or of a lottery game with a new and/or updated prize, can generate a notification message and transmit same to the user communication device 20. Thereafter, the user can link to the respective central processing computer 10 and/or gaming facility computer 30 and/or access the respective central processing computer 10 and/or gaming facility computer 30.

In the preferred embodiment, the respective central processing computer 10 and/or gaming facility computer 30 can post lottery games and/or lottery game information for any number of states and/or countries.

At step 2201, the user can access the respective central processing computer 10 and/or gaming facility computer 30 upon his or her own initiative and/or upon receiving a notification message from the respective central processing computer 10 and/or gaming facility computer 30.

At step 2202, the user can transmit a purchase request message for a lottery ticket and/or lottery tickets for each lottery game in which the user desires to play. The purchase request message can contain information identifying the user's gaming account and/or can contain a payment identifier for effecting payment for the requested lottery ticket and/or lottery tickets. The purchase request message can also contain the numbers which the user desires to play or a request for a "QUICKPICK" or an automatic and/or a random selection of the numbers to be played by the respective lottery sales machine and/or corresponding governmental entity computer 60.

The purchase request message can also contain and/or can be accompanied by position or location data and/or information which is generated by and/or transmitted from the user communication device global positioning device 20J. The position or location data and/or information can also be pre-stored and/or can be a pre-set position if the device 20 is stationary. The position or location data and/or information can also be utilized in order to determine an originating state for the gaming activity, as described in previous embodiments, which can also be utilized for effectuating payment for a gaming activity fee and/or gambling activity fee to the state from which the user's gaming activity and/or gambling activity originates (i.e. the state from which the user remotely purchases the lottery ticket or lottery tickets).

In the preferred embodiment, at step 2202, the user can transmit any number purchase request messages, with each purchase request message corresponding to a particular lottery game and/or lottery games. At step 2202, the user can purchase a lottery ticket or lottery tickets for as many of the posted lottery games as he or she desires.

At step 2203, the respective central processing computer 10 and/or gaming facility computer 30 will receive each of and/or all of the purchase request messages transmitted from the user communication device 20. At step 2204, the respective central processing computer 10 and/or gaming facility computer 30 will process each of and/or all of the purchase request messages transmitted from the user communication device 20.

At step 2205, the respective central processing computer 10 and/or gaming facility computer 30 will purchase the requested lottery ticket and/or lottery tickets for each of the lottery games designated by the user. At step 2205, the respective central processing computer 10 and/or gaming facility computer 30 can effectuate an electronic purchase of the respective lottery ticket and/or lottery tickets from each respective governmental entity computer 60 corresponding to a particular lottery.

At step 2205, the respective central processing computer 10 and/or gaming facility computer 30 can effectuate payment from the user's gaming account and/or with the payment identifier provided by the user in the purchase request message.

At step 2206, the governmental entity computer 60 for each of the lotteries for which tickets were purchased can transmit an electronic lottery ticket and/or electronic lottery tickets containing the picked and/or automatically picked numbers for each lottery game and a time-stamped electronic receipt of the user's purchase. At step 2207, the respective central processing computer 10 and/or gaming facility computer 30 will receive the electronic lottery ticket and/or electronic lottery tickets for and/or on behalf of the user for each designated lottery game and/or lottery games.

At step 2207, the respective central processing computer 10 and/or gaming facility computer 30 will, for all of the lottery games played, store the information contained in the electronic lottery ticket and/or electronic lottery tickets in the user's record and/or files. Thereafter, the respective central processing computer 10 and/or gaming facility computer 30 will await the reporting of the winning numbers for each lottery game or lottery games played.

At step 2208, the respective governmental entity computer 60, for each respective lottery game played, upon the winning numbers being drawn and/or selected, will transmit a lottery results message to the respective central processing computer 10 and/or gaming facility computer 30. At step 2209, the respective central processing computer 10 and/or gaming facility computer 30 will receive the lottery results message, process the information contained in same, compare the results in conjunction with the ticket numbers for the lottery game stored in the user's file of records.

At step 2210, the respective central processing computer 10 and/or gaming facility computer 30 can determine if the user has won any prizes in the game (i.e. jackpot, first prize, second prize, or third prize, etc.). If, at step 2210, it is determined that the user has not won a prize, the respective central processing computer 10 and/or gaming facility computer 30 can, at step 2211, generate a results message containing information for notifying the user that he or she did not win.

At step 2211, the respective central processing computer 10 and/or gaming facility computer 30 can transmit the results message to the user communication device 20. At step 2212, the user communication device 20 can provide the information contained in the results message to the user. Thereafter, at step 2213, the respective central processing computer 10 and/or gaming facility computer 30 can perform any of the herein-described gaming account administration routines and/or functionality for, or on behalf of, the user, such as, for example, recording a user's winnings, recording a user's losses, recording a user's net winnings, recording a user's net losses, reporting a user's winnings and/or losses to appropriate taxing authorities, withholding income taxes for a user, or paying withholding taxes to a taxing authority, etc.

As noted herein, in a preferred embodiment, the respective central processing computer 10 and/or gaming facility computer 30 can be linked with one or more governmental entity computers 60 for any one or more of purchasing lottery tickets, receiving lottery game results, receiving electronic transfers of a user's winnings on behalf of the user, paying via electronic transfer a user's withholding taxes and/or income taxes on winnings, and reporting the user's gaming activities to an appropriate governmental entity computer 60 associated with the appropriate governmental authority and/or taxing authority.

At step 2213, the respective central processing computer 10 and/or gaming facility computer 30 can effectuate payment of any due gaming activity fee and/or gambling activity fee to the originating state.

Thereafter, the operation of the apparatus 100 will cease at step 2214.

If, at step 2210, it is determined that the user has won a prize, the respective central processing computer 10 and/or gaming facility computer 30 can, at step 2215 generate a winning claim message containing information contained in the user's electronic lottery ticket and/or electronic lottery tickets and transmit same to the respective governmental entity computer 60 servicing the subject lottery. At step 2216, the governmental entity computer 60 can verify the winning numbers, determine the amount of the user's winnings and generate a winnings message containing an electronic transfer of the winning funds.

At step 2216, the governmental entity computer 60 can transmit the winnings message to the respective central processing computer 10 and/or gaming facility computer 30. At step 2217, the respective central processing computer 10 and/or gaming facility computer 30 will receive and process the winnings message. At step 2217, the respective central processing computer 10 and/or gaming facility computer 30 will deposit the user's winnings into the user's gaming account.

At step 2218, the respective central processing computer 10 and/or gaming facility computer 30 will generate a user's winning massage containing information for notifying the user that he or she has won a prize and the amount of the prize. At step 2218, the respective central processing computer 10 and/or gaming facility computer 30 will transmit the user's winning massage to the user communication device 20. At step 2219, the information in the user's winning message can be provided to the user.

At step 2220, the respective central processing computer 10 and/or gaming facility computer 30 can perform any of the herein-described gaming account administration routines and/or functionality for, or on behalf of, the user, such as, for example, recording a user's winnings, recording a user's losses, recording a user's net winnings, recording a user's net losses, reporting a user's winnings and/or losses to appropriate taxing authorities, withholding income taxes for a user, or paying withholding taxes to a taxing authority, etc.

As noted herein, in a preferred embodiment, the respective central processing computer 10 and/or gaming facility computer 30 can be linked with one or more governmental entity computers 60 for any one or more of purchasing lottery tickets, receiving lottery game results, receiving electronic transfers of a user's winnings on behalf of the user, paying via electronic transfer a user's withholding taxes and/or income taxes on winnings, and reporting the user's gaming activities to an appropriate governmental entity computer 60 associated with the appropriate governmental authority and/or taxing authority. At step 2220, the respective central processing computer 10 and/or gaming facility computer 30 can effectuate payment of any gaming activity fee and/or gambling activity fee due to the originating state.

Thereafter, the operation of the apparatus 100 will cease at step 2221.

The above steps can be repeated from step 2208 for each lottery game played by the user.

In another preferred embodiment, the apparatus 100 and method of the present invention can also be utilized in order to allow a user to identify and/or locate a gaming activity, a gaming event, a gambling activity, and/or a gambling event, to bet or wager on and/or to locate a counterparty or counterparties interested in betting and/or wagering on a gaming activity, a gaming event, a gambling activity, and/or a gambling event. In another preferred embodiment, the apparatus 100 and method of the present invention can also be utilized in order to allow users to engage in private bets, private gaming activity, private gaming events, private gambling activities, and/or private gambling events, with other users. For example, a user may desire to bet on a sporting event or game (i.e. college football game or professional football game) and may desire to find a counterparty to the bet.

The apparatus 100 and method of the present invention can also be utilized in order to allow the user to post his or her bet for a certain gaming activity, gaming event, gambling activity, and/or gambling event, on a respective central processing computer 10 and/or gaming facility computer 30. For example, a user desiring to bet on a professional or college football game can post his desire to bet a certain amount on a certain team to win. The user can also post the odds or spread he is willing to give in the bet. Thereafter, the user's posted bet can be available to another user or other users who may subsequently access the respective central processing computer 10 and/or gaming facility computer 30 in search of such a bet on the certain gaming activity, gaming event, gambling activity, and/or gambling event.

In another embodiment, a user can program the respective central processing computer 10 and/or gaming facility computer 30 to notify him or her if and/or when another user posts a certain bet for a certain gaming activity, gaming event, gambling activity, and/or gambling event. Upon the posting of the bet for the certain gaming activity, gaming event, gambling activity, and/or gambling event, the respective central processing computer 10 and/or gaming facility computer 30 can generate and transmit a notification message to the requesting user. Thereafter, the user may access the respective central processing computer 10 and/or gaming facility computer 30 and may decide to be that counterparty or one of the counterparties to the particular bet on the particular gaming activity, gaming event, gambling activity, and/or gambling event.

In another preferred embodiment, the respective central processing computer 10 and/or gaming facility computer 30 can determine whether the respective bet, gaming activity, gaming event, gambling activity, and/or gambling event, is legal in all appropriate jurisdictions. If the respective bet, gaming activity, gaming event, gambling activity, and/or gambling event, is determined to be illegal in at least one jurisdiction, the respective central processing computer 10 and/or gaming facility computer 30 can prevent the respective bet, gaming activity, gaming event, gambling activity, and/or gambling event, from being posted and/or from being made available in conjunction with the apparatus 100.

In another preferred embodiment, the respective central processing computer 10 and/or gaming facility computer 30 can administer the bet or bets. In a preferred embodiment, the bets of the individual users can be placed held by and/or secured by utilizing an escrow agent computer 50. For example, the individual users bets can be placed in an escrow account administered by an escrow agent computer 50.

Figure 23A:
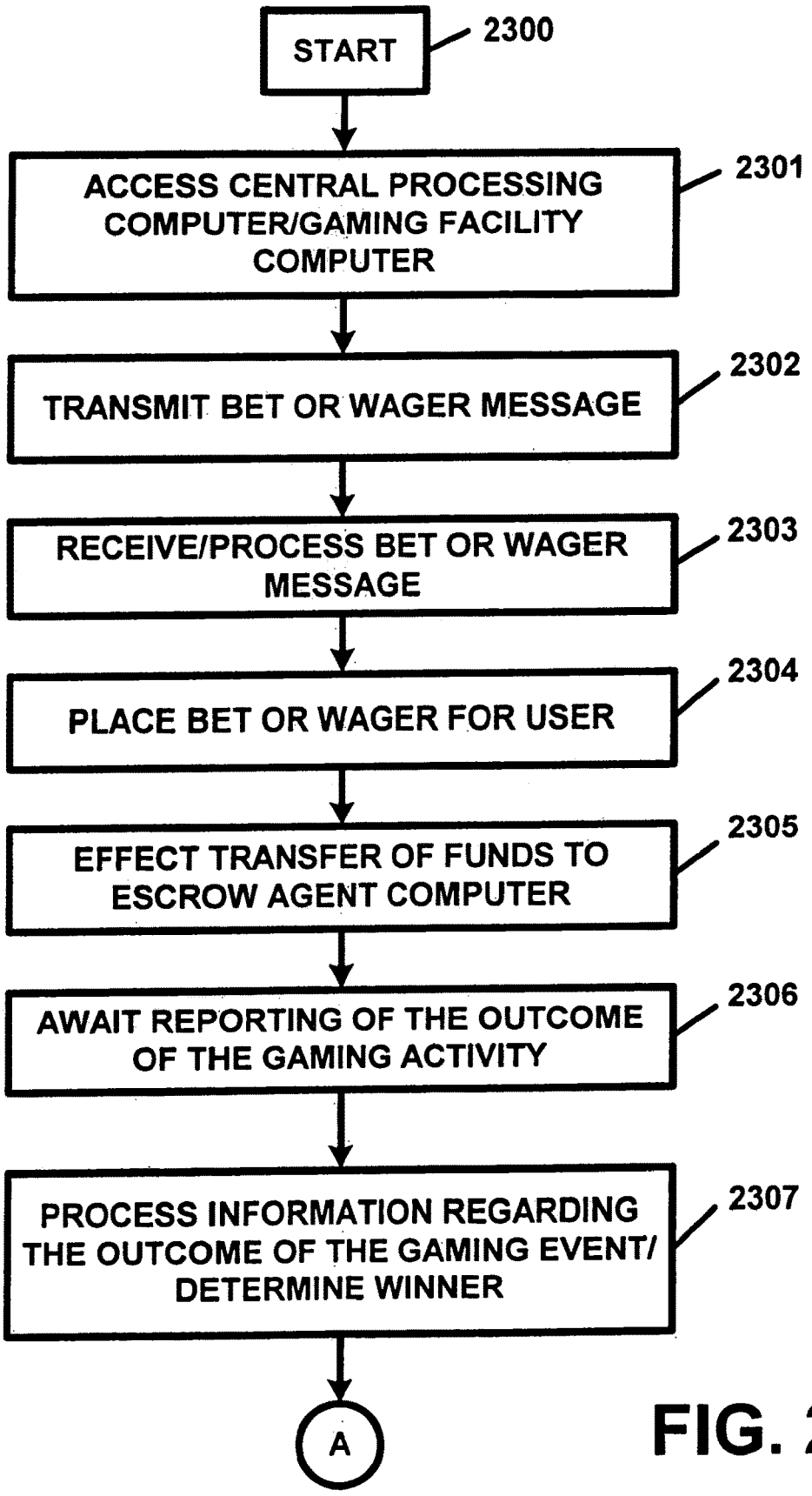
FIGS. 23A and 23B illustrate yet another preferred embodiment method for utilizing the apparatus and method of the present invention, in flow diagram form.
Figure 23B:
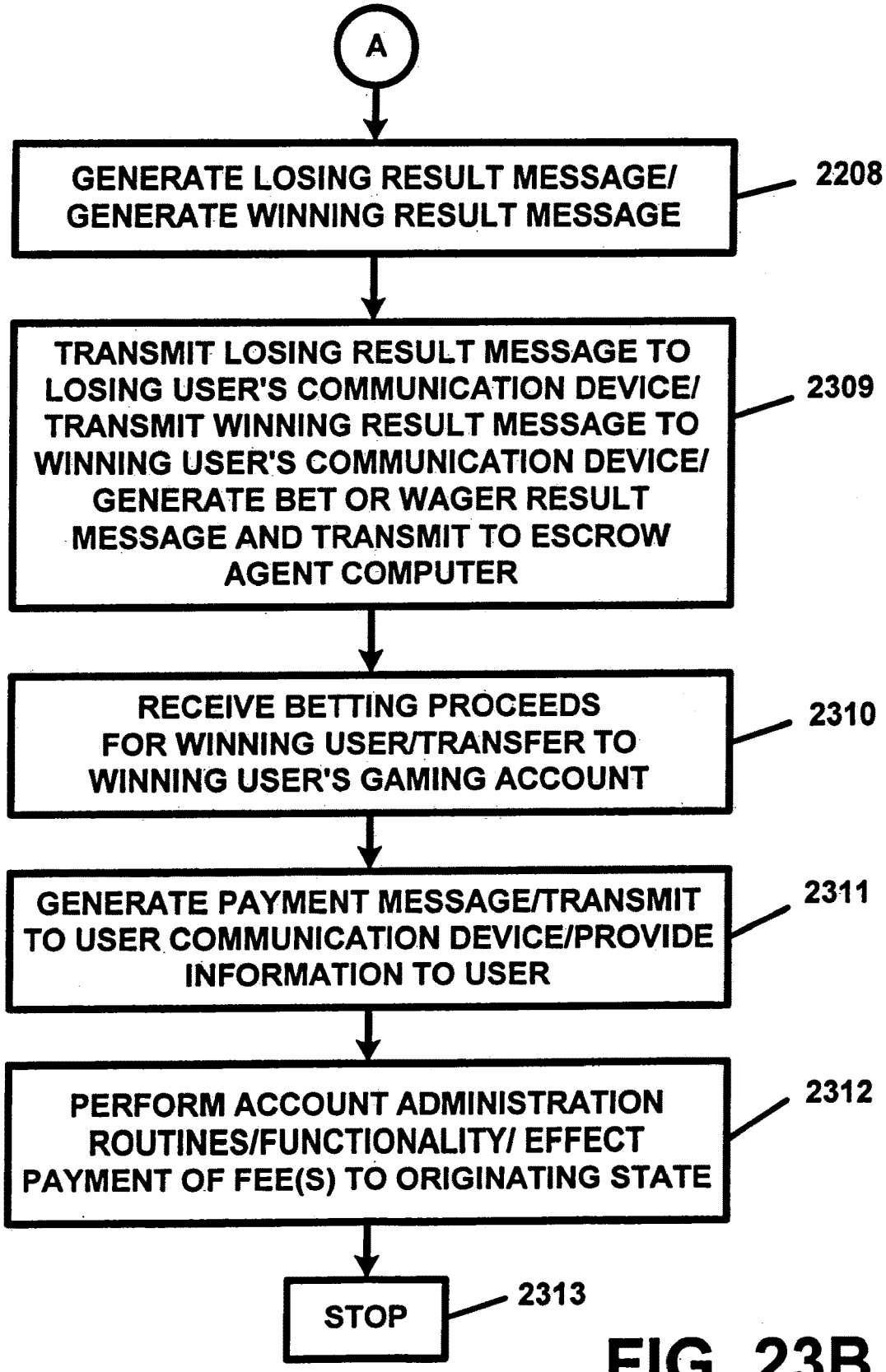

FIGS. 23A and 23B illustrate another preferred embodiment method for utilizing the apparatus 100 and method of the present invention, in flow diagram form. With reference to FIGS. 23A and 23B, the operation of the apparatus commences at step 2300. At step 2301, the user can access the respective central processing computer 10 and/or gaming facility computer 30. In a preferred embodiment, the user can access the respective central processing computer 10 and/or gaming facility computer 30 via the user communication device 20 at any time at his or her own initiative.

In another preferred embodiment, the user can program the respective central processing computer 10 and/or gaming facility computer 30 via the user communication device 20 in order to receive notification of the posting and/or availability of a bet, a wager, a gaming activity, a gaming event, a gambling activity, and/or a gambling event, which was previously posted by another user.

In the preferred embodiment, the bet, wager, gaming activity, gaming event, gambling activity, and/or gambling event, can be posted and/or made available, via a user computer 20, on the respective central processing computer 10 and/or gaming facility computer 30. A user can program the respective central processing computer 10 and/or gaming facility computer 30 to notify him or her of the availability of the bet, wager, gaming activity, gaming event, gambling activity, and/or gambling event.

The respective central processing computer 10 and/or gaming facility computer 30, upon detecting the posting or availability of the bet, wager, gaming activity, gaming event, gambling activity, and/or gambling event, can generate a notification message and transmit same to the user communication device 20. Thereafter, the user can link to the respective central processing computer 10 and/or gaming facility computer 30 and/or access the respective central processing computer 10 and/or gaming facility computer 30.

In the preferred embodiment, the respective central processing computer 10 and/or gaming facility computer 30 can post any number and/or kinds of bets, wagers, gaming activities, gaming events, gambling activities, and/or gambling events.

Another user or users can place a bet or wager as a counterparty or counterparties to the bet for any of the bets on a posted gaming activity, gaming event, gambling activity, and/or gambling event.

At step 2301, the user can access the respective central processing computer 10 and/or gaming facility computer 30 upon his or her own initiative and/or upon receiving a notification message from the respective central processing computer 10 and/or gaming facility computer 30.

At step 2302, the user can transmit a bet or wager message for the bet, wager, gaming activity, gaming event, gambling activity, and/or gambling event. The bet or wager message can contain information identifying the user's gaming account and/or can contain a payment identifier for effecting payment for the requested bet or wager. The bet or wager message can also be accompanied by position or location data and/or information which can be generated by and/or transmitted from the user communication device global positioning device 20J.

The position or location data and/or information can also be pre-stored or can be a pre-set position or location if the device 20 is stationary. The position or location data and/or information can also be utilized in order to determine an originating state for the gaming activity, as described in previous embodiments, which can also be utilized for effectuating payment of a gaming activity fee and/or gambling activity fee to the state from which the user's gaming activity and/or gambling activity originates (i.e. the state from which the user remotely places the respective bet or wager.

At step 2303, the respective central processing computer 10 and/or gaming facility computer 30 will receive and process the bet or wager message transmitted from the user communication device 20. At step 2304, the respective central processing computer 10 and/or gaming facility computer 30 will place the bet or wager. At step 2305, the respective central processing computer 10 and/or gaming facility computer 30 can effectuate an electronic transfer of funds to an escrow agent computer 50 which will serve as an escrow agent for the bet, wager, gaming activity, gaming event, gambling activity, and/or gambling event.

At step 2305, the respective central processing computer 10 and/or gaming facility computer 30 can effectuate payment from the user's gaming account and/or with the payment identifier provided by the user in the bet or wager message.

At step 2306, the respective central processing computer 10 and/or gaming facility computer 30 will await the reporting of the outcome of the gaming activity, gaming event, gambling activity, and/or gambling event.

At step 2307, the respective central processing computer 10 and/or gaming facility computer 30 will process information regarding the outcome of the gaming activity, gaming event, gambling activity, and/or gambling event and determine the winning user or users. At step 2307, the respective central processing computer 10 and/or gaming facility computer 30 can determine which of the users has won the bet or wager.

At step 2308, the respective central processing computer 10 and/or gaming facility computer 30 can generate a losing result message containing information for notifying the user who lost the bet or wager. At step 2308, the respective central processing computer 10 and/or gaming facility computer 30 can also generate a winning result message containing information for notifying the user who won the bet or wager.

At step 2309, the respective central processing computer 10 and/or gaming facility computer 30 can transmit the losing result message to the user communication device 20 associated with the losing user. At step 2309, the respective central processing computer 10 and/or gaming facility computer 30 can transmit the winning result message to the user communication device 20 associated with the winning user.

At step 2309, the respective central processing computer 10 and/or gaming facility computer 30 can also generate a bet or wager result message and transmit the bet or wager result message to the escrow agent computer 50. In the preferred embodiment, the bet or wager result message can contain information for instructing the escrow agent computer 50 to effectuate an electronic transfer of the betting proceeds to the respective central processing computer 10 and/or gaming facility computer 30.

At step 2309, the escrow agent computer 50 can effectuate the electronic fund transfer of the betting proceeds to the respective central processing computer 10 and/or gaming facility computer 30. At step 2309 the user communication device 20 associated with the winning user can provide the information contained in the winning result message to the winning user. At step 2309 the user communication device 20 associated with the losing user can provide the information contained in the losing result message to the winning user.

At step 2310, the respective central processing computer 10 and/or gaming facility computer 30 will receive the electronic fund transfer of the betting proceeds for, or on behalf of, the winning user. At step 2310, the respective central processing computer 10 and/or gaming facility computer 30 can store the betting proceeds in, and/or effectuate the transfer of the betting proceeds to, the winning user's gaming account.

At step 2311, the respective central processing computer 10 and/or gaming facility computer 30 can generate a payment message containing information regarding the payment to the winning user's gaming account and transmit same to the user communication device 20 associated with the winning user. Thereafter, the user communication device 20 can receive the payment message and provide information contained therein to the user.

At step 2312, the respective central processing computer 10 and/or gaming facility computer 30 can perform any of the herein-described gaming account administration routines and/or functionality for, or on behalf of, the winning user or winning users and/or for the losing user or losing users, such as, for example, recording a user's winnings, recording a user's losses, recording a user's net winnings, recording a user's net losses, reporting a user's winnings and/or losses to appropriate taxing authorities, withholding income taxes for a user, or paying withholding taxes to a taxing authority, etc., for each of, or for any of, the respective users.

As noted herein, in a preferred embodiment, the respective central processing computer 10 and/or gaming facility computer 30 can be linked with one or more governmental entity computers 60 for paying, via electronic transfer, a user's withholding taxes and/or income taxes on winnings, and/or for reporting a user's gaming activities to an appropriate governmental entity computer 60 associated with the appropriate governmental authority and/or taxing authority.

At step 2312, the respective central processing computer 10 and/or gaming facility computer 30 can also, for any and/or all of the respective users, effectuate payment of any required gaming activity fee and/or gambling activity fee due to a respective originating state.

Thereafter, the operation of the apparatus 100 will cease at step 2313.

In view of the foregoing, the apparatus 100 and method of the present invention can also be utilized in order to facilitate gaming activity and/or gambling activity in numerous preferred embodiments. The apparatus 100 and method of the present invention can also be utilized in order to facilitate gaming activity and/or gambling activity by remote users or players who can be located anywhere in the world and/or who can be located at any physical distance from a respective gaming facility, gaming activity, gaming event, gambling activity, and/or gambling event.

In any and/or all of the preferred embodiments described herein, the apparatus and method of the present invention can also be utilized in conjunction with any one or combination of the Internet, the World Wide Web, a telecommunication network, a satellite communication network, a cable television network, a satellite television network, a digital television network, a digital communication network, a radio frequency network, a broadband network, an optical communication network, and/or any other communication network described herein and/or otherwise, in order to allow users or players to engage in gaming activity and/or gambling activity.

The apparatus 100 and method of the present invention can also be utilized in order to provide any of the herein-described products and/or services via a web site or web sites associated with any of the respective central processing computers 10, gaming facility computers 30, financial institution computers 40, escrow agent computers 50, and/or governmental entity computers 60, described herein.

In any and/or all of the embodiments described herein, any of the herein-described signals, messages, reports, notifications, transaction reports, notification messages, gaming activity notification messages, service report messages, gaming derivative messages, gaming loss insurance messages, offering messages, activity results messages, activity reports, results messages, user's winning messages, losing result messages, winning result messages, payment messages, or any other signals, notifications, messages, or reports, described herein, can contain an advertisement or advertisements.

While the present invention has been described and illustrated in various preferred and alternate embodiments, such descriptions are merely illustrative of the present invention and are not to be construed to be limitations thereof. In this regard, the present invention encompasses all modifications, variations, and/or alternate embodiments, with the scope of the present invention being limited only by the claims which follow.

What is claimed is:

1. An apparatus, comprising:

a computer, wherein the computer is specially programmed for processing information for providing for a placement of a bet on or regarding a gaming activity, a gambling activity, or a sporting event, wherein the computer detects a posting of information regarding the gaming activity, the gambling activity, or the sporting event, and further wherein the computer generates a notification message regarding the gaming activity, the gambling activity, or the sporting event, wherein, in response to a generating of the notification message, the computer initiates a communication link with a first communication device and transmits the notification message to the first communication device as an electronic transmission, or the computer transmits the notification message as an electronic mail message, wherein the electronic mail message is received by or received at a first communication device, wherein the first communication device is associated with an individual, wherein the computer receives a bet message transmitted from the first communication device or from a second communication device, wherein the second communication device is associated with the individual, and further wherein the first communication device or the second communication device comprises a global positioning device, wherein the global positioning device determines a position or location of the first communication device or the second communication device, wherein the bet message contains information regarding a bet to be placed on or regarding the gaming activity, the gambling activity, or the sporting event, and information regarding the position or location of the first communication device or the second communication device, wherein the computer determines if the bet is allowed or disallowed using the information regarding the position or location of the first communication device or the second communication device and, if the bet is allowed, the computer processes information for placing the bet for or on behalf of the individual, or, if the bet is disallowed, the computer processes information for disallowing the bet.

2. A computer-implemented method, comprising:

detecting, with or using a computer which is specially programmed for processing information for providing for a placement of a bet on or regarding a gaming activity, a gambling activity, or a sporting event, a posting of information regarding the gaming activity, the gambling activity, or the sporting event;

generating, with or using the computer, a notification message regarding the gaming activity, the gambling activity, or the sporting event;

initiating, with or using the computer, a communication link with a first communication device and transmitting the notification message to the first communication device as an electronic transmission, or transmitting, from the computer, the notification message as an electronic mail message, wherein the electronic mail message is received by or received at a first communication device, wherein the first communication device is associated with an individual;

receiving, with the computer, a bet message transmitted from the first communication device or from a second communication device, wherein the second communication device is associated with the individual, and further wherein the first communication device or the second communication device comprises a global positioning device, wherein the global positioning device determines a position or location of the first communication device or the second communication device, and further wherein the bet message contains information regarding a bet to be placed on or regarding the gaming activity, the gambling activity, or the sporting event, and information regarding the position or location of the first communication device or the second communication device; and determining, with or using the computer, whether the bet is allowed or disallowed using the information regarding the position or location of the first communication device or the second communication device and, if the bet is allowed, processing information for placing the bet for or on behalf of the individual, or, if the bet is disallowed, processing information for disallowing the bet.

3. The computer-implemented method of claim 2, wherein the gaming activity, the gambling activity, or the sporting event, is a table game, a gaming machine game, a slot machine game, or a lottery.

4. The computer-implemented method of claim 2, further comprising:

determining whether the bet is a winning bet or a losing bet; and processing information for effectuating a payment to a gaming account, a gambling account, or a sports betting account, of or associated with the individual if the bet is a winning bet, or processing information for deducting funds from a gaming account, a gambling account, or a sports betting account, of or associated with the individual if the bet is a losing bet.

5. The computer-implemented method of claim 2, further comprising:

processing information for determining a state, a political subdivision, or a country, in which the first communication device or the second communication device is or was located at a time of the transmission of the bet message from the first communication device, or from the second communication device, to the computer.

6. The computer-implemented method of claim 5, further comprising:

processing information for effectuating a payment to the state, the political subdivision, or the country.

7. The computer-implemented method of claim 2, further comprising:

detecting a use of a gaming account, a gambling account, or a sports betting account, of or associated with the individual;

generating a gaming account use message, a gambling account use message, or a sports betting account use message; and transmitting the gaming account use message, the gambling account use message, or the sports betting account use message to the first communication device, the second communication device, or a third communication device.

8. The computer-implemented method of claim 2, further comprising:

transmitting video information or audio information of or regarding the gaming activity, the gambling activity, or the sporting event, to the first communication device, to the second communication device, or to a third communication device.

9. The computer-implemented method of claim 2, further comprising:

transmitting, to the first communication device, to the second communication device, or to a third communication device, information regarding a change in betting odds associated with the gaming activity, the gambling activity, or the sporting event, or transmitting, to the first communication device, to the second communication device, or to a third communication device, information regarding betting odds or a change in betting odds associated with a second gaming activity, a second gambling activity, or a second sporting event.

10. The computer-implemented method of claim 2, further comprising:

processing information regarding a placement of, or for placing, a second bet for or on behalf of the individual, or processing information regarding a placement of, or for placing, a private bet between the individual and a second individual.

11. The computer-implemented method of claim 2, further comprising:

processing information for purchasing a lottery ticket or lottery tickets for or on behalf of the individual or for or on behalf of a second individual, or for effectuating a payment for a lottery ticket or effectuating a payment for lottery tickets, or for receiving an electronic lottery ticket or electronic lottery tickets for or on behalf of the individual or for or on behalf of a second individual, or for receiving lottery game results, or for receiving electronic transfers of winnings for or on behalf of the individual or for or on behalf of a second individual, or for paying withholding taxes or income taxes on winnings for or on behalf of the individual or for or on behalf of a second individual, or for reporting the gaming activities of the individual or of a second individual to a governmental entity.

12. The computer-implemented method of claim 2, further comprising:

processing information for recording winnings of the individual, or for recording losses of the individual, or for recording net winnings of the individual, or for recording net losses of the individual, or for reporting winnings or losses of the individual to a taxing authority, or for withholding income taxes for the individual, or for paying withholding taxes to a taxing authority.

13. The computer-implemented method of claim 2, further comprising:

transmitting, to the first communication device, to the second communication device, or to a third communication device, information for promoting or for advertising the gaming activity, the gambling activity, the sporting event, a second gaming activity, a second gambling activity, or a second sporting event.

14. The computer-implemented method of claim 2, further comprising:

generating a lottery results message; and transmitting the lottery results message to the first communication device, to the second communication device, or to a third communication device.

15. The computer-implemented method of claim 2, further comprising:

processing information for purchasing a lottery ticket or lottery tickets for a lottery game or lottery games in or of a plurality of states, countries, or localities.

16. The computer-implemented method of claim 2, further comprising:

transmitting, to the first communication device, to the second communication device, or to a third communication device, information regarding a changed odds of winning, a changed score spread, an increased lottery prize or jackpot, changed or updated historical information or statistical information, or new or updated information regarding the gaming activity, a second gaming activity, the gambling activity, a second gambling activity, the sporting event, a second sporting event, a team, a player, an athlete, or a participant.

17. The computer-implemented method of claim 2, further comprising:

facilitating a posting of a second bet by the individual or by a second individual, or facilitating a participation in one or more gaming events by the individual or by a second individual, or providing information regarding one or more types or kinds of gaming events available on which to place one or more bets, wherein the information regarding the one or more types or kinds of gaming events available on which to place one or more bets includes information regarding a lottery odds of winning, a last winning draw, a last winning pay out, an odds of winning, a slot pay out, a frequency of user wins, an amount of user wins, a frequency of user wins at a table game, an amount of a user win at a table game, roulette wheel wins by users, or an amount of roulette wins.

18. A computer-implemented method, comprising:

detecting, with or using a computer which is specially programmed for processing information for providing for a placement of a bet on or regarding a sporting event, a posting of information regarding the sporting event;

generating, with or using the computer, a notification message regarding the sporting event;

initiating, with or using the computer, a communication link with a first communication device and transmitting the notification message to the first communication device as an electronic transmission, or transmitting, from the computer, the notification message as an electronic mail message, wherein the electronic mail message is received by or received at a first communication device, wherein the first communication device is associated with an individual;

receiving, with the computer, a bet message transmitted from the first communication device or from a second communication device, wherein the second communication device is associated with the individual, and further wherein the first communication device or the second communication device comprises a global positioning device, wherein the global positioning device determines a position or location of the first communication device or the second communication device, and further wherein the bet message contains information regarding a bet to be placed on or regarding the sporting event and information regarding the position or location of the first communication device or the second communication device; and determining, with or using the computer, whether the bet is allowed or disallowed using the information regarding the position or location of the first communication device or the second communication device and, if the bet is allowed, processing information for placing the bet for or on behalf of the individual, or, if the bet is disallowed, processing information for disallowing the bet.

19. The computer-implemented method of claim 18, further comprising:

transmitting, to the first communication device, to the second communication device, or to a third communication device, information regarding the sporting event or a second sporting event, and further wherein the information regarding the sporting event or the second sporting event contains information regarding teams records, sports players records, averages, statistics, statistical or historical records, probabilistic information, statistical or historical records regarding the sporting event or the second sporting event, player statistics against an opposing team, historical records regarding prior meetings of teams, a player injury or player injuries, a game line-up, or game line-ups.

20. The computer-implemented method of claim 18, further comprising:

transmitting, to the first communication device, to the second communication device, or to a third communication device, information regarding a change in betting odds associated with the sporting event, information regarding betting odds or a change in betting odds associated with a second sporting event, or information regarding a changed odds of winning, a changed score spread, changed or updated historical information or statistical information, or new or updated information regarding the sporting event, a second sporting event, a team, a player, or an athlete.

* * * * *